US012239232B2

(12) United States Patent
Karschnik et al.

(10) Patent No.: US 12,239,232 B2
(45) Date of Patent: Mar. 4, 2025

(54) BED SENSORS

(71) Applicant: Sleep Number Corporation, Minneapolis, MN (US)

(72) Inventors: Kody Lee Karschnik, Plymouth, MN (US); Dillon Pedersen, Saint Paul, MN (US); Eric Rose, Piedmont, SC (US); Wade Daniel Palashewski, Andover, MN (US); Daniel VerBockel, St. Louis Park, MN (US)

(73) Assignee: Sleep Number Corporation, Minneapolis, MN (US)

( * ) Notice: Subject to any disclaimer, the term of this patent is extended or adjusted under 35 U.S.C. 154(b) by 199 days.

(21) Appl. No.: 17/683,594

(22) Filed: Mar. 1, 2022

(65) Prior Publication Data

US 2022/0273115 A1 Sep. 1, 2022

Related U.S. Application Data

(60) Provisional application No. 63/155,040, filed on Mar. 1, 2021.

(51) Int. Cl.

| | |
|---|---|
| ***A47C 27/08*** | (2006.01) |
| ***A47C 27/10*** | (2006.01) |
| ***A47C 27/18*** | (2006.01) |

(52) U.S. Cl.

CPC ..... *A47C 27/083* (2013.01); *A47C 27/10* (2013.01); *A47C 27/18* (2013.01)

(58) Field of Classification Search

CPC ..... A47C 27/08; A47C 27/081; A47C 27/082; A47C 27/083; A47C 27/084; A47C 27/10; A47C 27/12; A47C 27/14; A47C 27/142; A47C 27/144; A47C 27/146; A47C 27/148; A47C 27/15; A47C 27/16; A47C 27/18

See application file for complete search history.

(56) References Cited

U.S. PATENT DOCUMENTS 5,948,303 A 9/1999 Larson
5,964,720 A * 10/1999 Pelz ..... A61B 5/6887 600/595

(Continued)

FOREIGN PATENT DOCUMENTS

CN 211355424 8/2020
WO WO 2003/013355 2/2003

(Continued)

OTHER PUBLICATIONS

U.S. Appl. No. 15/685,912, filed Aug. 24, 2017, Petrovski et al.

(Continued)

*Primary Examiner* — George Sun
(74) *Attorney, Agent, or Firm* — Fish & Richardson P.C.

(57) ABSTRACT

A mattress system can include a foam layer positioned proximate a mattress top and having a head end, a foot end, and opposite lateral ends, a mattress core positioned under the foam layer, and a sensor strip. The sensor strip can include a carrier strip and a plurality of sensors attached to the carrier strip and spaced apart from each other in a longitudinal direction of the carrier strip. The carrier strip can be configured to be releasably attached to the foam layer. The carrier strip can also extend between the opposite lateral ends of the foam layer.

19 Claims, 30 Drawing Sheets

(56) References Cited

U.S. PATENT DOCUMENTS

| | | | | |
|---|---|---|---|---|
| 7,245,956 | B2 * | 7/2007 | Matthews | A61B 5/282 600/382 |
| 7,877,827 | B2 | 2/2011 | Comiskey et al. | |
| 7,996,936 | B2 | 8/2011 | Comiskey et al. | |
| 8,065,763 | B2 | 11/2011 | Brykalski et al. | |
| 8,144,001 | B1 * | 3/2012 | D'Souza | A47C 31/105 340/573.1 |
| 8,161,826 | B1 * | 4/2012 | Taylor | A47C 27/082 73/862.041 |
| 8,181,290 | B2 | 5/2012 | Brykalski et al. | |
| 8,191,187 | B2 | 6/2012 | Brykalski et al. | |
| 8,332,975 | B2 | 12/2012 | Brykalski et al. | |
| 8,402,579 | B2 | 3/2013 | Comiskey et al. | |
| 8,418,286 | B2 | 4/2013 | Brykalski et al. | |
| 8,621,687 | B2 | 1/2014 | Brykalski et al. | |
| 8,732,874 | B2 | 5/2014 | Brykalski et al. | |
| 8,782,830 | B2 | 7/2014 | Brykalski et al. | |
| 8,893,329 | B2 | 11/2014 | Petrovski et al. | |
| 9,125,497 | B2 | 9/2015 | Brykalski et al. | |
| 9,131,781 | B2 | 9/2015 | Zaiss et al. | |
| 9,603,459 | B2 | 3/2017 | Brykalski et al. | |
| 9,622,588 | B2 | 4/2017 | Brykalski et al. | |
| 9,814,641 | B2 | 11/2017 | Brykalski et al. | |
| 9,974,394 | B2 | 5/2018 | Brykalski et al. | |
| 10,194,752 | B2 | 2/2019 | Zaiss et al. | |
| 10,226,134 | B2 | 3/2019 | Brykalski et al. | |
| 10,314,407 | B1 | 6/2019 | Main et al. | |
| 10,393,599 | B2 * | 8/2019 | Cotton | G01L 1/14 |
| 10,405,667 | B2 | 9/2019 | Comiskey et al. | |
| 10,675,198 | B2 | 6/2020 | Brykalski et al. | |
| 10,772,438 | B2 | 9/2020 | Griffith et al. | |
| 11,020,298 | B2 | 6/2021 | Brykalski et al. | |
| 11,045,371 | B2 | 6/2021 | Brykalski et al. | |
| 11,083,308 | B2 | 8/2021 | Zaiss et al. | |
| 11,297,953 | B2 | 4/2022 | Brykalski et al. | |
| 2003/0045806 | A1 * | 3/2003 | Brydon | A61B 5/0816 600/534 |
| 2003/0141983 | A1 | 7/2003 | Schmiz et al. | |
| 2004/0083550 | A1 * | 5/2004 | Graebe, Jr. | A47C 27/083 5/713 |
| 2008/0169931 | A1 * | 7/2008 | Gentry | A61B 5/1117 600/300 |
| 2011/0247143 | A1 * | 10/2011 | Richards | A61G 7/05776 417/313 |
| 2011/0265898 | A1 * | 11/2011 | Driscoll, Jr. | F04B 45/04 137/565.16 |
| 2014/0026320 | A1 | 1/2014 | Comiskey et al. | |
| 2014/0026327 | A1 * | 1/2014 | Taylor | A61B 5/6887 5/713 |
| 2015/0238020 | A1 | 8/2015 | Petrovski et al. | |
| 2016/0015183 | A1 * | 1/2016 | Stjerna | A47C 27/082 5/690 |
| 2016/0066701 | A1 | 3/2016 | Diller et al. | |
| 2016/0073788 | A1 * | 3/2016 | Franceschetti | A61B 5/01 219/486 |
| 2017/0035636 | A1 * | 2/2017 | Stiff | A61G 7/05776 |
| 2017/0071359 | A1 | 3/2017 | Steele et al. | |
| 2017/0273470 | A1 | 9/2017 | Brykalski et al. | |
| 2017/0280883 | A1 | 10/2017 | Diller | |
| 2017/0290548 | A1 * | 10/2017 | Tarsaud | A61B 5/4818 |
| 2019/0099009 | A1 * | 4/2019 | Connor | A61B 5/398 |
| 2019/0201271 | A1 * | 7/2019 | Grey | A61B 5/6892 |
| 2019/0320808 | A1 * | 10/2019 | Chapin | A47C 21/044 |
| 2020/0337470 | A1 | 10/2020 | Sayadi et al. | |
| 2020/0375542 | A1 * | 12/2020 | Haggis | A61B 5/02444 |
| 2020/0405525 | A1 * | 12/2020 | Yu | A47G 9/1027 |
| 2021/0037987 | A1 | 2/2021 | Griffith et al. | |
| 2021/0038453 | A1 | 2/2021 | Brykalski et al. | |
| 2021/0186224 | A1 * | 6/2021 | Chapin | A47C 27/15 |
| 2021/0204706 | A1 | 7/2021 | Karschnik et al. | |
| 2021/0204709 | A1 | 7/2021 | Grabinger et al. | |
| 2021/0204710 | A1 | 7/2021 | Grabinger et al. | |
| 2021/0204711 | A1 | 7/2021 | Karschnik et al. | |
| 2021/0204712 | A1 | 7/2021 | Karschnik et al. | |
| 2021/0204713 | A1 | 7/2021 | Karschnik et al. | |
| 2021/0204714 | A1 | 7/2021 | Karschnik et al. | |
| 2021/0204715 | A1 | 7/2021 | Karschnik et al. | |
| 2021/0204716 | A1 | 7/2021 | Karschnik et al. | |
| 2021/0204719 | A1 | 7/2021 | Grabinger et al. | |
| 2021/0204720 | A1 | 7/2021 | Karschnik et al. | |
| 2021/0244192 | A1 * | 8/2021 | Kirchhoff | B68G 11/04 |
| 2021/0322237 | A1 | 10/2021 | Brykalski et al. | |
| 2021/0322238 | A1 | 10/2021 | Brykalski et al. | |
| 2021/0401185 | A1 | 12/2021 | Zaiss et al. | |
| 2022/0015971 | A1 * | 1/2022 | Rowe | A47C 31/008 |
| 2022/0361787 | A1 * | 11/2022 | Burwinkel | A61B 5/7275 |

FOREIGN PATENT DOCUMENTS

| | | |
|---|---|---|
| WO | WO 2009/036077 | 3/2009 |
| WO | WO 2019/209733 | 10/2019 |

OTHER PUBLICATIONS

U.S. Appl. No. 15/973,279, filed May 7, 2018, Brykalski et al.
U.S. Appl. No. 17/559,515, filed Dec. 22, 2021, Molina et al.
U.S. Appl. No. 17/683,594, filed Mar. 1, 2022, Karschnik et al.
U.S. Appl. No. 17/692,959, filed Mar. 11, 2022, Karschnik et al.
U.S. Appl. No. 17/717,785, filed Apr. 11, 2022, Brykalski et al.
International Search Report and Written Opinion in International Appln. No. PCT/US2022/018301, mailed Jun. 13, 2022, 16 pages.

* cited by examiner

BED SENSORS

CROSS-REFERENCE TO RELATED APPLICATIONS

This application claims the benefit of U.S. Provisional Patent Application No. 63/155,040, filed Mar. 1, 2021. The disclosure of the prior application is considered part of (and is incorporated by reference in) the disclosure of this application.

TECHNICAL FIELD

This document relates to bed systems, and more particularly, to devices, systems, and methods for detecting parameters, such as temperature and humidity, associated with a bed or a user of the bed.

BACKGROUND

In general, a bed is a piece of furniture used for sleeping and relaxing. Many modern beds include a soft mattress on a bed frame. The mattress may include springs, foam material, and/or an air chamber to support the weight of one or more users. Various features and systems have been used in conjunction with beds, including heating and cooling systems and temperature sensors for heating and cooling the one or more users of the bed.

SUMMARY

Some embodiments described herein include a bed system with a sensor strip for sensing one or more parameters, such as temperature and/or humidity values, user presence, etc., of the bed system and/or a user. The bed system can include a microclimate control system that can be configured to control a microclimate of the bed system. In some implementations, the control system operates to supply conditioned air (e.g., heated or cooled air) to a mattress to achieve a desired temperature at a top of the mattress of the bed system. In some implementations, the control system operates to draw air from the mattress to achieve a desired cooler temperature at the top of the mattress. The conditioned air to supply can be determined based at least on one or more temperature and/or humidity values that are sensed by one or more sensors of the sensor strip. The user can also control the conditioned air supply from a remote control or an application on a mobile device. The user can receive temperature and/or humidity values from the bed system. The user can also provide the bed system with desired temperature and/or humidity values, which the bed system (e.g., via the microclimate control system) can use in addition to the sensed temperature and/or humidity values to determine an appropriate conditioned air supply and an understanding of comfort levels of the user.

The sensor strip can be used to detect a mattress microclimate temperature. In some implementations, the sensor strip can also be used to detect a mattress surface temperature and/or a user located on the mattress surface. The temperature detected by the strip can be used to estimate a body temperature of the user. More particularly, a temperature of the user's skin can be estimated using the temperature detected by the strip. In some implementations, the user's core body temperature can also be estimated using the disclosed techniques. The strip can also be used to detect a humidity levels of the mattress and/or the user. The sensor strip can include a plurality of sensors that are wired in series. The sensors can be temperature and/or humidity sensing sensors. The strip can be attached to a top layer of the mattress, such as a foam tub, and extend across the mattress from a right to a left side (e.g., opposite lateral sides of the mattress). In some implementations, the strip can be positioned at a midpoint of the mattress between head and foot ends of the mattress. This positioning can have a minimal impact on comfortability of the user when laying on top of the mattress. This positioning can also be advantageous to avoid measuring ambient conditions when covers are partially rolled down on the mattress. Moreover, this positioning can maintain left and right sides (and/or head and foot sides) of the mattress as uniform such that the mattress can be rotated around during assembly without impacting placement and usage of the sensor strip. In some implementations, the strip can be positioned closer to a head end of the mattress than the foot end of the mattress such that the strip is located at the user's chest area. The strip can also be positioned one or more distances from either the head end or the foot end of the mattress. As an illustrative example, the strip can be positioned approximately 30 inches down from the head end of the mattress for an 80 inch long mattress.

The strip can attach and secure to the top layer of the mattress. In some implementations, the strip can wrap over a side of the top layer and/or one or more other layers of the mattress. Using a micro-hook at one end of the sensor strip, the strip can be attached to a bottom of the mattress to keep the strip in place. In addition or alternatively, one or more additional adhesives or fastener elements can be used to retain the sensor strip to a top surface of the top layer and/or the sides of the mattress. In some implementations, the sensor strip can be attached to reinforcement straps that extend across the bottom of the mattress. One or more adhesives or fastener elements can be used to retain the sensor strip to the reinforcement straps. As a result, the sensor strip may not be directly attached to surfaces of the mattress, such as the bottom of the mattress, the top layer, and/or the sides of the mattress. Alternatively, the sensor strip and the reinforcement strap can be made as a single strap that wraps around the mattress and functions to both reinforce the assembly of the mattress at the bottom and provide sensing features at the top of the mattress. For example, the sensor strip can be provided as an extension of the reinforcement strap so that the sensor strip and the reinforcement is an integral piece.

A mattress cover can be placed over the sensor strip and the mattress, thereby concealing the strip from view and ensuring the strip does not obstruct movement or comfort of the user. The sensor strip is engaged with the top layer of the mattress with sufficient attachment force, and thus does not need additional attachment to the mattress cover. The attachment mechanisms of the sensor strip to the mattress layer (as opposed to the matter cover) improve stability and serviceability of the sensor strip, as described further herein. In some alternative implementations, the sensor strip can be incorporated into the mattress cover. For example, the sensor strip can be integrated into the mattress cover in the form of a sleeve so that the sensor strip does not attach to the mattress. The sleeve can then be integrated into an internal surface of the mattress cover rather than the external surface of the mattress cover closest to the sleeper surface.

According to implementations of the present disclosure, the sensor strip is conveniently replaceable with another sensor strip for maintenance and upgrades. The simple configurations of the sensor strip itself, as well as the simple mechanisms for attaching the sensor strip to the mattress, allow for easy detachment of the sensor strip from the mattress. Thus, the sensor strip can be easily swapped by another sensor strip that may have different sensing types (e.g., swapping from temperature sensors to a combination of temperature and humidity sensors) or may have upgraded features, such as improved sensing capability and processing performance.

Particular embodiments described herein include a mattress system having a foam layer positioned proximate a mattress top and having a head end, a foot end, and opposite lateral ends, and a sensor strip including a carrier strip, and a plurality of sensors attached to the carrier strip and spaced apart from each other in a longitudinal direction of the carrier strip, the carrier strip configured to be releasably attached to the foam layer and extend between the opposite lateral ends of the foam layer.

In some implementations, the system can optionally include one or more of the following features. For example, the mattress system can include a mattress cover disposed on the foam layer and covering the foam layer and the sensor strip. The mattress cover can be free of the carrier strip that is attached to the foam layer. The carrier strip can also include a first strip surface and a second strip surface opposite to the first strip surface, the first strip surface configured to be releasably attached to the foam layer. The plurality of sensors can be disposed at the first strip surface of the carrier strip. The carrier strip can also have a first strip surface and a second strip surface opposite to the first strip surface, the first strip surface configured to be releasably attached to the foam layer. The plurality of sensors can be disposed at the second strip surface of the carrier strip. The plurality of sensors can be stitched to the carrier strip. The plurality of sensors can be attached to the carrier strip by adhesive. The plurality of sensors can be wired in series.

As another example, the carrier strip can include a first fastener that can be releasably attached to the foam layer. The foam layer can include a second fastener that can be releasably attached to the first fastener of the carrier strip. The first and second fasteners can include hook-and-loop fasteners.

As another example, the carrier strip can include a sensor cover layer that can be attached to the first strip surface and cover at least part of the plurality of sensors at the first strip surface. The carrier strip can include opposite lead portions that can be configured to be releasably attached to opposite sides of the foam layer. The opposite lead portions of the carrier strip can be configured to be releasably attached to opposite sides of at least a portion of the mattress system.

Particular embodiments described herein can also include a mattress system having a foam layer positioned proximate a mattress top and having a head end, a foot end, and opposite lateral ends, a first air chamber positioned under a first portion of the foam layer, a second air chamber positioned under a second portion of the foam layer, wherein the first portion and the second portion are arranged side-by-side between the opposite lateral ends of the foam layer, a sensor strip including: a carrier strip having a first strip portion and a second strip portion, a plurality of first sensors attached to the first strip portion of the carrier strip and spaced apart from each other in a longitudinal direction of the carrier strip, and a plurality of second sensors attached to the second strip portion of the carrier strip and spaced apart from each other in the longitudinal direction of the carrier strip. The carrier strip can be configured to be releasably attached to the foam layer and extend between the opposite lateral ends of the foam layer, the first strip portion and the second strip portion can be configured to be disposed at the first portion and the second portion of the foam layer, respectively.

In some implementations, the system can optionally include one or more of the following features. For example, the system can also include a mattress cover disposed on the foam layer and covering the foam layer and the sensor strip. The mattress cover can be free of the carrier strip that can be attached to the foam layer. The carrier strip can have a first strip surface and a second strip surface opposite to the first strip surface, the first strip surface can be configured to be releasably attached to the first portion and the second portion of the foam layer. The plurality of first sensors and the plurality of second sensors can be disposed at the first strip surface of the carrier strip. The carrier strip can have a first strip surface and a second strip surface opposite to the first strip surface, the first strip surface can be configured to be releasably attached to the first portion and the second portion of the foam layer, and the plurality of first sensors and the plurality of second sensors can be disposed at the second strip surface of the carrier strip. The plurality of first sensors and the plurality of second sensors can be stitched to the carrier strip. The plurality of first sensors and the plurality of second sensors can be attached to the carrier strip by adhesive. The plurality of first sensors and the plurality of second sensors can be wired in series. The first strip portion of the carrier strip can include a first fastener and the second strip portion of the carrier strip includes a second fastener, and the first fastener can be configured to be releasably attached to the first portion of the foam layer and the second fastener can be configured to be releasably attached to the second portion of the foam layer. The first portion of the foam layer can include a third fastener that can be configured to releasably attach the first fastener of the first strip portion of the carrier strip, and the second portion of the foam layer can include a fourth fastener that can be configured to releasably attach the second fastener of the second strip portion of the carrier strip. The first, second, third, and fourth fasteners can include hook-and-loop fasteners.

The carrier strip can include a sensor cover layer that can be attached to the first strip surface and can cover at least part of the plurality of first sensors and the plurality of second sensors at the first strip surface. The carrier strip can include opposite lead portions that can be configured to be releasably attached to opposite sides of the foam layer. The opposite lead portions of the carrier strip can be configured to be releasably attached to opposite sides of at least a portion of the mattress system. The opposite lead portions of the carrier strip can be nine feet long. The first strip portion of the carrier strip can be spaced ten inches apart from the second strip portion of the carrier strip. The plurality of first sensors can be spaced five inches apart from each other on the first strip portion of the carrier strip and the plurality of second sensors can be spaced five inches apart from each other on the second strip portion of the carrier strip.

As another example, the mattress system can be king-sized, California king-sized, queen-sized, full size, or twin size. The plurality of sensors can be spaced five inches apart from each other in the longitudinal direction of the carrier strip. The sensor strip can be configured to be releasably attached to the foam layer free of an intermediary surface between the sensor strip and the foam layer. The sensor strip can include micro-hooks configured to releasably attach directly to a surface of the foam layer. The micro-hooks can be configured to releasably attach directly to a bottom surface of the foam layer.

As another example, the mattress system can include loop fasteners attached to a bottom surface of the foam layer. The sensor strip can include hook fasteners that can be configured to releasably attach to the loop fasteners. The mattress system can also include a mattress core positioned under the compressible layer.

Particular embodiments described herein can also include a mattress system having a top layer positioned proximate a mattress top and having a head end, a foot end, and opposite lateral ends, and a sensor strip including: a carrier strip, and a plurality of sensors attached to the carrier strip and spaced apart from each other in a longitudinal direction of the carrier strip, the carrier strip configured to be releasably attached to the top layer and extend between the opposite lateral ends of the top layer. The top layer can be a compressible material, foam, or fabric.

Particular embodiments described herein can also include a method for providing a mattress. The method can include arranging a set of mattress layers in place, the layers including a foam layer, the foam layer being positioned proximate a mattress top and having a head end, a foot end, and opposite lateral ends, attaching a first sensor strip to the foam layer of the mattress layers between the opposite lateral ends of the foam layer, and placing a mattress cover on the foam layer to cover the foam layer and the first sensor strip. The mattress cover can be free of the first sensor strip that is attached to the foam layer. The method can also include removing the mattress cover from the foam layer, detaching the first sensor strip from the foam layer, attaching a second sensor strip to the foam layer in place of the first sensor strip, and placing the mattress cover on the foam layer to cover the foam layer and the second sensor strip. The mattress cover can be free of the second sensor strip that is attached to the foam layer.

In some implementations, the system can optionally include one or more of the following features. For example, the second sensor strip can include a plurality of sensors that are different in type from a plurality of sensors of the first sensor strip. The second sensor strip can include a plurality of sensors that are different in number and arrangement from a plurality of sensors of the first sensor strip. The method can also include attaching a reinforcement strap across a bottom of the set of mattress layers, and attaching the first sensor strip to the reinforcement strap at the bottom of the set of mattress layers. Detaching the first sensor strip from the foam layer can also include detaching the first sensor strip from the reinforcement strap at the bottom of the set of mattress layers, and detaching the first sensor from the foam layer at the mattress top. The method can also include attaching the second sensor strip to the reinforcement strap at the bottom of the set of mattress layers. The method can also include attaching a reinforcement strap across a bottom of the set of mattress layers, and attaching the first sensor strip onto the bottom of the set of mattress layers adjacent to the reinforcement strap.

Particular embodiments described herein include a mattress system having: a foam layer positioned proximate a mattress top and having a head end, a foot end, and opposite lateral ends and a sensor strip including: a carrier strip, and a group of sensors attached to the carrier strip and spaced apart from each other in a longitudinal direction of the carrier strip, the carrier strip being configured to be releasably attached to the foam layer and extend between the opposite lateral ends of the foam layer.

In some implementations, the system can optionally include one or more of the following features. For example, the system can also include a mattress cover disposed on the foam layer and covering the foam layer and the sensor strip, the mattress cover being free of the carrier strip that is attached to the foam layer. The carrier strip can have a first strip surface and a second strip surface opposite to the first strip surface, the first strip surface being configured to be releasably attached to the foam layer, and the group of sensors can be disposed at the first strip surface of the carrier strip. The group of sensors can also be stitched to the carrier strip. The plurality of sensors can be attached to the carrier strip by adhesive. In some implementations, the carrier strip can include a first fastener that can be configured to be releasably attached to the foam layer, the foam layer can include a second fastener that can be configured to releasably attach the first fastener of the carrier strip, and the first and second fasteners can include hook-and-loop fasteners. In some implementations, the group of sensors can be spaced five inches apart from each other in the longitudinal direction of the carrier strip. The sensor strip can include micro-hooks that can be configured to releasably attach directly to a surface of the foam layer.

As another example, the carrier strip can extend between a midpoint of the foam layer and a location that is a predetermined distance away from an edge of a first lateral end of the opposite lateral ends of the foam layer. The carrier strip may not extend over the edge of the first lateral end of the opposite lateral ends of the foam layer. In some implementations, the carrier strip may not extend over either of opposite sides of the foam layer, and the group of sensors can include wires, the wires being collectively routed over an edge of a first lateral end of the opposite lateral ends of the foam layer and down one of the opposite sides of the foam layer. The plurality of sensors can include wires, the wires being collectively routed through at least one hole defined through the foam layer. The sensor strip further can include a group of additional materials. Each of the group of additional materials can be ultrasonically welded to the carrier strip between each of the group of sensors in the longitudinal direction of the carrier strip. At least one of the group of additional materials can form at least one of (i) a circle around at least one of the group of sensors and (ii) a triangle around at least one of the group of sensors. At least one of the group of additional materials can form a square around at least one of the group of sensors. At least one of the group of additional materials can extend a length between two consecutive sensors of the group of sensors in the longitudinal direction of the carrier strip. Each of the group of additional materials can be welded to the carrier strip in welding locations that straddle a wire that wiredly connects the group of sensors in series in the longitudinal direction of the carrier strip.

Particular embodiments described herein include a mattress system having: a foam layer positioned proximate a mattress top and having a head end, a foot end, and opposite lateral ends, a first air chamber positioned under a first portion of the foam layer, a second air chamber positioned under a second portion of the foam layer, the first portion and the second portion being arranged side-by-side between the opposite lateral ends of the foam layer, and a sensor strip. The sensor strip can include a carrier strip having a first strip portion and a second strip portion, a group of first sensors attached to the first strip portion of the carrier strip and spaced apart from each other in a longitudinal direction of the carrier strip, a group of second sensors attached to the second strip portion of the carrier strip and spaced apart from each other in the longitudinal direction of the carrier strip. The carrier strip can be configured to be releasably attached to the foam layer and extend between the opposite lateral ends of the foam layer, and the first strip portion and the second strip portion can be configured to be disposed at the first portion and the second portion of the foam layer, respectively.

In some implementations, the system can optionally include one or more of the following features. For example, the carrier strip can have a first strip surface and a second strip surface opposite to the first strip surface, the first strip surface being configured to be releasably attached to the first portion and the second portion of the foam layer, and the group of first sensors and the group of second sensors can be disposed at the first strip surface of the carrier strip. The group of first sensors can be spaced five inches apart from each other on the first strip portion of the carrier strip and the group of second sensors can be spaced five inches apart from each other on the second strip portion of the carrier strip.

Particular embodiments described herein include a mattress system having: a top layer positioned proximate a mattress top and having a head end, a foot end, and opposite lateral ends and a sensor strip including: a carrier strip, and a group of sensors attached to the carrier strip and spaced apart from each other in a longitudinal direction of the carrier strip, the carrier strip being configured to be releasably attached to the top layer and extend between the opposite lateral ends of the top layer.

The devices, system, and techniques described herein may provide one or more of the following advantages. For example, the sensor strip configuration described herein can improve stability. Using a micro-hook attachment at ends of the sensor strip can secure the strip in place. Moreover, using adhesive or other fasteners along a length of the sensor strip can securely attach the strip to the top layer of the mattress (e.g., foam). As a result, the sensor strip may not move around as the user moves on top of the mattress. The stability provided by the sensor strip configuration described herein can also be advantageous to sense consistent temperature and/or humidity values. In other words, because the strip can be retained in a same position on the top layer of the mattress, sensors on the strip can continuously capture sensor values associated with the same region of the mattress. These sensor values can then be used to more accurately determine temperature and/or humidity trends, user body temperature, desired airflow supplies, bed occupancy, and user sleeping positions (e.g., back, side, etc.). Alternative approaches, on the other hand, can include attaching sensors to an inside of the mattress cover. This approach, however, may not provide stability because the mattress cover can be significantly moved and/or shifted as the user moves on top of the mattress. The sensors can easily detach from the mattress cover due to continuous movement of the cover and/or the user on top of the mattress. Furthermore, when the sensors detach and/or are constantly being moved, they may not provide for accurate temperature and/or humidity readings. As a result, the bed system may not accurately capture temperature and/or humidity values to provide desired airflow supplies to the mattress.

As another example, the sensor strip configuration described herein can improve serviceability. Typically, sensors have a lifespan and may break (e.g., moisture builds up) or need to be replaced for varying reasons. Attaching sensors in series to the strip can make servicing the sensors easier and faster. On the other hand, sensors that are not attached in series can make it challenging to identify which sensor to fix and/or replace. Additionally, when sensors are attached to the inside of the mattress cover, the cover has to be taken off the mattress and then flipped inside-out for a user to service any one of the sensors and/or remove the entire array of sensors. This configuration can make servicing more challenging and a longer process. The disclosed sensor strip configuration, on the other hand, makes it easier and faster to remove the entire sensor strip from the bed system. Since all of the sensors can be attached in series to the strip, the entire strip can be removed and replaced with another strip. The user does not have to test and/or identify which sensor needs servicing, which can speed up the servicing process. Thus, the user of the bed may not require a technician or other specialist to assist in the servicing process. The user of the bed can merely remove the strip from the mattress and replace it with another strip that the user purchased. Moreover, because the strip can be attached to a bottom of the mattress using a micro-hook, the strip can more easily be detached and taken off the bed system. The user can merely release the micro-hook attachment and pull the strip off the mattress. Therefore, servicing the sensor strip can be accomplished faster and more easily.

As yet another example, the disclosed sensor strip configuration can provide for easier application to any mattress or bed system. The sensor strip can easily be attached to the bed system using the micro-hook attachment at each end of the strip. The user of the bed can place the strip across the top surface of the mattress proximate to the chest area. The user can then secure the strip in place by attaching the micro-hook to the bottom of the mattress. Once the user places the mattress cover over this configuration, the user does not have to worry about movement of the sensor strip for reasons described above. Furthermore, the sensor strip can be purchased as an add-on and applied to any mattress configuration. The sensor strip can be attached to a king, California-king, queen, twin, full, twin XL, flexible top king, split king, flexible top California-king, and/or split California-king mattress. Temperature and/or humidity values can be determined for any of these mattress configurations to provide for desired airflow supplies as well as biometric and user sleeping detection information.

As another example, the sensor strip configuration described herein can be advantageous to provide different airflow supplies to different portions of the bed system. For example, in a king-sized bed system, the mattress can have two side-by-side air chambers that are configured to provide airflow supply to each side of the mattress. The sensor strip can include a plurality of first sensors and a plurality of second sensors, wherein each plurality of sensors are positioned over each air chamber. The plurality of first sensors can capture parameters, such as temperature and/or humidity values, associated with a portion of the mattress surface above a first air chamber while the plurality of second sensors can capture parameters, such as temperature and/or humidity values, associated with a portion of the mattress surface above a second air chamber. The bed system can use these values to determine desired airflow supplies for each portion of the mattress, instead of providing a universal airflow supply to the entire mattress. By way of example, a user on the portion of the mattress above the first air chamber can have a higher determined body temperature and the bed system can provide a supply of cool air through the first air chamber. A user on the portion of the mattress above the second air chamber can, for example, have a lower determined body temperature, so the bed system can provide a supply of warm air through the second air chamber. Therefore, the sensor strip configuration described herein can provide for more individualized management of airflow through the mattress to meet the needs of more than one user on top of the mattress.

The details of one or more implementations are set forth in the accompanying drawings and the description below.

Other features and advantages will be apparent from the description and drawings, and from the claims.

DETAILED DESCRIPTION OF ILLUSTRATIVE EMBODIMENTS

This document generally pertains to a bed system with a sensor strip for sensing temperature and/or humidity values of the bed system and/or a user.

Figure 1:
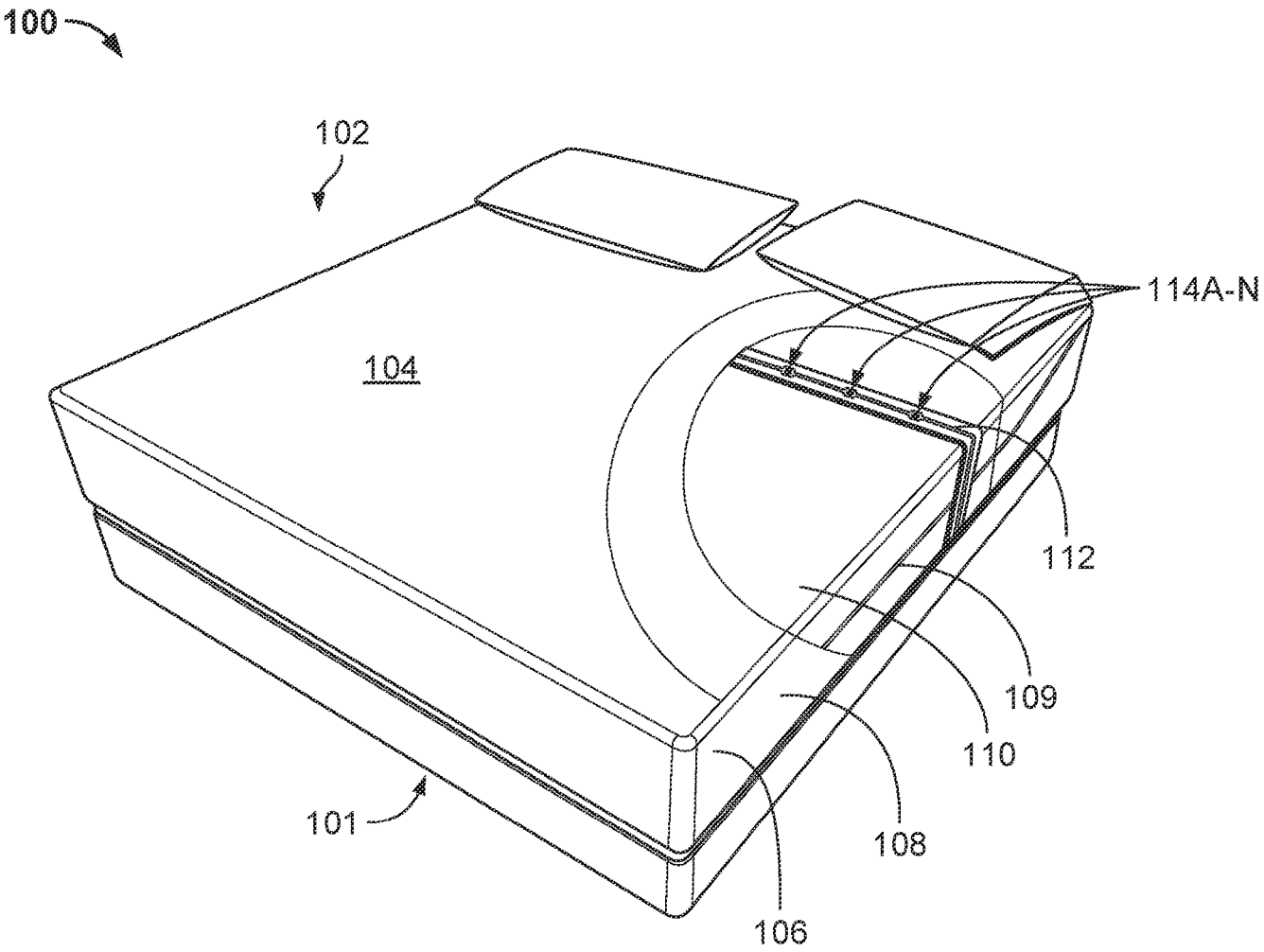
FIG. 1 illustrates an example bed system having a sensor strip as described herein.

Referring to the figures, FIG. 1 illustrates an example bed system 100 having a sensor strip 112 as described herein. The bed system 100 can include a mattress 102 that can be placed on a foundation 101. In some implementations, the foundation 101 can be optionally included in the example bed system 100. Thus, the bed system 100 or other bed systems may not include the foundation 101. The mattress 102 can have a mattress top 104 and one or more layers, including a foam tub 110 or top layer, an intermediate layer 108, and a bottom layer 109. In other words, the foam tub 110 or layer can be positioned proximate the mattress top 104 and having a head end, a foot end, and opposite lateral ends. Any one or more of the layers 110, 108, and 109 can be compressible layers and made of foam, fabric, or another compressible material. The mattress 102 can also include air chambers and an airflow supply system, as described throughout this disclosure. The air chambers can be in a mattress core positioned under the foam tub layer 110 and can be inflatable to various pressures so as to provide variable firmness to a user on the mattress. The airflow supply system can provide ambient or conditioned (e.g., cooled or warmed) air to the top surface of the mattress 102, or draw ambient or conditioned air from the top surface of the mattress 102, thereby controlling a microclimate at the top surface of the mattress 102.

The sensor strip 112 can be placed on top of the foam tub 110 on the mattress top 104. The sensor strip 112 can extend across the mattress 102 from one of the opposing lateral sides to another lateral side (e.g., from left to right sides of the mattress 102). The sensor strip 112 can be attached closer to a head end of the mattress 102 than a foot end of the mattress 102. For example, the sensor strip 112 can be disposed such that parameters, such as temperature and/or humidity values, can be measured of a user around their chest area. The sensor strip 112 can be attached using adhesive along the top of the foam tub 110. In other examples, the strip 112 may not be attached along the top of the foam tub 110 using adhesives. Instead, the strip 112 can be attached to sides and/or a bottom of the mattress 102. The strip 112 can be made of a fabric or other flexible materials. In some implementations, such a fabric or other flexible materials are selected to be suitable to accommodate a change in shape of the top of the foam tub 110. In addition, the material of the strip 112 can also be stretchable. The configuration of the sensor strip 112 described herein is advantageous because it may not cause any negative impact on comfort of a user laying on top of the mattress 102. The sensor strip 112 can be attached flush to the top of the foam tub 110. Any wiring used to connect sensors on the sensor strip 112 can be arranged and attached to the strip 112 in such a way that the wires do not cause discomfort to the user (e.g., refer to FIGS. 4-11). Moreover, the configuration of the sensor strip 112 as described herein is advantageous because none of the strip 112 components may be aesthetically visible from outside of the mattress 102. In other words, once a mattress cover 106 is positioned over the sensor strip 112, the strip 112 and/or any wires can be hidden from view of the user. The wires can be aligned down a side of the mattress 102 such that the wires are neither visible nor causing an obstructions to the user when the user gets in and out of the bed system 100.

The sensor strip 112 can wrap over an edge of the foam tub 110 (e.g., compressible layer) and down a side of the mattress 102. For example, the strip 112 can be attached along a side of the foam tub 110, the intermediate layer 108, and the bottom layer 109. The strip 112 can then attach to a bottom of the mattress 102 by a micro-hook or other similar fastening element (e.g., adhesive, VELCRO). In other examples, the strip 112 can attach to one or more of the foam tub 110, the intermediate layer 108, or the bottom layer 109 without attaching to the bottom of the mattress 102. The micro-hook fastening means can make it quick and easy to configure the sensor strip 112 to any mattress configuration. A user may not have to move the mattress 102 on the foundation 101 in order to attach the sensor strip 112 to the mattress 102. Moreover, the user can more easily pull the strip 112 off of the mattress 102 without having to readjust a position of the mattress 102 on the foundation 101.

Figure 2:
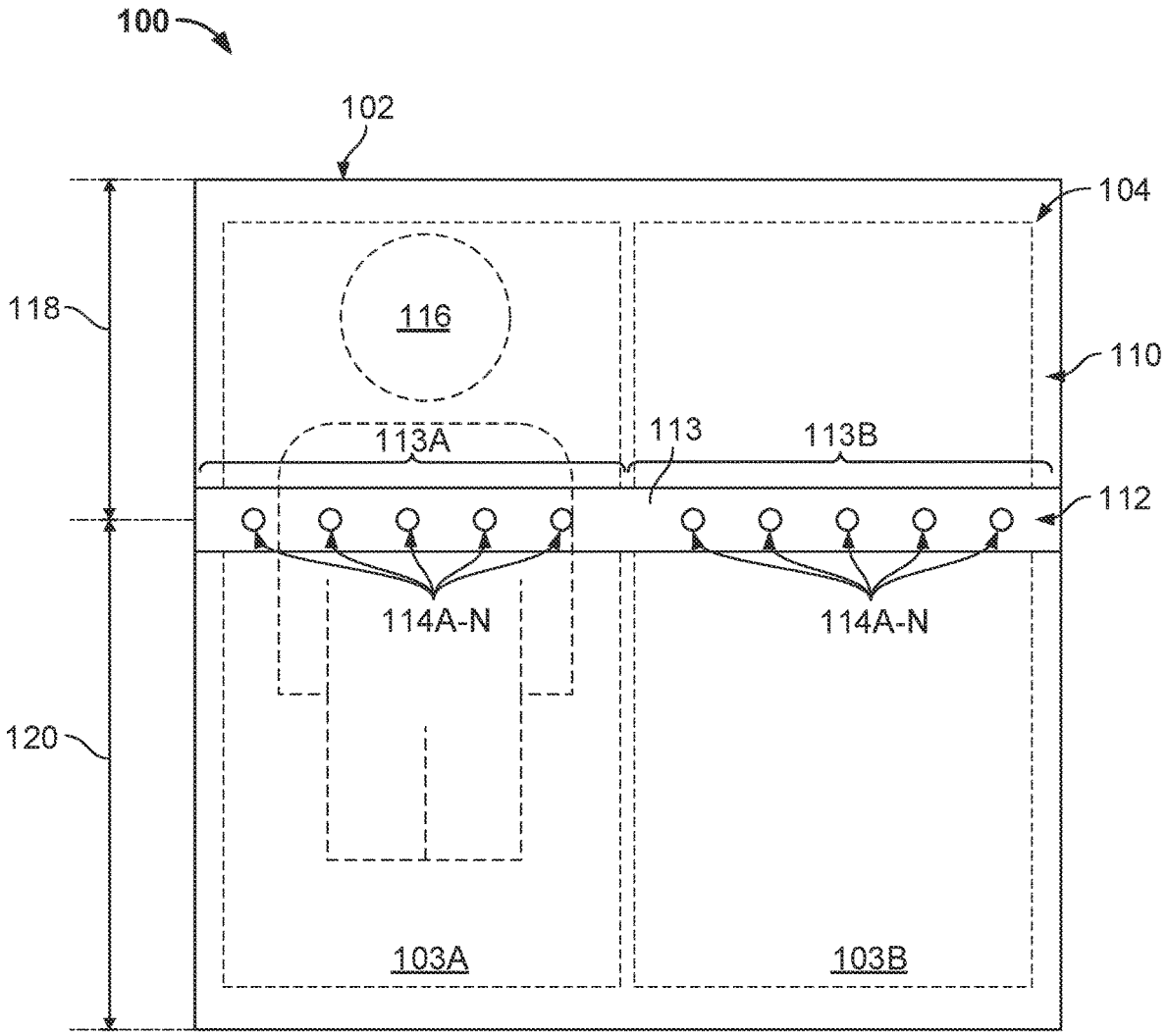
FIG. 2 is a schematic top view of the bed system having the sensor strip.

The sensor strip 112 can include a carrier strip (e.g., refer to the carrier strip 113 in FIG. 2). The carrier strip can include a first fastener that is configured to be releasably attached to the foam tub layer 110 (e.g., compressible layer). The foam tub layer 110 can also include a second fastener configured to releasably attach the first fastener of the carrier strip. The first and second fasteners can include hook-and-loop fasteners. The carrier strip includes opposite lead portions that are configured to be releaseably attached to opposite sides of the foam tub layer 110. As described herein, the opposite lead portions of the carrier strip can also be configured to be releasably attached to opposite sides of at least a portion of the mattress 102, such as the intermediate layer 108, the bottom layer 109, and/or the bottom of the mattress 102.

The sensor strip 112 can also include a plurality of sensors 114A-N. The plurality of sensors 114A-N can be attached to the carrier strip of the sensor strip 112. The sensors 114A-N can be spaced apart from each other in a longitudinal direction of the carrier strip. In some implementations, the sensors 114A-N can be spaced apart from each other in one or more other directions and/or patterns. The carrier strip can be configured to be releasably attached to the foam tub layer 110 and extend between the opposite lateral ends of the foam tub layer 110. Having the plurality of sensors 114A-N attached to the sensor strip 112 in series can improve serviceability of the sensors 114A-N. In other words, because the sensors 114A-N are attached in series to the strip 112, if any one of the sensors 114A-N requires servicing or repair, then the entire strip 112 can be replaced and/or serviced. A user or technician would not have to identify which of the sensors 114A-N requires servicing and then fix that identified sensor. Instead, the user can merely remove the strip 112 from the top of the foam tub 110 and replace it with a new strip 112. In some implementations, the user (or a technician) may disconnect a single failed sensor and replace that sensor without having to remove the strip 112 and/or replace the strip 112 with a new strip.

The sensors 114A-N can capture real-time temperature and/or humidity values of the mattress top 104 and/or the user. Based on the sensed temperature and/or humidity values, a computing system (e.g., refer to FIG. 18) can operate components of the bed system to control a microclimate of the mattress. For example, the sensed temperature and/or humidity values can be used to determine an appropriate airflow supply to provide throughout the mattress 102. For example, the sensors 114A-N can sense one or more temperature values of the mattress top 104 that indicate the mattress top 104 is cooler than a desired temperature of the user (e.g., the user can indicate a preference for mattress temperature in a mobile application and/or on a remote control in communication with the bed system 100). As a result, it can be determined that warm air should be provided through the air chambers until the sensors 114A-N return values indicative of the mattress top 104 reaching the desired temperature. The sensor strip 112 configuration described herein is advantageous because it can provide for collecting accurate and repeatable microclimate temperatures via the sensors 114A-N. In other words, because the strip 112 is retained to a top of the foam tub 110 and does not substantially move as a user moves on top of the mattress 102, the sensors 114A-N can capture temperature values at a same location of the bed system 100. Sensing temperature values at the same location can be beneficial for a computing system (e.g., refer to FIG. 18) to more accurately determine desired temperatures of the overall bed system 100 and/or body temperatures of the user. Moreover, any delays and/or shifts in sensed temperature values can be compensated based on previously collected temperature readings from the same location of the bed system 100.

In some implementations, the sensors 114A-N include temperature sensors. In other implementations, the sensors 114A-N include humidity sensors. In yet other implementations, the sensors 114A-N include both temperature sensors and humidity sensors. In addition or alternatively, the sensors 114A-N can include other types of sensors suitable for measuring other parameters, such as airflow, bed occupancy, user sleeping positions (e.g., back, side, etc.), user's heart rate, breathing rate, or other physiological responses.

The mattress cover 106 can also be configured over the mattress 102. In other words, the mattress cover 106 can be disposed on the foam tub layer 110 and covering at least the foam tub layer 110 and the sensor strip 112. The mattress cover 106 can cover the mattress top 104, the sensor strip 112, the foam tub 110, the intermediate layer 108, and the bottom layer 109. Therefore, the sensor strip 112 can remain in place attached to the foam tub 110, which is advantageous regardless of movement of a user on top of the mattress 102. Because the strip 112 may not move as the user moves on top of the mattress 102, the sensors 114A-N can capture more accurate temperature and/or humidity values from a same location. Therefore, the sensed temperature and/or humidity values can be more accurately used to determine desired airflow supplies to the mattress 102.

Although the sensor strip according to implementations of the present disclosure is primarily described herein with respect to mattress systems that are equipped with active microclimate controls, it is understood that the sensor strip in the same or similar configurations can be used with mattress systems without active heating/cooling functionalities.

FIG. 2 is a schematic top view of the bed system 100 having the sensor strip 112. The mattress 102 can be king-sized. As another example, the mattress 102 can be queen-sized. The mattress 102 can have one foam tub 110 beneath the top of the mattress 104. The foam tub 110 can have two air chambers 103A and 103B positioned therewithin. In other words, a first air chamber 103A can be positioned under a first portion of the foam tub layer 110 (e.g., compressible layer). A second air chamber 103B can be positioned under a second portion of the foam tub layer 110. The first and second portions can be arranged side-by-side between the opposite lateral ends of the foam tub layer 110. Each of the air chambers 103A and 103B can be configured to provide conditioned (e.g., warmed, cooled, ambient) airflow throughout the mattress 102. The sensor strip 112 having the plurality of sensors 114A-N can be attached across the mattress top 104 from one lateral side to an opposing lateral side (e.g., from left to right). The sensor strip 112 can be attached proximate to a head section of the mattress 102 to measure temperature and/or humidity values around a chest area of a user 116. As depicted in FIG. 2, the strip 112 can be placed a shorter distance 118 to the head section of the mattress 102 in comparison to a longer distance 120 from a foot end of the mattress 102. The sensor strip 112 can also be placed at a center point (e.g., midpoint) of the mattress 102 such that the distances 118 and 120 are equal to each other.

The sensor strip 112 can include a carrier strip 113 having a first strip portion 113A and a second strip portion 113B. The carrier strip 113 can be releasably attached to the foam tub layer 110 and extend between the opposite lateral ends of the foam tub 110. The first strip portion 113A and the second strip portion 113B can be disposed at the first portion and the second portion of the foam tub 110, respectively.

The sensor strip 112 can also have a plurality of first sensors 114A-N and a plurality of second sensors 114A-N. Each of the plurality of sensors 114A-N can have five sensors. For example, where the sensor strip 112 is configured for a king and/or queen size mattress 102, the sensor strip 112 can have a total of ten sensors. The plurality of first sensors 114A-N can be attached to the first strip portion 113A of the carrier strip 113 and spaced apart from each other in a longitudinal direction of the carrier strip. The plurality of second sensors 114A-N can be attached to the second strip portion 113B of the carrier strip 113 and also spaced apart from each other in the longitudinal direction of the carrier strip 113. In other words, the plurality of first sensors 114A-N can be positioned over the air chamber 103A and the plurality of second sensors 114A-N can be positioned over the air chamber 103B. As a result, when the user 116 is positioned on top of the mattress over the air chamber 103A, the plurality of first sensors 114A-N can measure temperature and/or humidity values of the mattress top 104 above the air chamber 103A. Those measured valued can be used to, for example, determine a conditioned airflow to supply to the air chamber 103A. One or more temperature and/or humidity values measured by the plurality of second sensors 114A-N can then be used to, for example, determine a conditioned airflow to supply to the air chamber 103B. As a result, the bed system 100 can provide for custom airflow to different portions of the mattress 102 based on body temperatures of users and/or temperatures of different portions of the mattress top 104.

In other examples (not depicted), two separate sensor strips can be attached to the mattress 102. For example, a first sensor strip can be attached over the portion of the mattress 102 having the air chamber 103A and a second sensor strip, separate from the first sensor strip, can be attached over the portion of the mattress 102 having the air chamber 103B. The first and second sensor strips can be attached to a center of the mattress top 104 via fastening elements, such as VELCRO or adhesive.

In addition, the sensor strip 112 can be easily replaced with another sensor strip by simply removing the sensor strip 112 from the mattress 102, and attaching a new sensor strip (or the same sensor strip that has been repaired or upgraded) to the mattress 102 the same way as the sensor strip 112 was fixed to the mattress 102. This is advantageous for maintenance and upgrade purposes. As described herein, the sensor strip 112 has simple configurations and can be fixed to the mattress 102 with simple attachment mechanisms, thereby allowing such easy maintenance and upgrades. For example, the sensor strip 112 can be easily replaced by another sensor strip that may have different sensing types (e.g., swapping from temperature sensors to a combination of temperature and humidity sensors) or another sensor strip that may have upgraded features, such as improved sensing capability and processing performance.

In one example, mattress components as described in, for example, FIGS. 13-17, are assembled and arranged in place. A sensor strip 112 is then attached to a foam layer that is positioned proximate the mattress top. As described herein, the sensor strip 112 may be routed between opposite lateral ends of the foam layer. Then, a mattress cover is placed on the foam layer to cover the foam layer and the first sensor strip. In some implementations, the sensor strip is not fixed to the mattress cover so that the mattress cover is free of the sensor strip while the sensor strip is attached to the foam layer. In other implementations, the sensor strip may be attached to the mattress cover as well as to the foam layer.

When the sensor strip 112 needs to be repaired, or replaced by a new sensor strip, the mattress cover is removed from the foam layer. Then, the sensor strip is simply detached from the foam layer, and can be repaired at the site or delivered to a remote place for repair or maintenance. The repaired sensor strip can be simply reattached to the foam layer. Where a new sensor strip is available for easy replacement or upgrade, the new sensor strip can be attached to the foam layer in place of the old sensor strip. Then, the mattress cover is placed on the foam layer again to cover the foam layer and the repaired or new sensor strip.

Figure 3:
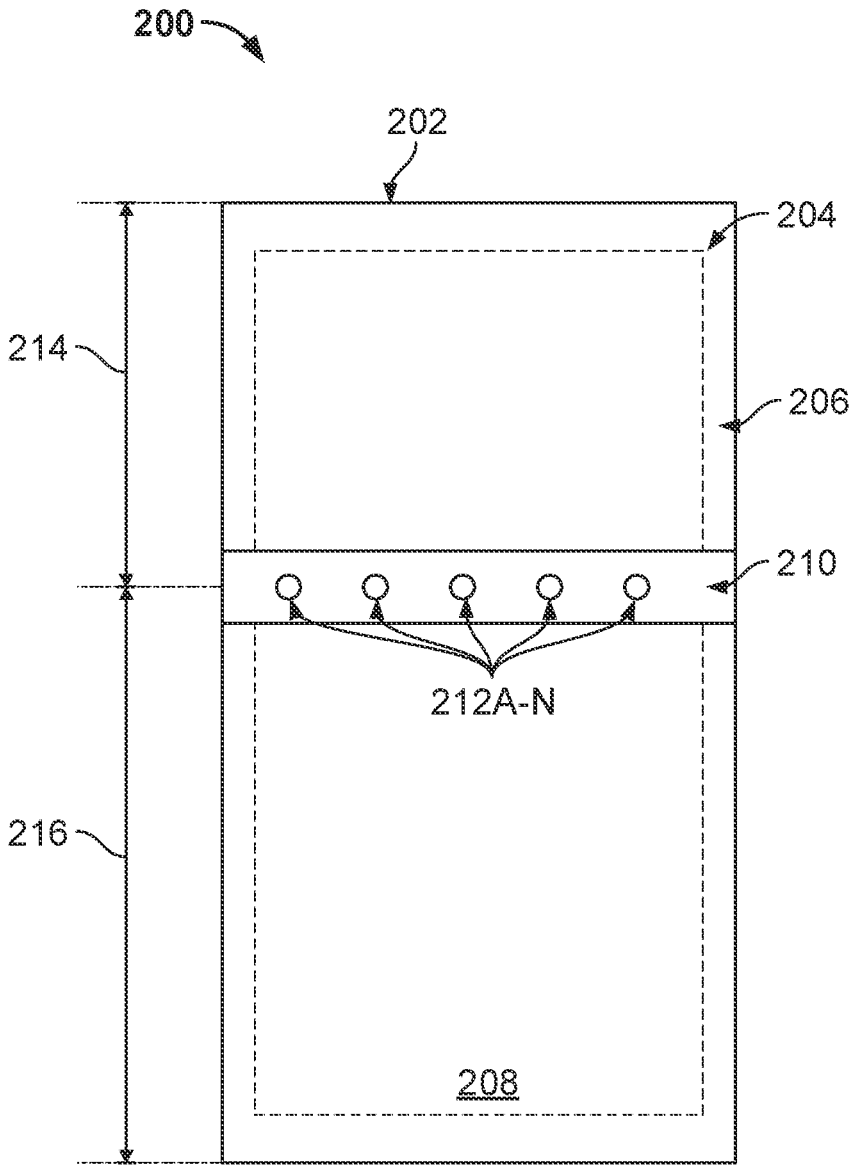
FIG. 3 is another schematic top view of a bed system having a sensor strip.

FIG. 3 is another schematic top view of a bed system 200 having a sensor strip 210. A mattress 202 can be full-sized. The mattress 202 can also be twin-sized. The mattress 202 can have foam tub 206 beneath a top of the mattress 204. The foam tub 206 can have an air chamber 208 positioned therewithin. The air chamber 208 can be configured to provide conditioned (e.g., warmed, cooled, ambient) airflow throughout the mattress 202. The sensor strip 210 having a plurality of sensors 212A-N can be attached across the mattress top 204 from one lateral side to an opposing lateral side (e.g., from left to right). The sensor strip 210 can be attached proximate to a head section of the mattress 202 to measure temperature and/or humidity values around a chest area of a user who lays on top of the mattress 202. As depicted in FIG. 3, the strip 210 can be placed a shorter distance 214 to the head section of the mattress 202 in comparison to a longer distance 216 from a foot end of the mattress 202. The sensor strip 210 can also be placed at a center point (e.g., midpoint) of the mattress 202 such that the distances 214 and 216 are equal to each other. In some implementations, the sensor strip 210 can be placed at other distances from a head or foot end of the mattress 202. For example, the sensor strip 210 can be placed approximately 30 inches down from the head end of the mattress 202.

The sensor strip 210 can have a plurality of sensors 212A-N, as described throughout this disclosure. The plurality of sensors 212A-N can be five sensors. When the user is positioned on top of the mattress over the air chamber 208, the plurality of sensors 212A-N can measure temperature and/or humidity values of the mattress top 204 above the air chamber 208. Those measured valued can be used to determine a conditioned airflow to supply to the air chamber 208.

As depicted in FIG. 3, the sensor strip 210 can have a shorter length than the sensor strip 112 as depicted in FIGS. 1-2. This is because the sensor strip 210 can be designed and configured for smaller beds, such as twin and full size beds. In other examples (not depicted), a universal length sensor strip can be used and attached to any bed size. That universal sensor strip can include longer leads or portions on sides of the plurality of sensors that can be wrapped over sides of any mattress size and attached thereunder.

Figure 4:
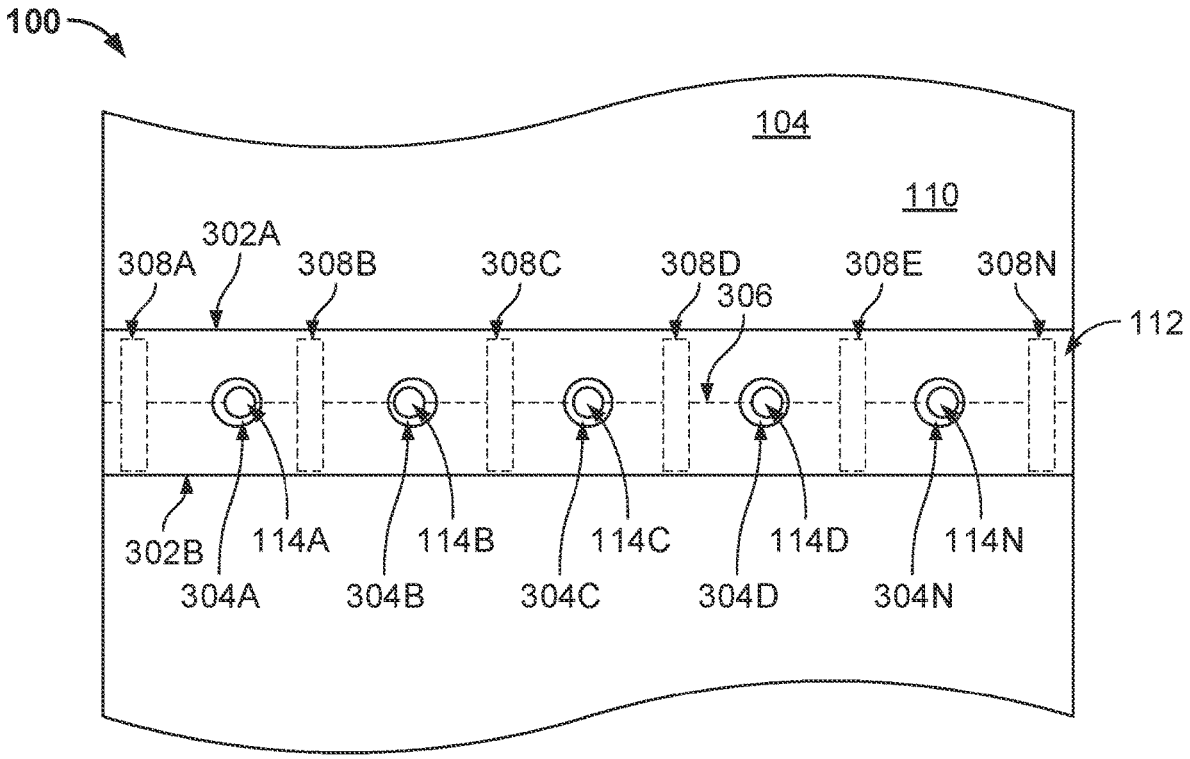
FIG. 4 is a partial exploded top view of the sensor strip as described herein.

FIG. 4 is a partial exploded top view of the sensor strip 112 as described herein. As depicted, the sensor strip 112 is attached to a top of the foam tub 110 at the mattress top 104. The sensor strip 112 (e.g., carrier strip 113 of the sensor strip 112 in FIG. 2) has a first strip surface 302A and a second strip surface 302B. The first strip surface 302A is oriented to face the top of the foam tub 110, and the second strip surface 302B can be opposite to the first strip surface 302A. The first strip surface 302A can be configured to be releasably attached to the foam tub layer 110 (e.g., compressible layer). The plurality of sensors 114A-N can be disposed at the first strip surface 302A of the sensor strip 112. The sensor strip 112 can define a plurality of openings 304A-N such that the sensors 114A-N attached on the first strip surface 302A can be exposed at the mattress top 104 through the plurality of openings 304A-N. Direct exposure of the sensors 114A-N through the openings 304A-N to the mattress top 104 and/or a user laying on top of the bed system 100 can be advantageous to improve sensor performance and measure more accurate temperature and/or humidity readings. In some implementations, the sensor strip 112 may not include the plurality of openings 304A-N.

As depicted, a wire or wires 306 (schematically illustrated with a dotted line) can run along the first strip surface 302A, connecting the plurality of sensors 114A-N. The sensors 114A-N can be wired in series. In some implementations, One or more adhesives 308A-N can be used on the first strip surface 302A to hold the wire 306 in place against the surface 302A. The adhesives 308A-N can be tape, other forms of adhesive, and/or fasteners, such as micro-hooks, VELCRO or hook-and-loop fasteners. In some implementations, at least one of the adhesives 308A-N can also be used to retain the first strip surface 302A to the foam tub layer 110. In some implementations, the sensor strip 112 can be attached to the foam tub layer 110 by only the adhesives 308A-N. In addition or alternatively, the sensor strip can be attached to the foam tub 110 by micro-hooks or similar fasteners at ends of the sensor strip 112.

Figure 5:
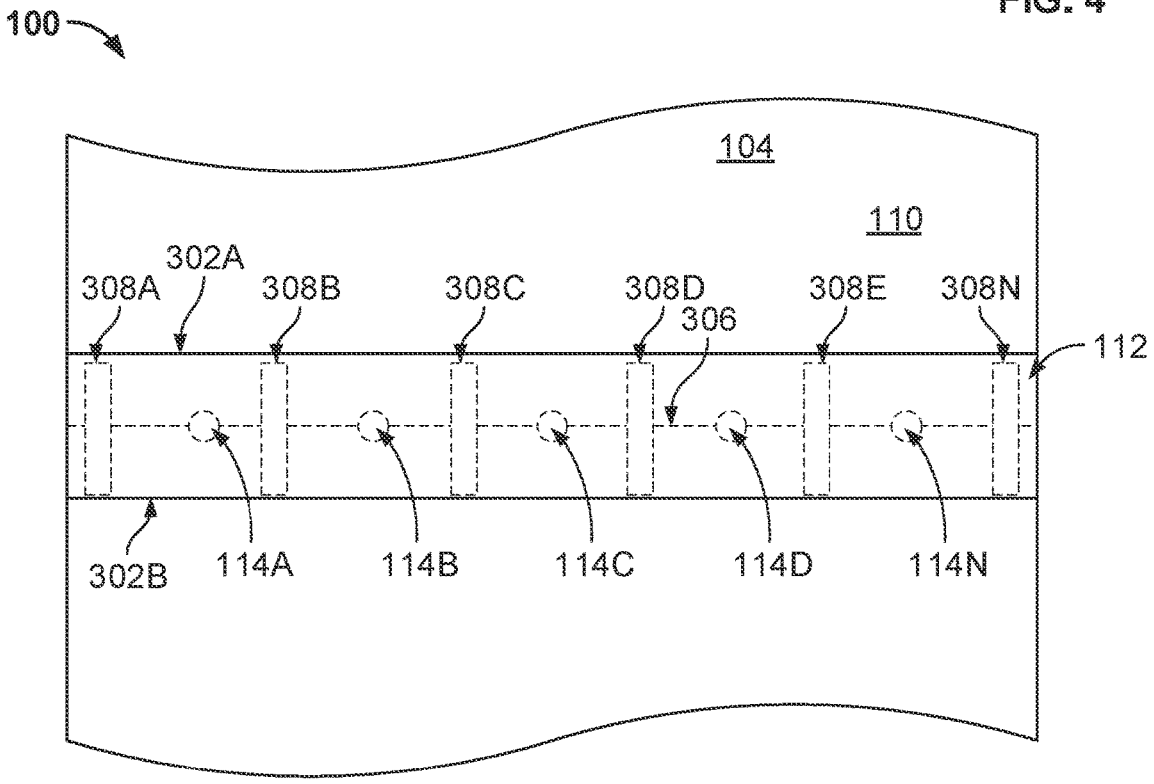
FIG. 5 is another partial exploded top view of the sensor strip.

FIG. 5 is another partial exploded top view of the sensor strip 112. As depicted, the sensor strip 112 is attached to a top of the foam tub 110 at the mattress top 104. The sensor strip 112 (e.g., carrier strip 113 of the sensor strip 112 in FIG. 2) has the first strip surface 302A and the second strip surface 302B. The first strip surface 302A is oriented to face the top of the foam tub 110, and the second strip surface 302B can be opposite to the first strip surface 302A. The first strip surface 302A can be configured to be releasably attached to the foam tub layer 110 (e.g., compressible layer). The plurality of sensors 114A-N can be disposed at the first strip surface 302A of the sensor strip 112. As a result, the sensors 114A-N may not have direct exposure to the mattress top 104 and/or a user laying on top of the bed system 100. However, this configuration can be beneficial to protect the sensors 114A-N from damage or being moved around as the user moves on top of the bed system 100.

In other examples, the plurality of sensors 114A-N can be disposed at the second strip surface 302B. Therefore, the sensors 114A-N can be exposed at the mattress top 104. Direct exposure of the sensors 114A-N to the mattress top 104 and/or a user laying on top of the bed system 100 can be advantageous to improve sensor performance and measure more accurate temperature and/or humidity readings.

As depicted, a wire or wires 306 (schematically illustrated with a dotted line) can run along the second strip surface 302A, connecting the plurality of sensors 114A-N. The sensors 114A-N can be wired in series. One or more adhesives 308A-N can be used on the second strip surface 302A to hold the wire 306 in place against the surface 302A. The adhesives 308A-N can be tape, other forms of adhesive, and/or fasteners, such as micro-hooks, VELCRO or hook-and-loop fasteners. Additional adhesives like the adhesives 308A-N can also be used to retain the first strip surface 302A to the foam tub layer 110.

Figure 6:
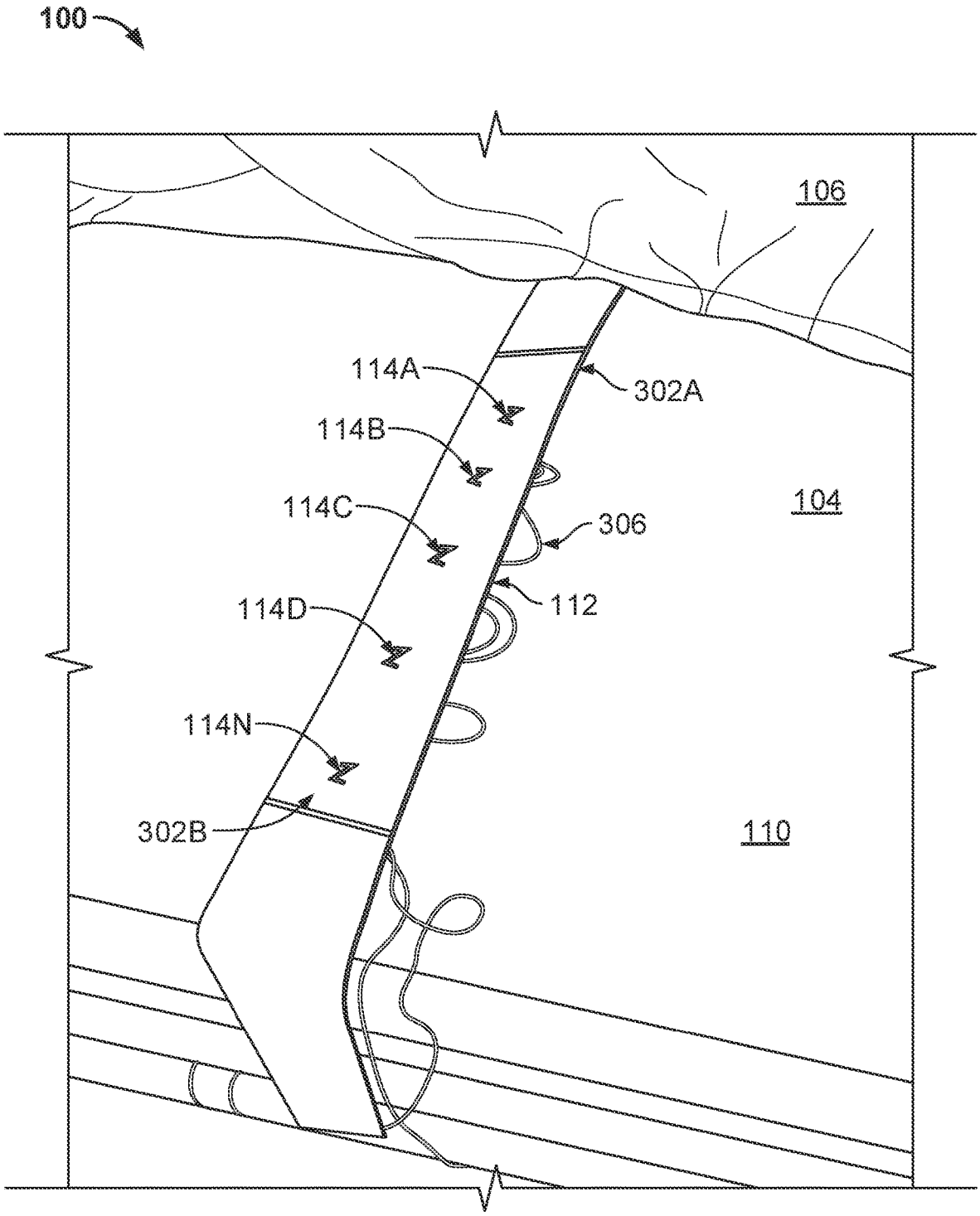
FIG. 6 is a side perspective view of the bed system having the sensor strip as described herein.

FIG. 6 is a side perspective view of the bed system 100 having the sensor strip 112 as described herein. As shown, the mattress cover 106 is pulled off of the mattress top 104, thereby exposing the foam tub layer 110 (e.g., compressible layer) beneath. The sensor strip 112 is attached directly to a top surface of the foam tub 110. The plurality of sensors 114A-N are located on the first strip surface 302A, which is in contact with the top surface of the foam tub 110. The second strip surface 302B is exposed and comes in contact with a bottom of the mattress cover 106, or a flame resistant cap (which can be positioned between the foam tub 110 and the mattress cover 106), when the mattress cover 106 is placed over the foam tub 110 and the mattress top 104. The flame resistant cap can be a flame resistant material that protects the mattress of the bed system 100 from where it may be vulnerable to catching fire (e.g., in most areas of the mattress except for a middle and/or bottom of the bed system 100). The plurality of sensors 114A-N can be stitched to the first strip surface 302A of the sensor strip 112. In other examples, the sensors 114A-N can be attached to the first strip surface 302A by adhesive, as described throughout this disclosure. Moreover, the wire 306 can be used to attach the sensors 114A-N in series on the first strip surface 302A of the sensor strip 112. The wire 306 can be attached to the first strip surface 302A using adhesive, as described herein, such that the wire 306 does not get tangled when a user moves on top of the bed system 100. This wire configuration can be advantageous to improve durability, flexibility for user comfort, and attachment techniques. In some implementations, the wire 306 can be a carbon fiber wire. Moreover, the wire 306 can be thinner than depicted in FIG. 6 and thus may not create discomfort or other concerns with routing and organization of the wire 306 on the top surface of the foam tub 110. The wire 306 may be configured to stretch and otherwise lay flat against the top surface of the foam tub 110 to avoid potential failures or interference of the sensors 114A-N and to ensure user comfortability (e.g., not feeling the wire 306) when the user is resting on the bed system 100.

Figure 7:
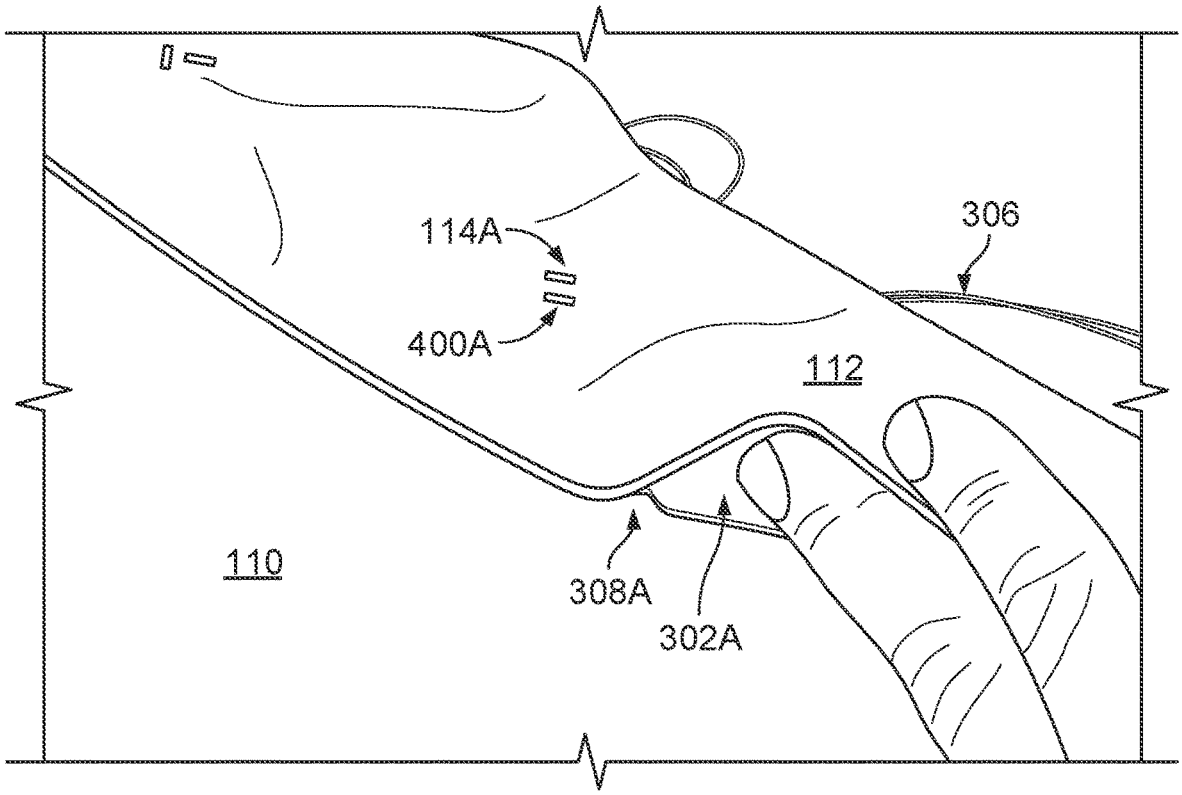
FIG. 7 is a partial exploded perspective view of the sensor strip.

FIG. 7 is a partial exploded perspective view of the sensor strip 112. The sensor strip 112 is attached to the top surface of the foam tub 110 by the adhesive 308A on the first strip surface 302A. In some implementations, instead of directly attaching the strip 112 to the foam tub 110, a fabric layer can be laminated to the top surface of the foam tub 110. The strip 112 can then attach or fasten to the fabric layer using the adhesive 308A. As described throughout, the adhesive 308A can be tape, a micro-hook, a hook-and-loop fastener, or similar fastening elements. The same adhesive 308A can be used to secure the wire 306 to the first strip surface 302A such that the wire 306 does not get tangled, destroyed, or cause any disturbances when the user moves on top of the bed system. Moreover, the sensor 114A can be attached to the first strip surface 302A by one or more stitches 400A. In some implementations, ultrasonic welding techniques, as described below, can be used to securely position the sensor 114A to the strip 112. Two materials, such as adhesives, can attach to the strip 112 and create a harness for retaining the sensor 114A in place against the strip 112. For example, adhesives or other similar material can attach to the strip 112 over wires of the sensor 114A and on opposite sides of the sensor 114A such that the sensor 114A is cradled in a position between the two adhesives against the first strip surface 302A of the strip 112. As a result, the sensor 114A may be coupled or attached to the first strip surface 302A without using one or more stitches 400A. Refer to FIGS.

25A-F for additional discussion about ultrasonic welding techniques. Alternatively, the ultrasonic welding can be used together with the stitches.

Each sensor can be stitched to the first strip surface 302A in order to remain securely attached to the sensor strip 112. This configuration can provide for a single layer of protection to the sensor 114A and/or the wire 306. This configuration can be advantageous because it can prevent the sensors from moving around as the user moves on top of the bed system. Moreover, stitching the sensors to the sensor strip can be advantageous to ensure that the sensors capture accurate measurements (e.g., temperature and/or humidity readings) from a same location of the bed system. In other words, if the sensors are constantly being moved around the bed system, it can be more challenging to determine conditions of the bed system to provide an accurate and desired airflow supply through the mattress. For example, sensed temperature values closer to a chest area of the user may not be similar to sensed temperature values closer to legs or feet of the user. Therefore, it can be more challenging to determine an actual body temperature of the user and an airflow that should be supplied to comfort the user. Although distribution of heat and temperature may be different, as described above, temperature data collected closer to the legs or feet of the user can also be used to determine user comfort levels and/or the microclimate of the mattress.

Figure 8:
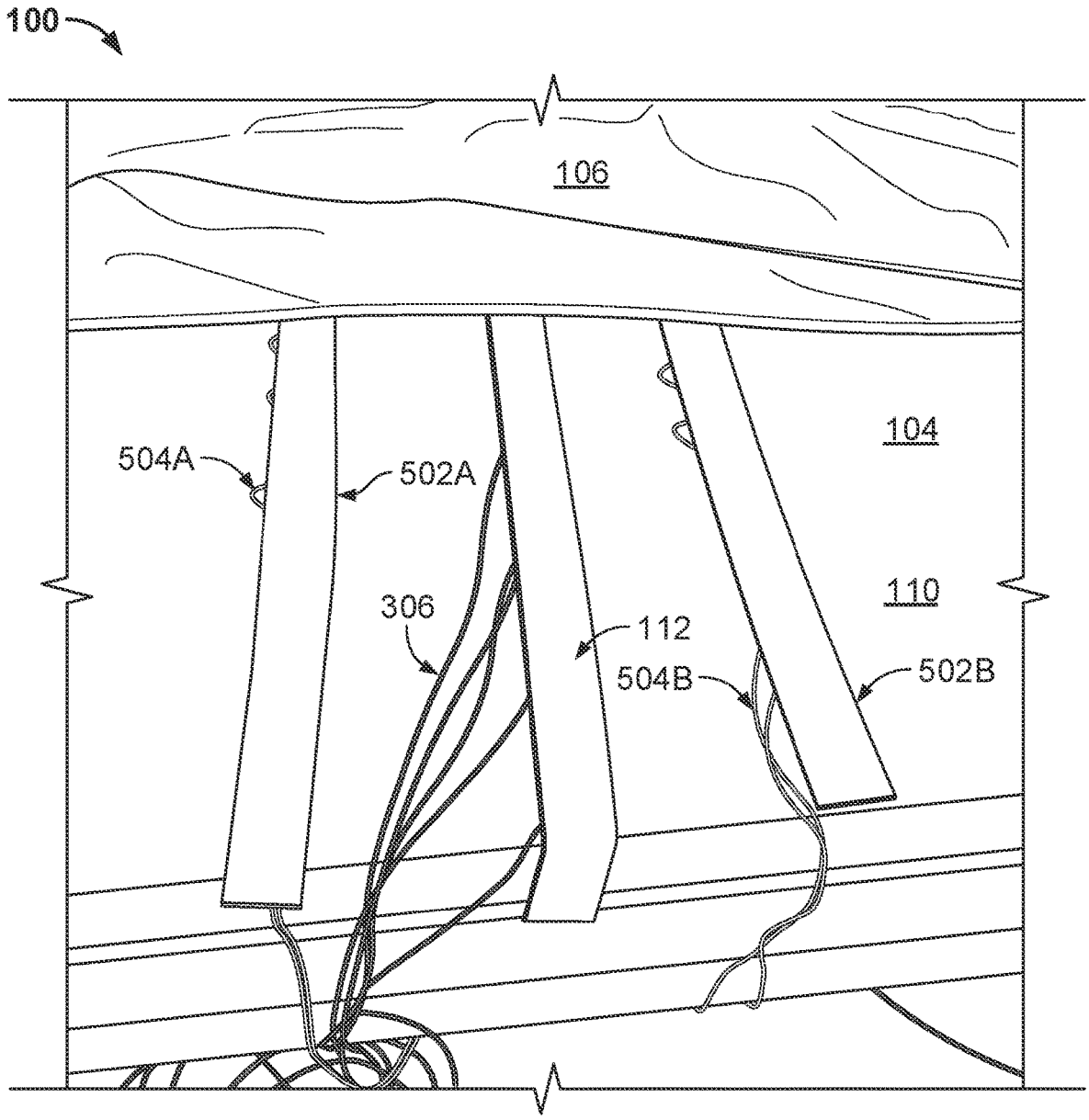
FIG. 8 is a perspective view of the bed system having one or more sensor strips.

FIG. 8 is a perspective view of the bed system 100 having one or more sensor strips. The mattress cover 106 can be lifted off of the mattress top 104, thereby exposing the foam tub layer 110 (e.g., compressible layer). The sensor strip 112 can be attached to a top surface of the foam tub 110. The wires 306 of the plurality of sensors on the strip 112 can be collected and moved to a lateral side of the foam tub 110 (e.g., a right side and/or a left side). Therefore, the wires 306 can be organized and routed around an outside of the foam tub 110 (e.g., the lateral side). In some implementations, the wires 306 can be collected and routed down through the foam tub 110 to help with hiding and integrating the wires 306 into the bed system 100. To do so, an elongated tool (e.g., a needle) can be used to puncture at least one hole through the foam tub 110. The wires 306 can then be routed through the at least one hole. Alternatively, foam cutting bits can also be used to drill the at least one hole through the foam tub 110 and route the wires 306 therethrough.

One or more additional sensor strips 502A and 502B can be attached to the foam tub layer 110. The sensor strips 502A and 502B can be configured and arranged as depicted and described throughout this disclosure in reference to the sensor strip 112. For example, the sensor strips 502A and 502B can have wires 504A and 504B, respectively, that attach a plurality of sensors in series. In some implementations, fewer wires 306 may be used to wiredly connect the sensors on each of the sensor strips depicted herein (e.g., 112, 502A, and 502B). The wires 306 can then be collected and organized to run down a side of the foam tub 110 for each of the sensor strips.

Having at least one or more of the additional sensor strips 502A and 502B can be advantageous to increase a quantity of temperature and/or humidity readings that are captured while the bed system 100 is in use. The increased quantity of readings can be used to more accurately determine an appropriate airflow supply to deliver throughout the mattress. In some examples, one or more of the additional sensor strips 502A and 502B can be used to capture different sensor values. For example, the sensor strip 502A can include temperature sensors and the sensor strip 502B can include humidity sensors. Combining these sensor values can be advantageous to determine more accurate airflow supplies to the mattress or other parameters for microclimate control of the mattress.

In other examples, the additional sensor strips 502A and 502B can be spaced farther apart or closer together. For example, the sensor strip 112 can be placed across a chest area of the user. The sensor strip 502A can be placed across a head area of the user. The sensor strip 502B can be placed across a foot area of the user. In other implementations, the sensor strip 112 can be placed across the chest area of the user and the sensor strips 502A and 502B can both be placed closer to a lower back, legs, and/or foot area of the user. In yet other implementations, the sensor strips 502A and 502B can be placed immediately next to the sensor strip 112 near the chest area of the user. This configuration can be beneficial to more accurately read temperature and/or humidity values in the chest area and provide a more accurate airflow supply.

Figure 9:
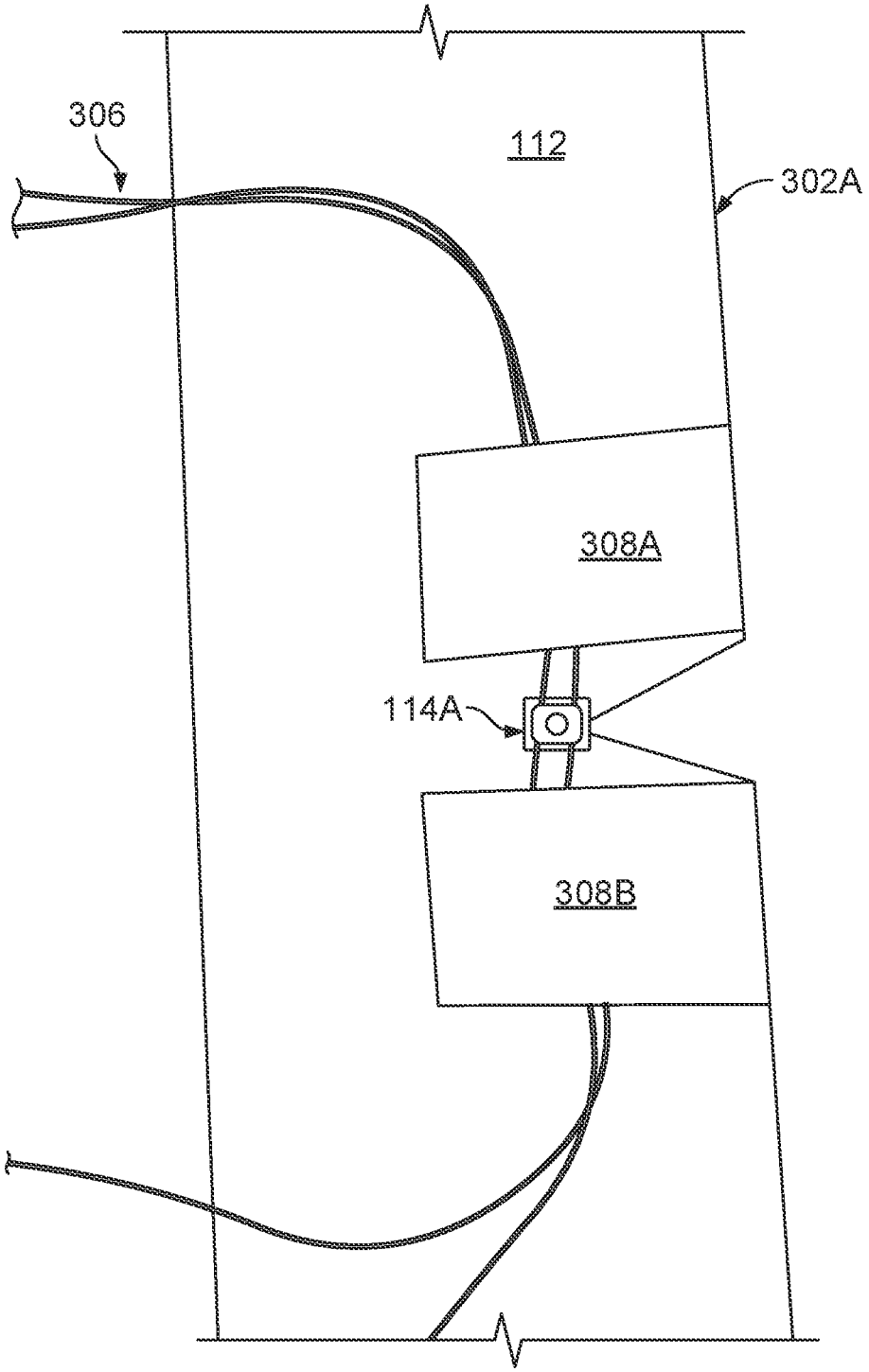
FIG. 9 is a partial exploded bottom view of the sensor strip.

FIG. 9 is a partial exploded bottom view of the sensor strip 112. As depicted and described throughout this disclosure, the sensor strip 112 can have the first strip surface 302A. The first strip surface 302A can be attached and thus abutted to a top surface of the foam tub layer (e.g., compressible layer). The sensor 114A can be attached to the first strip surface 302A. Moreover, the wire 306, which can be used to attach the plurality of sensors in series, can be attached to the first strip surface 302A via one or more adhesives 308A-B. As depicted in FIG. 9, the adhesives 308A-B can be tape. The adhesives 308A-B can be other forms of fastening elements as described throughout this disclosure, such as stitches, hook-and-loop fasteners, and micro-hooks. Moreover, instead of sewing or attached the sensor 114A directly to the first strip surface 302A, the sensor 114A can be held in place by the adhesives 308A-B, which frame the sensor 114A and secure the wire 306 against the first strip surface 302A. This configuration can be advantageous to ensure that the sensor 114A is not obstructed from accurately capturing temperature and/or humidity values. This configuration can also be advantageous to provide comfortability to a user laying on top of the mattress. For example, the sensor 114A can face downwards towards the top surface of the foam tub layer. As a result, the sensor 114A can sink into the foam rather than being pushed upwards and causing discomfort to the user laying on top of the mattress.

Figure 10:
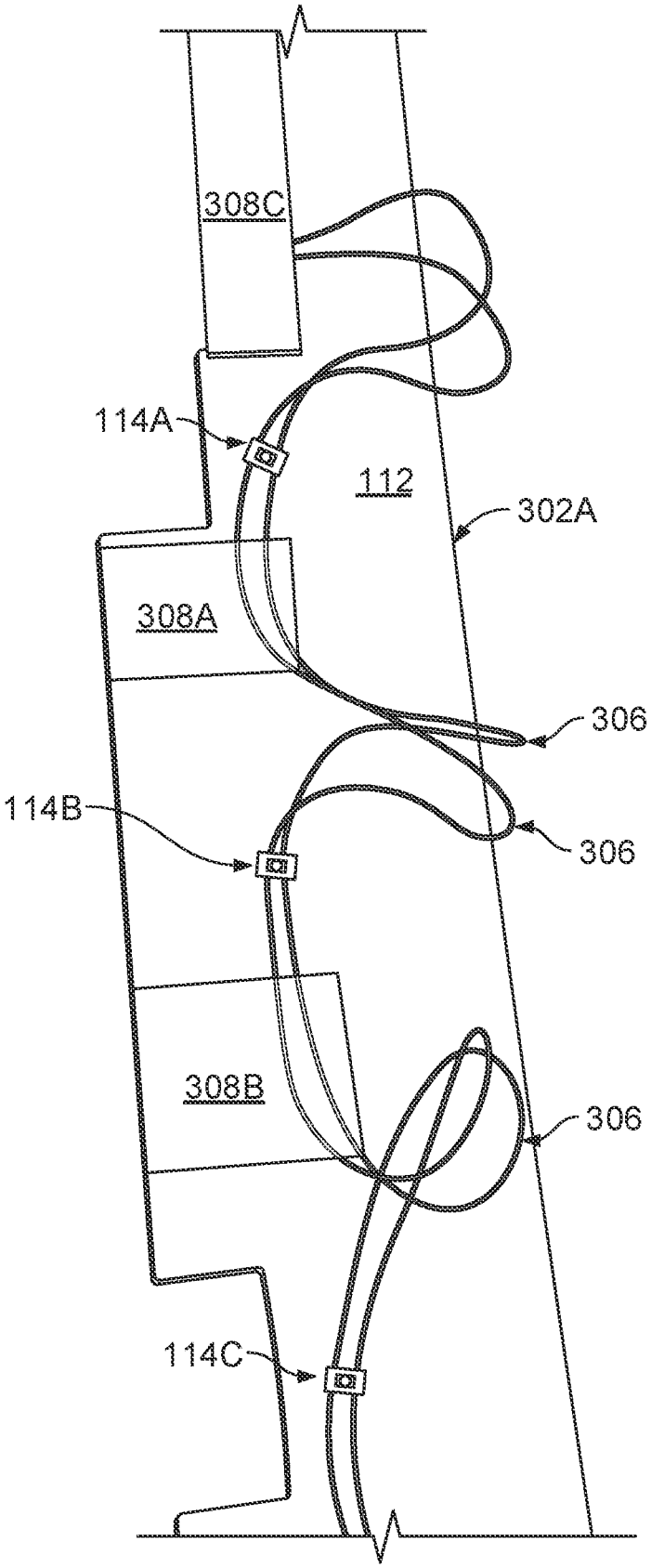
FIG. 10 is another partial exploded bottom view of the sensor strip.

FIG. 10 is another partial exploded bottom view of the sensor strip 112. The sensors 114A-C can be attached in series via the wire 306 to the first strip surface 302A of the sensor strip 112. Adhesives 308A, 308B, and 308C can be used to attach portions of the wire 306 to the first strip surface 302A. At least one of the adhesives 308A-C can be larger than the other adhesives so as to be used to attach the wire 306 to a larger area of the first strip surface 302A. Further, one of the adhesives 308A-C (e.g., the adhesive 308C in FIG. 10) can be configured at an end of the plurality of sensors 114A-C along the strip 112, such as a lead portion of the strip 112. The adhesive 308C can therefore be used to keep all the wire(s) 306 in one place while the lead portion of the strip 112 extends over a side or sides of the mattress to retain the strip 112 to the mattress. This configuration can help with wire management, such that the wire(s) 306 do not obstruct movement of a user on the bed system and also when getting on and off of the bed system. This configuration can also improve comfortability of a user laying on top of the mattress, as described in reference to FIG. 9. In some implementations, double-sided adhesive can be used to fold fabric of the strip 112 (e.g., the first strip surface 302A) onto itself, thereby forming a channel to maintain the wire(s) in position. In such examples, a cutout can also be formed around each of the sensors 114A-C.

Figure 11:
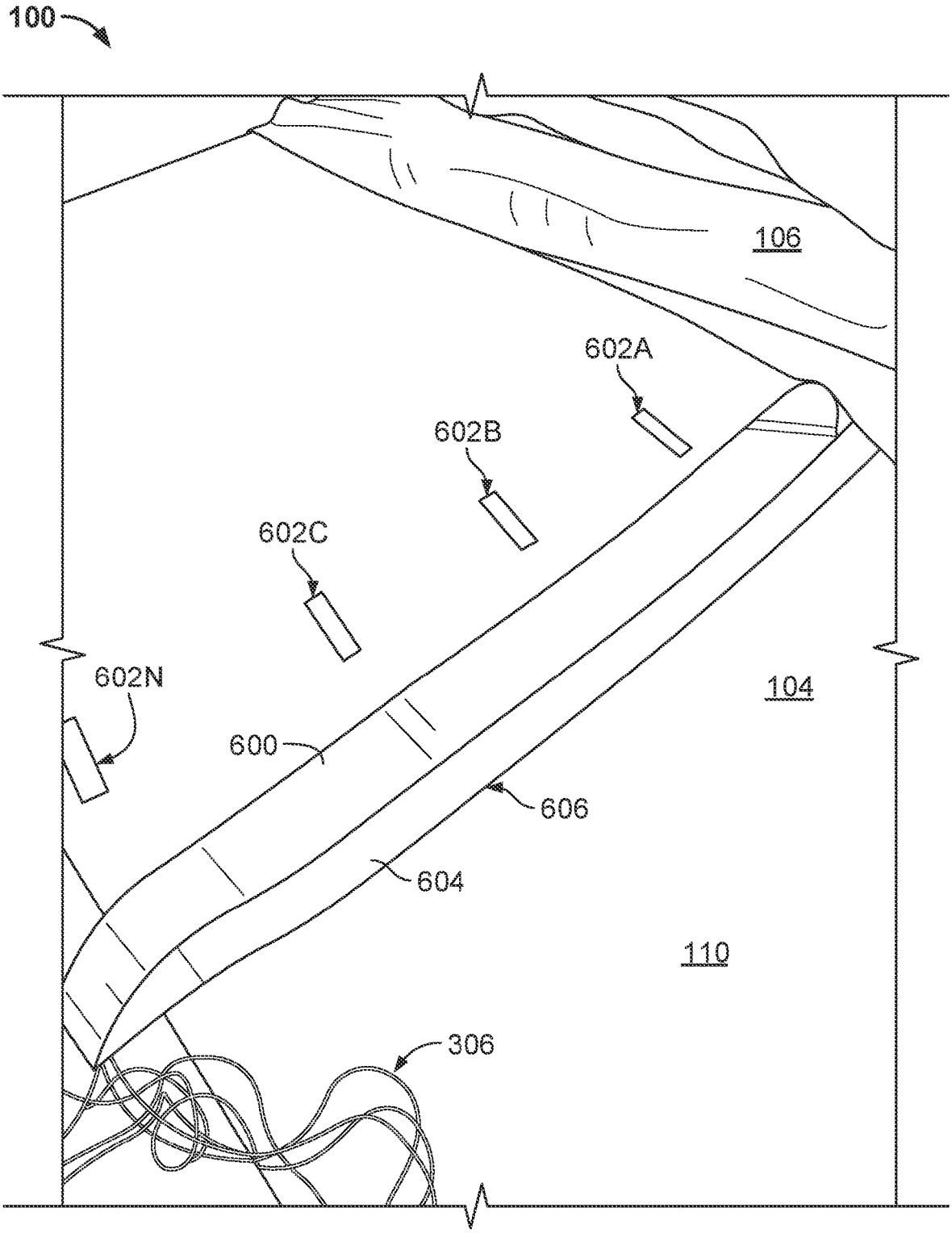
FIG. 11 is a perspective view of the bed system having the sensor strip in an encasement.

FIG. 11 is a perspective view of the bed system 100 having a sensor strip 600. The sensor strip 600 can be same as or similar to the sensor strip 112 described throughout this disclosure. For example, the sensor strip 600 can include a plurality of sensors in wired series. The sensor strip 600 can be wider than the sensor strip 112 such that a portion 604 of the strip 600 can fold over and/or along an edge 606. The folded portion 604 can cover up the sensors and/or wire(s) 306 of the sensor strip 600. This configuration can be advantageous for a variety of reasons. For example, the folded portion 604 can protect components of the sensor strip 600, such as the plurality of sensors and/or the wire 306, from damage. The folded portion 604 can keep all the wire(s) 306 together such that they can run down a side of the bed system 100. The folded portion 604 can also be used to prevent a user from feeling the sensor strip 600, the wire(s) 306, and/or the plurality of sensors when the user is laying on top of the mattress cover 106. In other words, the folded portion 604 can smooth a surface beneath the mattress cover 106 such that the user does not even know the sensor strip 600 is beneath them.

In an alternative embodiment, the sensor strip 600 can be enclosed in an encasement. The mattress cover 106 is pulled aside to expose the mattress top 104 and the foam tub layer 110. The encasement can enclose the sensor strip 112 or go over the sensor strip 112 and the wire(s) 306. In other words, the sensor strip 112 (e.g., carrier strip 113 in FIG. 2) can include a sensor cover layer (e.g., the encasement) that is attached to the first strip surface and covers at least part of the plurality of sensors at the first strip surface. The encasement can be used for a variety of reasons. For example, as mentioned above, the encasement can protect components of the sensor strip 600 from damage. The encasement can also assist the user in not feeling the sensor strip 600 under the mattress cover 106. The encasement can also be used to secure the sensor strip 600 in place on the foam tub layer 110. As a result, the sensor strip 600 does not have to be directly attached to the foam tub layer 110. Manufacturing the sensor strip 600 can be less expensive because additional fastening elements and/or adhesives may not be required to attach the sensor strip 600 to the foam tub 110. In such a use, the encasement can be attached to the foam tub layer 110 using one or more adhesives 602A-N. The adhesives 602A-N can be any fastening elements as discussed and described throughout this disclosure. The encasement can be configured to easily slide onto/over the sensor strip 112. The encasement can also be made from a material that does not limit an ability of the plurality of sensors to accurately sense temperature and/or humidity levels. As a result, the encasement may not interfere with operations of the bed system 100 in determining a desired airflow supply through the mattress.

Figure 12:
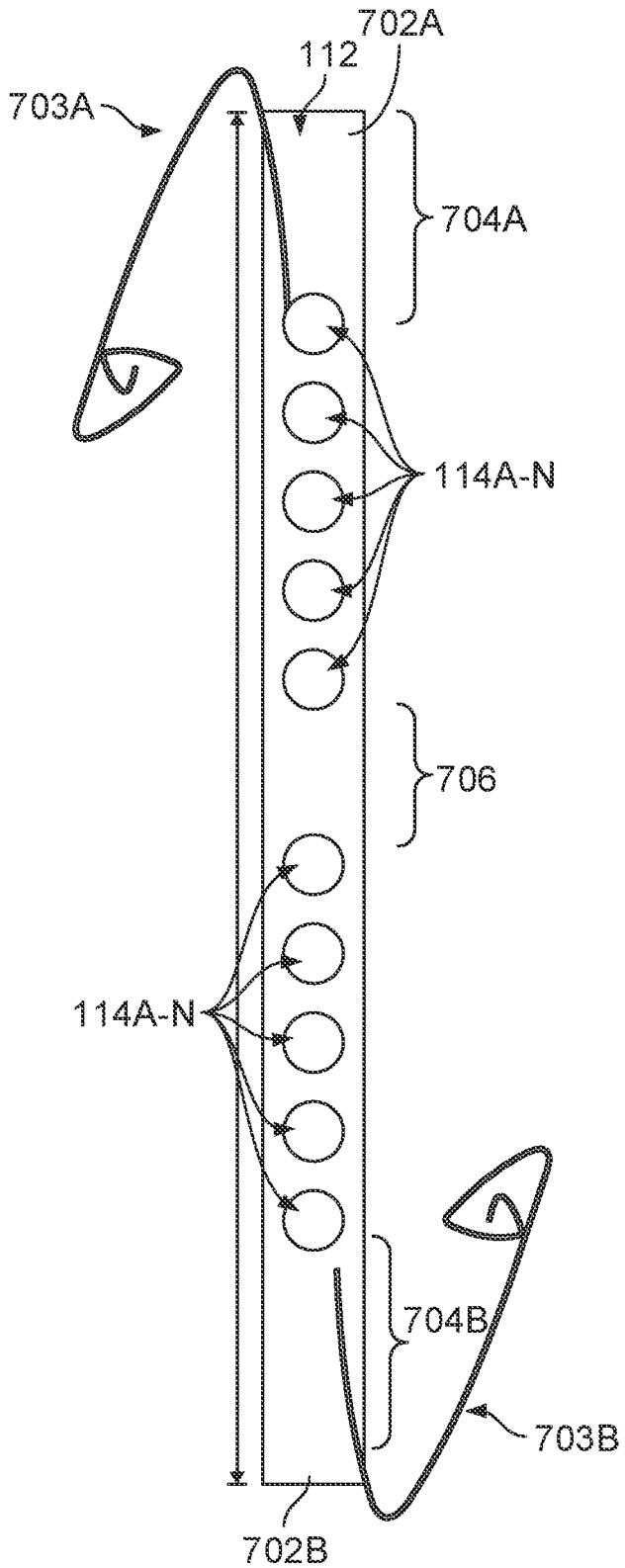
FIG. 12 is a schematic diagram of the sensor strip as described herein.

FIG. 12 is a schematic diagram of the sensor strip 112 as described herein. The sensor strip has a plurality of first sensors 114A-N and a plurality of second sensors 114A-N. As described throughout this disclosure, this strip 112 can be used for king and/or queen size bed systems. The sensor strip 112 can also include lead portions 702A and 702B at each opposite end/side of the strip 112. The lead portions 702A and 702B can be configured to releasably attach to opposite sides of the foam tub layer, compressible layer, or any other sides of the mattress as described herein. The lead portions 702A and 702B can attach to the foam tub layer, or any other sides or bottom of the mattress using micro-hook fastening elements as described herein. Any other fastening elements described herein can also be used. Further, the sensor strip 112 includes wire leads 703A and 703B that are electrically connected to the first sensors 114A-N and the second sensors 114A-N. Each of the wire leads 703A and 703B can be nine feet long. Other lengths of the wire leads 703A and 703B are possible. In some implementations, for example, each of the wire leads 703A and 703B (e.g., harnesses) can extend 40 inches beyond edges of the sensors 114A-N of the sensor strip 112.

The lead portions 702A and 702B can be different lengths, depending on what size bed the sensor strip 112 is configured to be used with. In other examples, the lead portions 702A and 702B can be a universal length (e.g., nine feet) regardless of what size bed the sensor strip 112 is used with. For example, the lead portions 702A and 702B can have a predetermined length that is suitable to attach the sensor strip 112 to a mattress system that is very thick (e.g., has several layers of foam) as well as a thinner mattress system.

The sensor strip 112 can be one or more different lengths. For example, the strip 112 can be 80 inches long. The strip 112 can be less than 30 inches long since the strip 112 may not extend all the way to an edge of the mattress, in some implementations. In such an implementation, a first sensor of the strip 112 can be positioned at a distance (e.g., a few inches) inward from an edge of the strip 112. The strip 112 can be 30 inches long, which can be half of a queen size bed and attached to the surface of the mattress rather than wrapped around sides of the mattress. The strip 112 can also be 122 inches long, which can be used with an eastern king size bed, wherein the lead portions 702A and 702B can wrap around approximately 10 inches of a bottom of a foam tub of the mattress and attach to reinforcement straps. As another example, the strip 112 can be 106 inches long, having 76 inches that extend across the mattress and 13 inch long lead portions 702A and 702B. The length of the strip 112 can be changed depending on a size of the bed system that the strip 112 is used with. Moreover, the sensor strip 112 can have a 15 inch spacing 704A between a first sensor of the plurality of the first sensors 114A-N and the lead portion 702A. Likewise, the strip 112 can have a 15 inch spacing 704B between a last sensor of the plurality of second sensors 114A-N and the lead portion 702B.

Each of the plurality of sensors 114A-N can be spaced 5 inches apart from each other (which can be advantageous for a queen size bed). Each of the plurality of sensors 114A-N can also be spaces 7 inches apart from each other (which can be advantageous for a king size bed). A 10 inch middle gap 706 can also be disposed between the plurality of first sensors 114A-N and the plurality of second sensors 114A-N. The spacing of the sensors 114A-N described herein can be advantageous to provide for equal distribution of the sensors 114A-N and even detection of temperature and biometric information. One or more other spacings can be realized. For example, one or more other spacings can be used depending on a size of the bed system. In some examples, the spacing can be 5 inches between sensors 114A-N. In some implementations, the spacing can vary within a range of 5 inches to 6⅝ inches.

Figure 13:
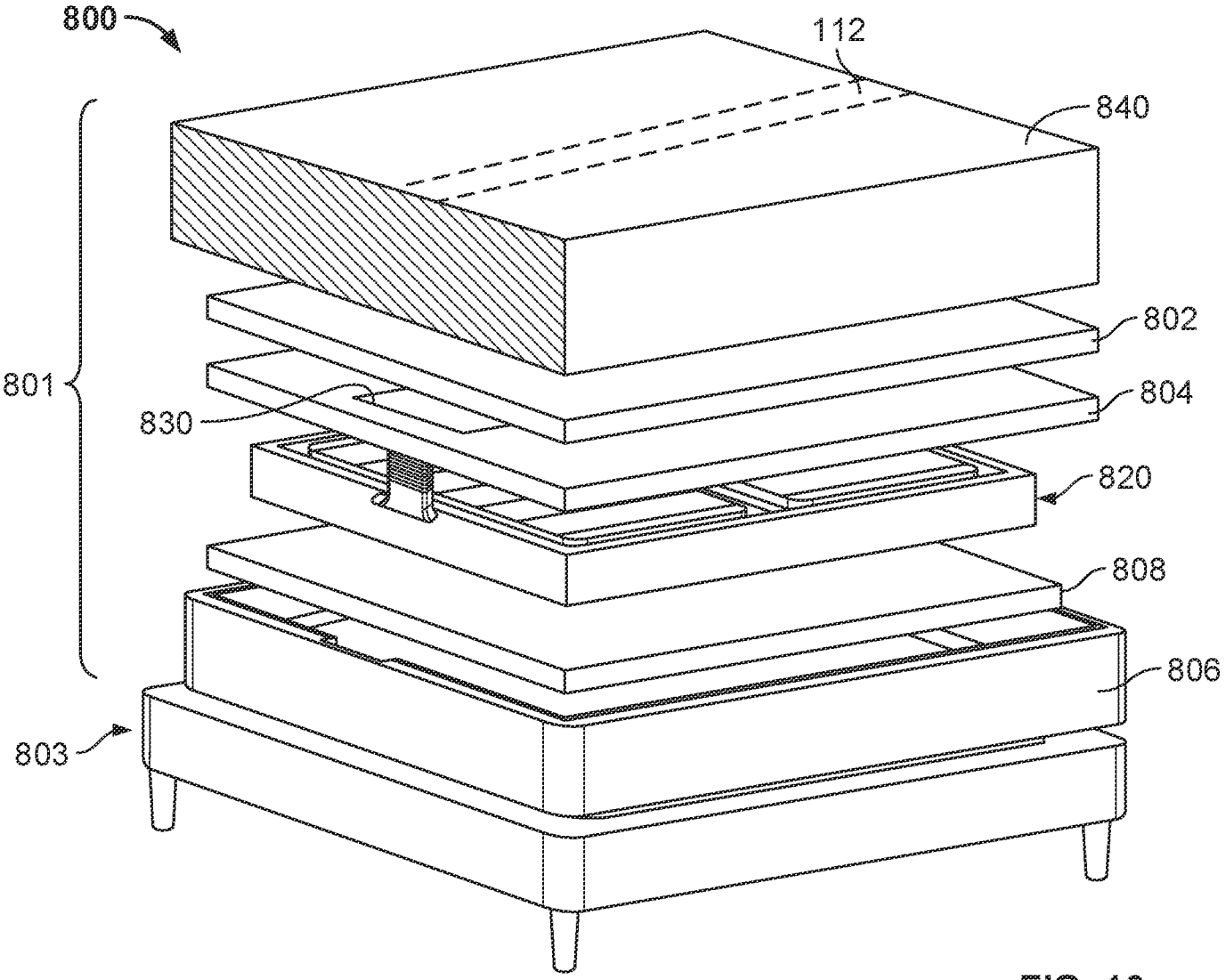
FIG. 13 illustrates an example bed system having the sensor strip as described herein.

FIG. 13 illustrates an example bed system 800 having the sensor strip 112 as described herein. The bed system 800 can be the bed system 100 as depicted and described throughout this disclosure (e.g., refer to FIGS. 1-11). In this example, the bed system 800 includes a mattress 801 and a foundation 803, which can be configured to be identical or similar to the mattresses and the foundations described herein. In general, the mattress 801 can be configured as a climate-controlled mattress, and include a mattress core, an air distribution layer, an air hose, an air controller, and a mattress cover. The mattress core is configured to support a user resting on the mattress. The air distribution layer is configured to facilitate air flow for climate control of a top surface of the mattress. As described throughout this disclosure, a plurality of sensors on the sensor strip 112 can sense one or more measurements, such as temperature and/or humidity values, that can be used by the bed system 800 to determine one or more appropriate operational parameters for microclimate control of the mattress, such as an appropriate air flow for climate control. The air hose is configured to route ambient or conditioned air into and from the air distribution layer. The air controller is fluidly connected to the air distribution layer via the air hose, and operates to cause ambient or conditioned air to flow into or from the air distribution layer, where the desired ambient or conditioned air is determined based at least in part on temperature and/or humidity values sensed by the sensors on the sensor strip 112. The mattress cover is used to enclose the mattress core, the air distribution layer, the sensor strip 112, and at least part of the air hose.

Still referring to FIG. 13, the mattress 801 can include a top layer 802, an intermediate layer 804, a rail structure 806, a bottom layer 808, an air chamber assembly 820, and an airflow layer 830, which can be configured to be identical or similar to the top layer, the intermediate layer, the rail structure, the bottom layer, the air chamber assembly, and the airflow layer, respectively, described above and throughout this disclosure. Any one or more of the layers 802, 804, 806, 808, and/or 830 can be made of foam, fabric, or another compressible material. The sensor strip 112 depicted and described herein can also be attached across the top layer 802 from one opposing lateral side to another opposing lateral side (e.g., from left to right sides of the mattress 801). The sensor strip 112 can come over an edge of each of the opposing lateral sides and down along a side of at least one of the top layer 802, the intermediate layer 804, the bottom layer 808, and/or the rail structure 806. The sensor strip 112 can attach to the side of at least one of the top layer 802, the intermediate layer 804, the bottom layer 808, and/or the rail structure 806 via one or more fastening elements as described herein. Additionally and/or alternatively, the sensor strip 112 can attach to a bottom of the mattress 801 via a micro-hook fastener that is configured to each end of the sensor strip 112. Further, the mattress 801 includes a mattress cover 840 having a top surface, a bottom surface, and side surfaces, which are configured to at least partially cover the top layer 802, the intermediate layer 804, the rail structure 806, the bottom layer 808, the air chamber assembly 820, the airflow layer 830, and the sensor strip 112.

Figure 14:
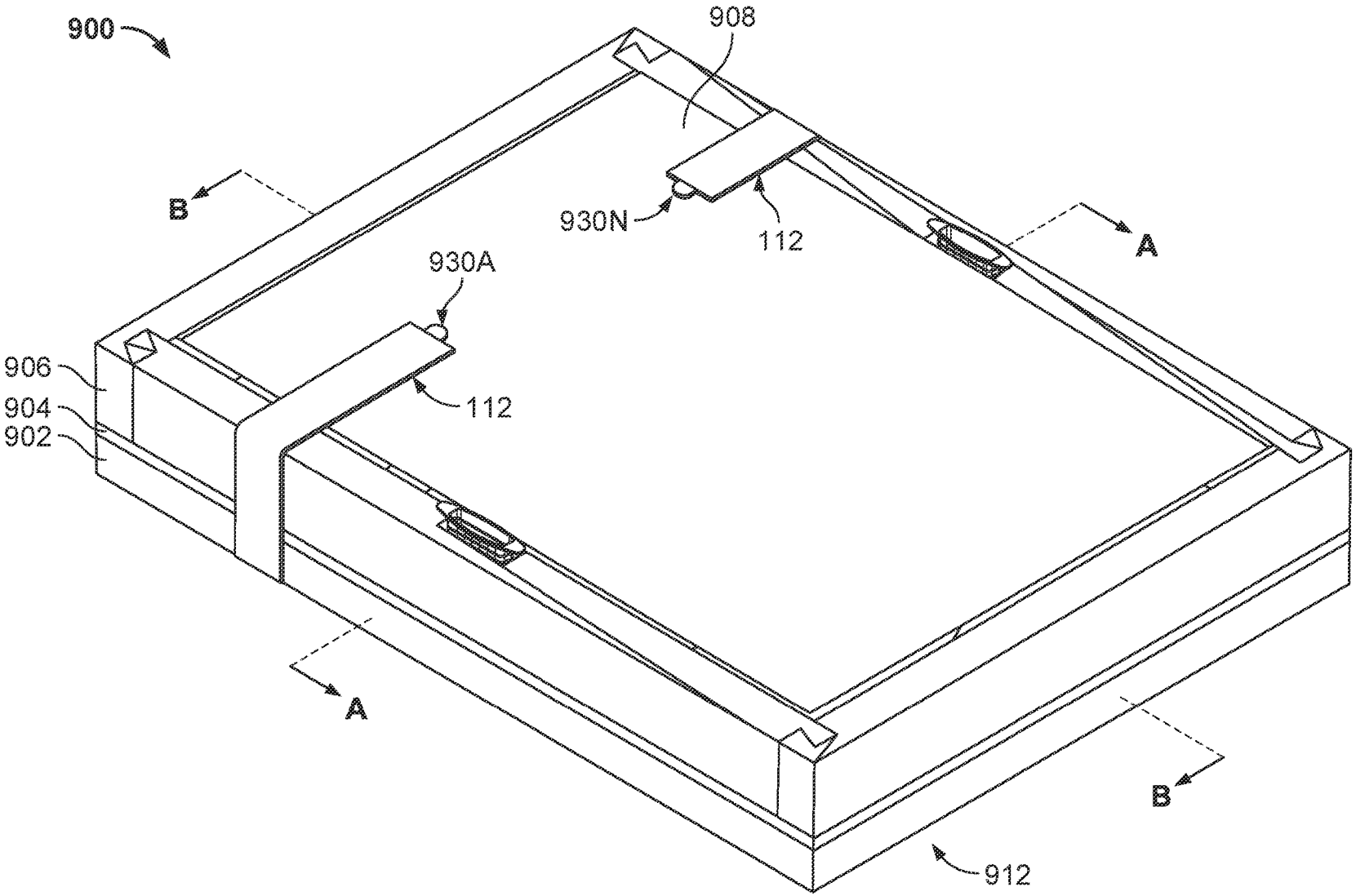
FIG. 14 is a bottom perspective view of a mattress system, illustrating the mattress system upside down.
Figure 15:
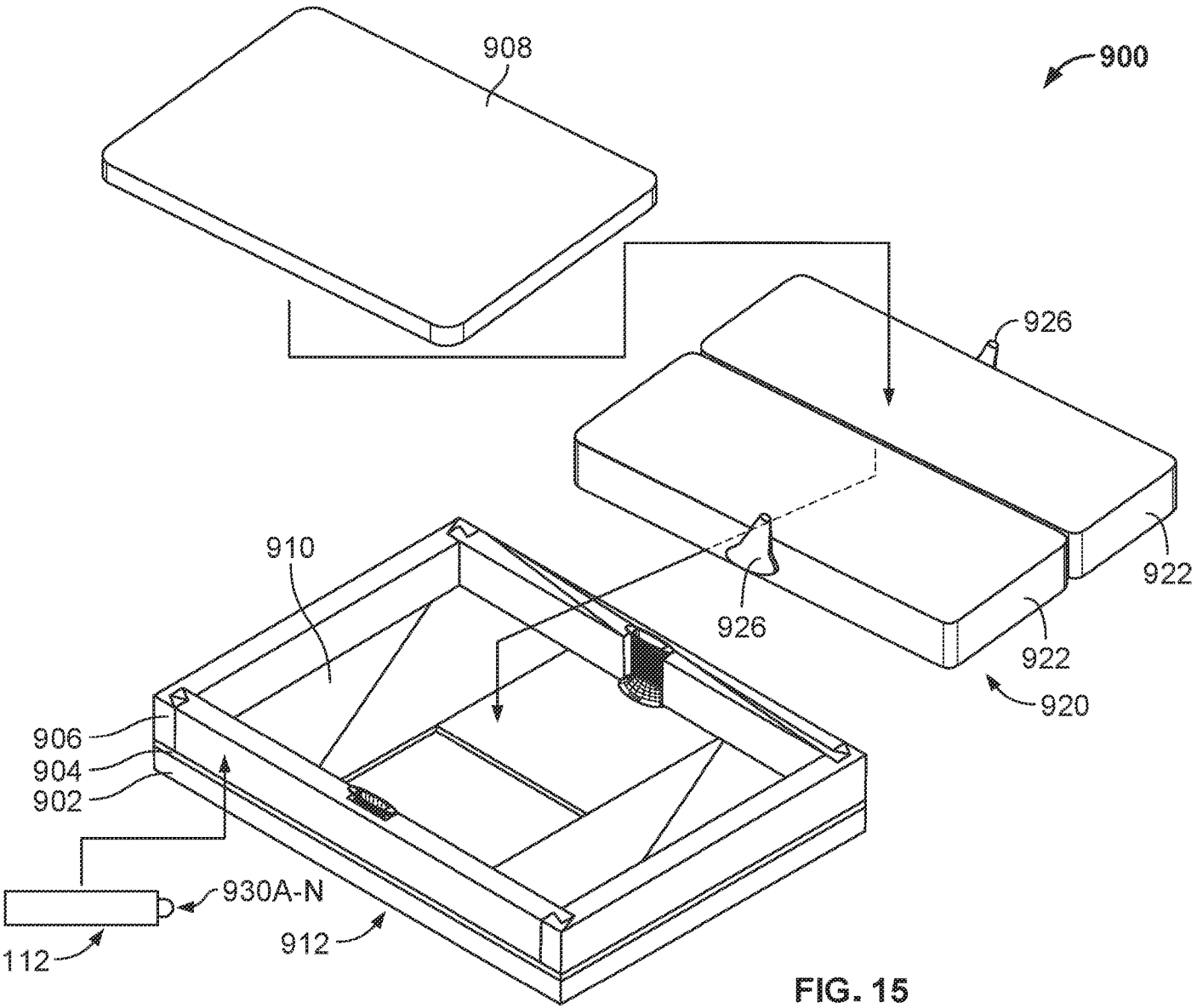
FIG. 15 is a partial exploded view of the mattress system of FIG. 14, illustrating the top later, the intermediate later, an example airflow layer, and the sensor strip.

FIG. 14 is a bottom perspective view of a mattress system 900, illustrating the mattress system upside down. The mattress system 900 can be the mattress as depicted and described throughout this disclosure (e.g., refer to FIGS. 1-13). The mattress system 900 can include a top layer (e.g., a first layer) 902, an intermediate layer (e.g., a second layer) 904, a rail structure 906, and a bottom layer (e.g., a third layer) 908. In some implementations, the top layer 902, the intermediate layer 904, and the bottom layer 908 are arranged in order from the top to the bottom of the mattress system 900. In some implementations, the mattress system 900 may not include the bottom layer 908. The rail structure 906 is arranged around a periphery of the mattress system 900 and configured to at least partially surround an air chamber assembly 920 (FIG. 15). As illustrated in FIG. 14, the bottom layer 908 can be disposed to be at least partially surrounded by the rail structure 906. The bottom layer 908 can be configured to close a space 910 (FIG. 15) defined by the rail structure 906. In other implementations, the bottom layer 908 can be configured and disposed above the rail structure 906.

The mattress system 900 can also include the sensor strip 112 as described throughout this disclosure. The sensor strip 112 can extend across the top layer 902 and over sides of at least one of the top layer 902, the intermediate layer 904, the bottom layer 908, and the rail structure 906. As a result, the strip 112 can be retained or secured in place to the mattress system 900. The sensor strip 112 can have fasteners 930A-N (e.g., micro-hook, VELCRO®, adhesive, tape, etc.) at each end (e.g., lead portion) of the strip 112. The fasteners 930A-N can retain the strip 112 to the bottom layer 908 of the mattress system 900. In other examples, the fasteners 930A-N can retain the strip 112 to the rail structure 906. In yet other examples, the fasteners 930A-N can retain the strip to only the top layer 902 and/or the intermediate layer 904.

Micro-hook fasteners 930A-N can be advantageous because they only have a hook, which can be inserted into one or more of the top layer 902, the intermediate layer 904, the bottom layer 908, and/or the rail structure 906 to secure the strip 112 in place. The strip 112 can have one or more fasteners 930A-N along a length of the strip 112. In other examples, the strip 112 can have the fasteners 930A-N only on the ends of the strip 112. For example, as depicted, each end of the strip 112 can have one fastener or micro-hook. This configuration can improve stability and serviceability of the sensor strip 112.

FIG. 15 is a partial exploded view of the mattress system 900 of FIG. 14. The top layer 902 can have a top surface 912 on which a user's body can be rested either directly, or indirectly through a mattress cover and/or one or more additional layers disposed on the top surface. The sensor strip 112 can be attached to the top surface 912. Therefore, a plurality of sensors attached to the strip 112 can have more direct exposure to a top of the mattress 900 and/or the user's body to capture more accurate temperature and/or humidity readings. The strip 112 can then extend down over at least one of the top layer 902, the intermediate layer 904, the bottom layer 908, and the rail structure 906. The strip 112 can be fastened or attached to any one of these using layers one or more fasteners 930A-N, as depicted and described throughout this disclosure.

The intermediate layer 904 can be disposed opposite to the top surface 912 of the top layer 902. The intermediate layer 904 can be attached to the top layer 902 in various ways. For example, the intermediate layer 904 can be glued to the top layer 902, or attached to the top layer 902 using fasteners, such as hook-and-loop fasteners (e.g., VELCRO®), zippers, clips, pins, buttons, straps, ties, snap fasteners, and other suitable types of fasteners.

Moreover, the mattress system 900 can include the air chamber assembly 920. In the illustrated example, the air chamber assembly 920 includes a pair of air chambers 922 disposed between the top layer 902 and the bottom layer 908, where the intermediate layer 904 is already attached to the top layer 902. The air chamber assembly 920 depicted can be for a king or queen size mattress 900. Other mattresses, such as twin and full size mattresses, can have an air chamber assembly having only one air chamber. As depicted in FIG. 15, the air chambers 922 can be arranged to be surrounded by the rail structure 906. The air chamber assembly 920 can further include a pump system configured to inflate and/or deflate the air chambers 922. The mattress 900 further includes an air chamber hose 926 connected to the air chambers 922 for inflating or deflating the air chambers 922. For example, one end of the air chamber hose 926 can be connected to the air chamber 922 to be in fluid communication with the interior of the air chamber 922, and the other end of the air chamber hose 926 can be fluidly connected to the pump system. In the illustrated implementations, the air chamber hoses 926 are routed at the side locations of the mattress system 900. In alternative implementations, the air chamber hoses 926 can be routed at different locations of the mattress system 900, such as the head or foot of the mattress system 900, or other suitable locations of the mattress system 900.

As depicted, the rail structure 906 can be disposed on the intermediate layer 904 to define the space 910 for at least partially receiving the air chamber assembly 920. The bottom layer 908 can be disposed at least partially within the space 910 to at least partially cover the space 910 and the air chamber assembly 920 within the space 910.

The top layer 902, the intermediate layer 904, the rail structure 906, and the bottom layer 908 can be made of various materials. For example, at least one of the top layer 902, the intermediate layer 904, the rail structure 906, and the bottom layer 908 can be made of foam, which may be closed-cell, open-cell, or a combination thereof. Other materials, such as one or more coil springs, air chambers, spacer materials, and/or other suitable materials, can be used for at least one of the top layer 902, the intermediate layer 904, the rail structure 906, and the bottom layer 908.

Figure 16:
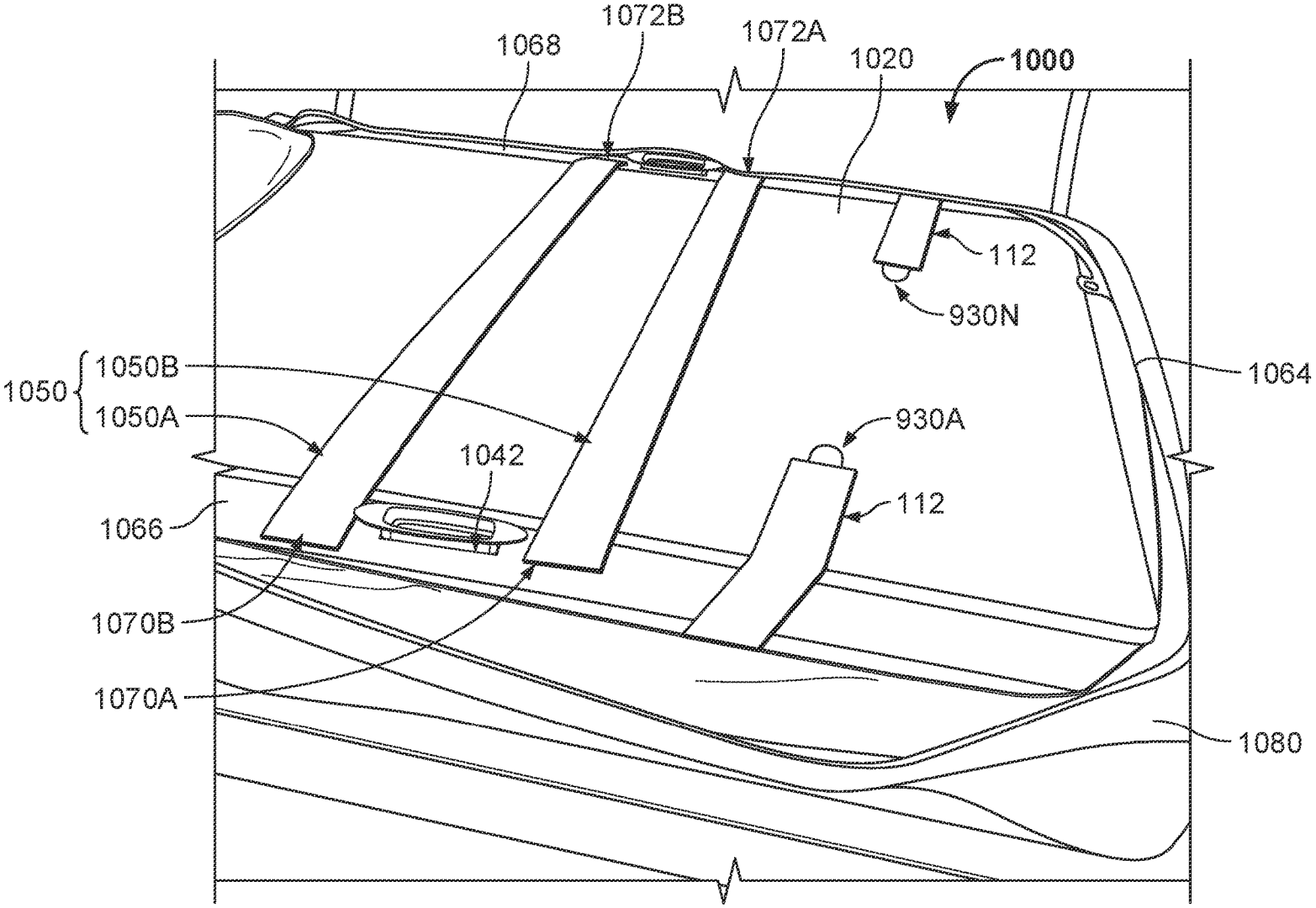
FIG. 16 illustrates a bottom perspective view of an example mattress system of FIG. 14 with a set of reinforcement straps and the sensor strip attached in place.
Figure 17:
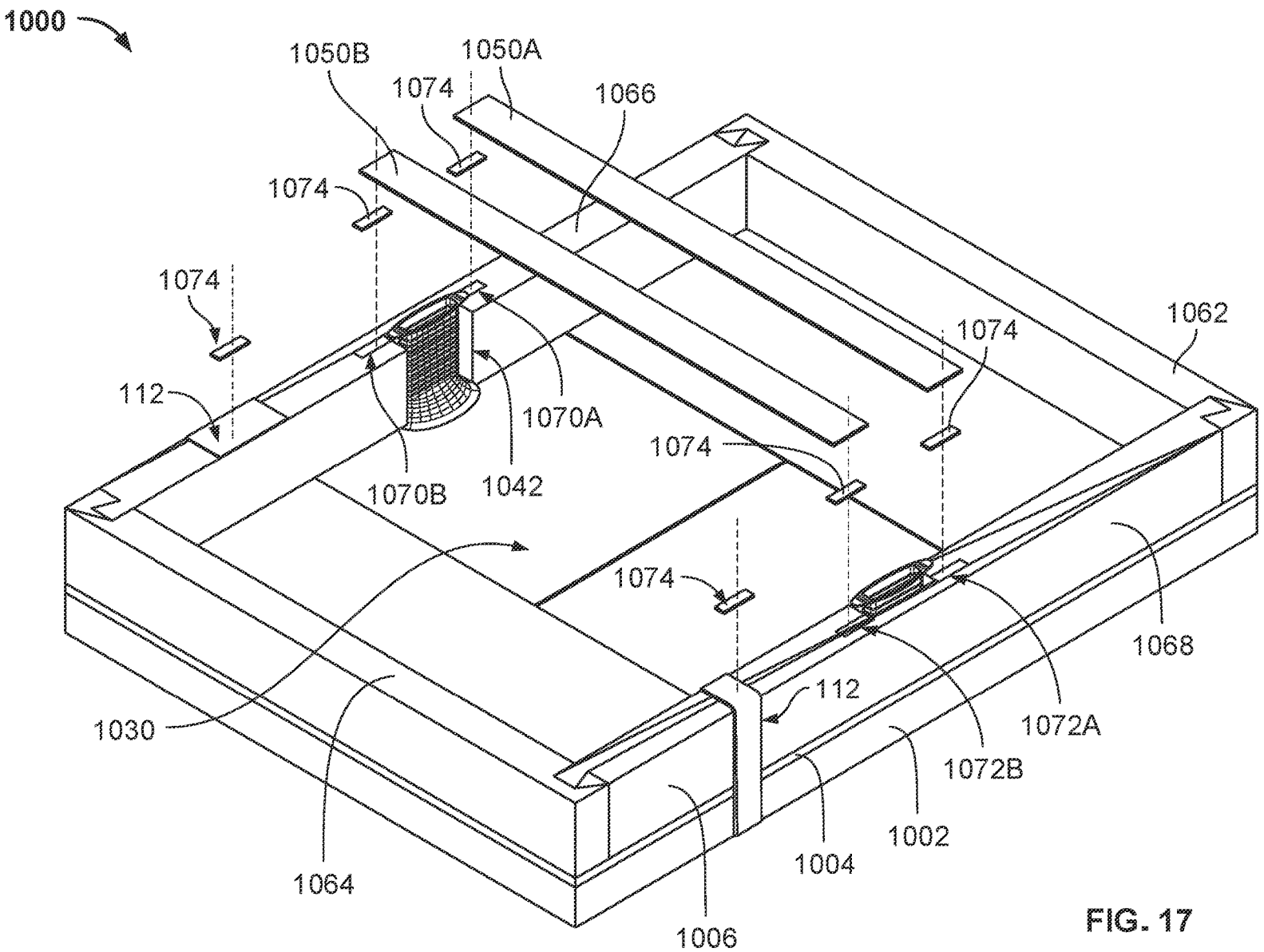
FIG. 17 illustrates a bottom perspective view of the mattress system with the reinforcement straps removed.

FIG. 16 illustrates a bottom perspective view of an example mattress system 1000 of FIG. 14 with a set of reinforcement straps 1050 and the sensor strip 112 attached in place. FIG. 17 illustrates a bottom perspective view of the mattress system 1000 with the reinforcement straps 1050 removed. Referring to both FIGS. 16-17, one or more reinforcement straps 1050 (e.g., 1050A and 1050B) can be used to hold the mattress system 1000 in place and keep it from bowing outwards when used. The mattress system 1000 can be configured similarly to the other mattress systems described herein. For example, the mattress system 1000 includes a top layer 1002, an intermediate layer 1004, a rail structure 1006, and an airflow layer 1030. The mattress system 1000 can be configured to include a core of various types, such as one or more inflatable air chambers, foams, and/or spring assemblies, that can be received in a space defined by the rail structure 1006 in the same or similar manner as described herein.

The rail structure 1006 can include a foot rail 1062, a head rail 1064, and opposite side rails 1066, 1068 extending between the foot rail 1062 and the head rail 1064. In some implementations, the rail structure 1006 can be made of one or more foam materials. In this example, the rail structure 1006 is attached to the intermediate layer 1004. When attached to the intermediate layer 1004, the rail structure 1006 may be also engaged with, or attached to, the airflow layer 1030 that is positioned in a cutout section of the intermediate layer 1004 (e.g., to be flushed with the intermediate layer 1004). For example, the foot rail 1062 is attached to a bottom of the intermediate layer 1004 at (or proximate) a foot edge of the intermediate layer 1004, and the head rail 1064 is attached to the bottom of the intermediate layer 1004 at (or proximate) a head edge of the intermediate layer 1004 (opposite to the foot edge of the intermediate layer 1004). The side rails 1066, 1068 are attached to the bottom of the intermediate layer 1004 at (or proximate) opposite sides of the intermediate layer 1004. The rail structure 1006 also forms an upside-down foam tub, along with the layers (e.g., the intermediate layer 1004, the airflow layer 1030, and/or the top layer 1002). For example, the rail structure 1006 defines a space for receiving a mattress core 1020, such as one or more inflatable air chambers, foams, and/or spring assemblies.

The reinforcement straps 1050 can include the first strap 1050A. The first strap 1050A can be connected to the opposite side rails 1066, 1068 so as to extend under the mattress core 1020 between bottoms of the side rails 1066, 1068. For example, one end of the first strap 1050A can be connected to a first connection point located on a bottom of a first side rail (e.g., the side rail 1066), and the other end of the first strap 1050A can be connected to a second connection point located on a bottom of a second side rail (e.g., the side rail 1068). The first strap 1050A can be attached to the opposite side rails 1066, 1068 at predetermined connection locations 1070A, 1072A. Further, the reinforcement straps 1050 can include the second strap 1050B. Similarly to the first strap 1050A, the second strap 1050B can be connected to the opposite side rails 1066, 1068 so as to extend under the mattress core 1020 between bottoms of the side rails 1066, 1068. For example, one end of the second strap 1050B can be connected to a third connection point located on a bottom of the first side rail (e.g., the side rail 1066), and the other end of the second strap 1050B can be connected to a fourth connection point located on a bottom of the second side rail (e.g., the side rail 1068). The second strap 1050B can be attached to the opposite side rails 1066, 1068 at predetermined connection locations 1070B, 1072B. In some implementations, the first strap 1050A and the second strap 1050B are positioned in a longitudinal middle section of the mattress. The first strap 1050A can extend to be parallel with the second strap 1050B and spaced at a predetermined distance from the second strap 1050B.

Other configurations of the straps 1050 can be possible. In some implementations, the straps 1050 can be routed to cross each other. For example, the first strap 1050A and the second strap 1050B are connected to the opposite side rails 1066, 1068 to extend under the mattress core 1020 between the bottoms of the side rails 1066, 1068. The first strap 1050A can be routed to cross the second strap 1050B by connecting one end of the first strap 1050A to one of the side rails 1066, 1068 between the head rail 1062 and the second strap 1050B, and connecting the other end of the first strap 1050A to the other side rail 1066, 1068 between the foot rail 1062 and the second strap 1050B.

In other configurations, one or more straps 1050 can extend to one or both of the foot rail 1062 and the head rail 1064. In one example, one or more straps 1050 can extend from the foot rail 1062 to the head rail 1064 rather than extending between the opposite side rails 1066 and 1068. In another example, one or more straps 1050 can extend from the foot rail 1062 to the head rail 1064 in addition to having one or more straps 1050 extending between the opposite side rails 1066 and 1068.

In some implementations, the rail structure 1006 can include one or more cutouts for various purposes. For example, the rail structure 1006 includes cutouts 1042 configured to receive air ducts of the airflow pad assemblies 1030 and/or other components (e.g., air passages, electronic wires, etc.) of the mattress system. The cutouts 1042 can be configured similarly to the notches 1042 described herein. The cutouts 1042 of the rail structure 1006 can structurally weaken the rail structure 1006 at or around the cutouts. The straps 1050 can be attached to the rail structure 1006 on opposite side of the cutouts 1042, thereby reinforcing or maintaining the rail structure 1006 at or around the cutouts 1042. For example, in the illustrated example, the cutouts 1042 are provided in the opposite side rails 1066, 1068, and the first strap 1050A and/or the second strap 1050B are connected to the opposite side rails 1066, 1068 proximate the cutouts 1042, as illustrated in FIGS. 16 and 17.

The first strap 1050A can be arranged close to the second strap 1050B and extend to be parallel with the second strap 1050B, as depicted in FIG. 16. The first strap 1050A can be arranged at a different distance from the second strap 1050B extending parallel with the first strap 1050A. An example of the distance can range from about 5 inches to about 70 inches. Although two reinforcement straps are illustrated in the illustrated examples, more than two reinforcement straps 1050 can be used in similar manners in other implementations. In yet alternative implementations, a single reinforcement strap 1050 can be used in a desired configuration.

The straps 1050 can be attached to the rail structure 1006 using one or more fastening elements 1074. The fastening elements 1074 can be of various types. For example, the fastening elements 1074 include adhesive tapes. Alternatively or in addition, the fastening elements 1074 can be hook-and-loop fasteners (e.g., VELCRO®), zippers, clips, pins, buttons, straps, ties, snap fasteners, and other suitable types of fasteners. The fastening elements 1074 can be applied at the connection locations 1070A-B, 1072A-B, or at desired locations (e.g., the ends) of the straps 1050, so that such desired location of the straps 1050 are attached to the connection points of the rail structure 1006. For example, adhesive tapes can be applied between the connection locations 1070A-B, 1072A-B of the rail structure and the ends of the straps 1050.

The straps 1050 that extend between the opposite side rails 1066 and 1068 and run across the bottom of the mattress can help hold the mattress core 1020 and other mattress components in place and keep them from bowing outwards after repeated edge of bed stress from a user entering and exiting. The reinforcement straps 1050 can be used with pieces of hook materials (e.g., 3M hook materials) with adhesive backing (e.g., the fastening elements 1074). The hook materials can be placed along the bottom side of the perimeter side rails 1066 and 1068. In some implementations, the reinforcement straps 1050 can include a scrim material and attach to the hook materials and extend from one side of the bed to the other side. The straps can be removable to allow other components (e.g., the air chambers, layers, etc.) to be assembled without interference. The straps 1050 can be adjustable to accommodate for stretch or changes over time, varying tolerances of the foam tub and its cover, or general aesthetic preference impact. The straps can have a width of varying sizes, such as a width ranging between about 1 inch and about 7 inches.

As illustrated in FIG. 16, the mattress system 1000 can further include a mattress cover 1080 configured to cover components of the mattress system 1000, such as the top layer 1002, the intermediate layer 1004, the rail structure 1006, the mattress core 1020, an airflow layer 1030, the straps 1050, and the sensor strip 112.

The mattress system 1000 also includes the sensor strip 112, as described throughout this disclosure. The strip 112 can extend over a top surface of the top layer 1002 and over sides of at least one of the top layer 1002, the intermediate layer 1004, and the rail structure 1006. As depicted in FIG. 17, the strip 112 can be fastened (e.g., attached, connected) to the opposite side rails 1066 and 1068. In other examples, as depicted in FIG. 16, the strip 112 can be fastened to the mattress core 1020. The strip 112 can be positioned closer to the head section of the mattress system 1000, for example closer to the head rail 1064. This configuration is beneficial because it provides for more accurate sensing of user body temperature(s) around the user's chest area. In other examples, the sensor strip 112 can be placed in one or more other locations on the mattress 1000. For example, the sensor strip 112 can be attached on top of one of the reinforcement straps 1050. The strip 112 can be attached between the straps 1050. The strip 112 can be attached to the mattress 112 at a predetermined distance from at least one of the straps 1050.

The sensor strip 112 can be attached to the mattress core 1020 by fasteners 930A-N, as described throughout this disclosure. Additionally and/or alternatively, the strip 112 can be attached to the opposite side rails 1066 and 1068 by the fastening elements 1074, as described above. The fastening elements 1074 and the fasteners 930A-N can be the same and/or different. In some examples, the sensor strip 112 can be attached to the reinforcement straps 1050A and/or 1050B by the fastening elements 1074. In other examples, the fastening elements 1074 that retain the reinforcement straps 1050A and 1050B to the opposite side rails 1066 and 1068 can be extended towards the head rail 1064. The sensor strip 112 can then be attached to the opposite side rails 1066 and 1068 via the extended fastening elements 1074. As a result, additional fastening elements 1074 may not be needed to secure the sensor strip 112 to the opposite side rails 1066 and 1068.

Figure 18:
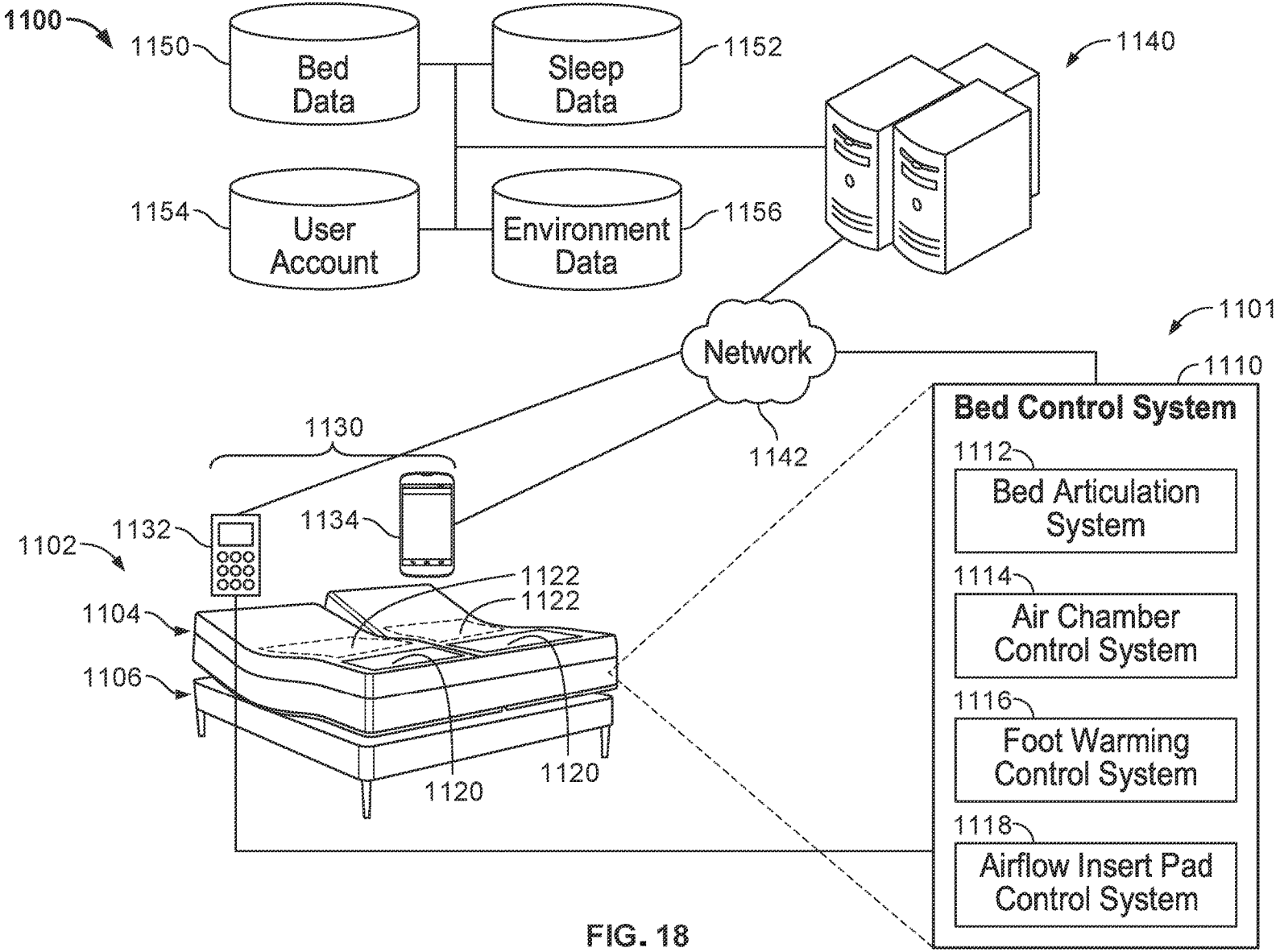
FIG. 18 illustrates an example bed system for providing a quality sleep experience with an example local bed system.

FIG. 18 illustrates an example bed system 1100 for providing a quality sleep experience with an example local bed system 1101. The local bed system 1101 can include a bed 1102 and a bed control system 1110 used in conjunction with the bed 1102 and configured to control one or more user comfort features of the bed 1102. The local bed system 1101 can be any one of the bed systems described throughout this disclosure.

The bed 1102 can include a mattress 1104 and a foundation 1106. In some embodiments, the mattress 1104 can be an air mattress having an inflatable air chamber and a controller for controlling inflation of the inflatable air chamber. In other embodiments, the mattress 1104 does not include an air chamber. For example, the mattress 1104 may include foam and/or springs instead of or in addition to an inflatable air chamber. The mattress 1104 can be sized and shaped as a twin mattress, full mattress, queen mattress, king mattress, California king mattress, split king mattresses, partially split mattress (e.g. a mattress that is split at the head and/or foot ends and joined in the middle), and/or other mattress as suitable for the application. The foundation 1106 is positioned under the mattress 1104 to support the mattress 1104. In some embodiments, the foundation 1106 can be an adjustable foundation with one or more articulable sections, such as for raising the head and foot of the foundation 1106 and the mattress 104. In other embodiments, the foundation 1106 can be a stationary foundation.

The bed 1102 can be configured to provide a microclimate control of the mattress 1104. In some implementations, the bed 1102 provides a foot warming function. For example, the bed 1102 can include a foot warming device 1120 which is disposed on the mattress 1104 or incorporated in the mattress 1104 and at a foot side of the bed 1102. The foot warming device 1120 can be disposed on a top of the mattress 1104, included in the mattress 1104, or disposed at other locations of the bed 1102 and/or in other configurations. The foot warming device 1120 can include an electronic heating element in some implementations. The foot warming device 1120 can include an air circulation element through which heating air is circulated in other implementations. Other configurations are also possible. The foot warming device 1120 can provide desired heat to the foot side of the bed 1102 based on one or more temperature and/or humidity values that are sensed by sensors configured to a sensor strip, as described throughout this disclosure.

In addition or alternatively, the bed 1102 can be configured to provide a body cooling/heating function. For example, the bed 1102 can include an airflow insert pad 1122 that can be included in the mattress 1104 and configured to circulate ambient or conditioned air through the mattress under the user at rest. The airflow insert pad 1122 can be arranged at various locations in the mattress 1104. In the illustrated example, the airflow insert pad 1122 is disposed between the head and foot of the mattress 1104 (e.g., in the middle of the mattress 1104). Whether to circulate ambient or conditioned air can be determined at least in part by one or more temperature and/or humidity values that are sensed by sensors configured to the sensor strip, as described throughout this disclosure.

The bed control system 1110 operates to control features available for the bed 1102. In some implementations, the bed control system 1110 includes a bed articulation system 1112, an air chamber control system 1114, a foot warming control system 1116, and an airflow insert pad control system 1118. The bed control system 1110 can be in communication with sensors of the sensor strip in order to make determinations about desired airflow supplies throughout the bed 1102.

The bed articulation system 1112 operates to articulate the foundation 1106 and/or the mattress 1104. For example, the bed articulation system 1112 can adjust one or more articulable sections of the foundation 1106 to raise the head and foot of the foundation 1106 and/or the mattress 1104. The bed articulation system 1112 can include a controller and an actuator (e.g., a motor) operated by the controller and coupled to the articulable sections of the foundation 1106 so that the sections of the foundation 1106 are automatically adjusted to desired positions. Alternatively or in addition, the articulable sections of the foundation 1106 can be manually adjusted.

The air chamber control system 1114 operates to control the air chamber of the mattress 1104. The air chamber control system 1114 can include a controller and an actuator (e.g., a pump) operated by the controller and fluidly connected to the air chamber. The actuator is controlled to inflate or deflate the air chamber to provide and maintain a desired pressure in the air chamber, thereby providing a desired firmness of the air chamber.

The foot warming control system 1116 operates to control the foot warming device 1120 disposed in the mattress 1104. The foot warming control system 1116 can include a controller configured to activate a heating element of the foot warming device 1120 and maintain a desired temperature of the heating element. For example, to maintain the desired temperature of the heating element, the control system 1116 can receive real-time temperature and/or humidity values from the sensors attached to the sensor strip. Based on these sensed values, the control system 1116 can determine whether to provide additional heated air to the foot section of the bed 1102, whether to stop providing heated air, and/or whether to provide ambient air. As an example, when the sensed values reach the desired temperature of the heating element, the control system 1116 can be configured to provide ambient air via the heating element in order to maintain the desired temperature. Once the sensed values indicate that the bed 1102 has a temperature below the desired temperature, the control system 1116 can activate the heating element to provide warmed air until the desired temperature is sensed in real-time by the sensors attached to the sensor strip.

The airflow insert pad control system 1118 operates to control the airflow insert pad 1122 disposed in the mattress 1104. The airflow insert pad control system 1118 can include an air controller configured to cause ambient or conditioned air to flow into or out of the airflow insert pad 1122 so that a top layer of the mattress above or adjacent the airflow insert pad 1122 have a desired temperature and/or humidity. The airflow insert pad control system 1118 can determine an airflow based on one or more temperature and/or humidity sensor readings. The temperature and/or humidity sensor readings can be captured by the sensors attached to the sensor strip, as described throughout this disclosure. The sensor strip can be positioned and attached to the top of the mattress 1104, beneath a mattress cover, and proximate to a head section of the mattress 1104 or above the airflow insert pad 1122. As a result, temperature and/or humidity values can be sensed by the sensors closest to a user's chest area when the user is laying on top of the mattress 1104. More accurate temperature and/or humidity values can be sensed if the sensor strip is positioned closer to where a user's body lays and/or where the airflow insert pad 1122 is located. The airflow insert pad control system 1118 can determine whether to cause ambient or conditioned air to flow into or out of the airflow insert pad 1122 based on the sensed temperature and/or humidity values at the top layer of the mattress and/or of the user's body.

In some implementations, the bed articulation system 1112, the air chamber control system 1114, the foot warming control system 1116, and the airflow insert pad control system 1118 can be independently configured and operated. In other implementations, some or all of the bed articulation system 1112, the air chamber control system 1114, the foot warming control system 1116, and the airflow insert pad control system 1118 are at least partially combined so that they share at least part of their components such as actuators (e.g., motors, pumps, etc.) and/or controllers (e.g., control circuits, processors, memory, network interfaces, etc.).

The bed control system 1110 can be accessed by a user via one or more control devices 1130, such as a bed-side controller 1132 and a mobile computing device 1134. The bed-side controller 1132 is wired to, or wirelessly connected to, the bed control system 1110 to enable the user to at least partially control the bed control system 1110. The bed-side controller 1132 includes an input device (e.g., a keypad, buttons, switches, etc.) for receiving a user input of controlling various settings of the bed control system 1110, such as articulation positions, temperature settings, air chamber pressure settings, etc. The bed-side controller 1132 can further include an output device (e.g., a display, a speaker, etc.) for outputting the statuses and conditions of the bed control system 1110 and other information useful to the user, such as articulation positions, temperature settings, air chamber pressure settings, sleep analysis results, etc. The same or similar functionalities can be implemented with the mobile computing device 1134, such as a mobile device running a dedicated software application. For example, the user can use a mobile device as an input device to control various settings of the bed control system 1110, such as articulation positions, temperature settings, air chamber pressure settings, etc., and further use the mobile device as an output device to see the statuses and conditions of the bed control system 110 and other useful information, such as articulation positions, temperature settings, air chamber pressure settings, sleep analysis results, etc.

Referring still to FIG. 18, the system 1100 can include a server system 1140 connected to the local bed system 1101 and configured to provide one or more services associated with the bed 1102. The server system 1140 can be connected to the local bed system 1101, such as the bed 1102, the bed control system 1110, and/or the control devices 1130, via a network 1142. The server system 1140 can be of various forms, such as a local server system with one or more computing devices dedicated to one or more beds, or a cloud server. The network 1142 is an electronic communication network that facilitates communication between the local bed system 1101 and the server system 1140. An electronic communication network is a set of computing devices and links between the computing devices. The computing devices in the network use the links to enable communication among the computing devices in the network. The network 1142 can include routers, switches, mobile access points, bridges, hubs, intrusion detection devices, storage devices, standalone server devices, blade server devices, sensors, desktop computers, firewall devices, laptop computers, handheld computers, mobile telephones, and other types of computing devices. In various embodiments, the network 1142 includes various types of links. For example, the network 1142 includes wired and/or wireless links. Furthermore, in various embodiments, the network 1142 is implemented at various scales. For example, the network 1142 can be implemented as one or more local area networks (LANs), metropolitan area networks, subnets, wide area networks (such as the Internet), or can be implemented at another scale.

In some implementations, the server system 1140 can provide a bed data service that can be used in a data processing system associated with the local bed system 1101. The server system 1140 can be configured to collect sensor data and sleep data from a particular bed, and match the sensor and sleep data with one or more users that use the bed when the sensor and sleep data were generated. The sensor and sleep data, and the matching data, can be stored as bed data 1150 in a database. The bed data 1510 can include user identification data usable to identify users of beds. The users can include customers, owners, or other users registered with the server system 1140 or another service. Each user can have, for example, a unique identifier, user credentials, contact information, billing information, demographic information, or any other technologically appropriate information. The bed data 1150 can include management data usable to identify data related to beds or other products associated with data processing systems. For example, the beds can include products sold or registered with a system associated with the server system 1140. Each bed can have, for example, a unique identifier, model and/or serial number, sales information, geographic information, delivery information, a listing of associated sensors and control peripherals, etc. Additionally, an index or indexes stored in the bed data 1150 can identify users that are associated with beds. For example, this index can record sales of a bed to a user, users that sleep in a bed, etc.

The bed data 1150 can include sensor data that record raw or condensed sensor data recorded by beds with associated data processing systems. For example, a bed's data processing system can have a temperature sensor, humidity sensor, pressure sensor, and light sensor. Readings from these sensors, either in raw form or in a format generated from the raw data (e.g. sleep metrics) of the sensors, can be communicated by the bed's data processing system to the server system 1140 for storage in the bed data 1150. Additionally, an index or indexes stored by the server system 1140 can identify users and/or beds that are associated with the sensor data. In some implementations, the server system 1140 can use any of its available data to generate advanced sleep data. The advanced sleep data includes sleep metrics and other data generated from sensor readings.

For example, the advanced sleep data can include sensed mattress surface temperature values and/or sensed mattress surface humidity values. Using these values, the server system 1140 can determine an amount of ambient and/or conditioned air to deliver through the mattress 1104 to maintain an optimal or desired temperature for the mattress 1104 (e.g., the desired temperature can be determined by the user, by the server system 1140, and/or by any one of the other systems described in reference to FIG. 18). The server system 1140 can also determine/estimate a body temperature of the user based on sensed mattress surface temperature values and/or humidity values. One or more of these calculations can be performed locally on the bed's data processing system. Performing such calculations in the server system 1140, however, can be advantageous because the calculations can be computationally complex or requiring a large amount of memory space or processor power that is not available on the bed's data processing system. This can help allow a bed system to operate with a relatively simple controller and still be part of a system that performs relatively complex tasks and computations.

The sensed temperature values and/or airflow adjustment determinations can also be transmitted to the bed-side controller 1132 and/or the mobile computing device 1134. Based on these values and airflow adjustment determinations, the user can selectively moderate, adjust, and/or change an airflow through the mattress 1104 or a desired temperature.

In addition or alternatively, the server system 1140 can provide a sleep data service that can be used in a data processing system that can be associated with the local bed system 1101. In this example, the server system 1140 is configured to record data related to users' sleep experience and store the data as sleep data 1152. The sleep data 1152 can include pressure sensor data related to the configuration and operation of pressure sensors in beds. For example, the pressure sensor data can include an identifier of the types of sensors in a particular bed, their settings and calibration data, etc. The sleep data 1152 can include pressure based sleep data which can be calculated based on raw pressure sensor data and represent sleep metrics specifically tied to the pressure sensor data. For example, user presence, movements, weight change, heart rate, and breathing rate can be determined from raw pressure sensor data. Additionally, an index or indexes stored by the server system 1140 can identify users that are associated with pressure sensors, raw pressure sensor data, and/or pressure based sleep data. The sleep data 1152 can include non-pressure sleep data which can be calculated based on other sources of data and represent sleep metrics obtained from such other sources of data. For example, user entered preferences, light sensor readings, and sound sensor readings can all be used to track sleep data 1152. Additionally, an index or indexes stored by the server system 1140 can identify users that are associated with other sensors and/or non-pressure sleep data 1152.

In addition or alternatively, the server system 1140 can provide a user account service that can be used in a data processing system associated with the local bed system 1101. For example, the server system 1140 can record a list of users and to identify other data related to those users, and store such data as user account data 1154. The user account data 1154 are related to users of beds with associated data processing systems. For example, the users can include customers, owners, or other users registered with the server system 1140 or another service. Each user can have, for example, a unique identifier, user credentials, demographic information, or any other technologically appropriate information. The user account data 1154 can include engagement data usable to track user interactions with the manufacturer, vendor, and/or manager of the bed and/or cloud services. This engagement data can include communications (e.g., emails, service calls), data from sales (e.g., sales receipts, configuration logs), and social network interactions. The user account data 1154 can include usage history data related to user interactions with one or more applications and/or remote controls of a bed. For example, a monitoring and configuration application can be distributed to run on, for example, the control devices 1130. This application can log and report user interactions for storage. Additionally, an index or indexes stored by the server system 1140 can identify users that are associated with each log entry.

In addition or alternatively, the server system 1140 can provide an environment service that can be used in a data processing system associated with the local bed system 1101. For example, the server system 1140 can record data related to users' home environment, and store such data as environment data 1156. The environment data 1156 can be obtained using one or more sensors installed in or around the bed. Such sensors can be of various types that can detect environmental variables, such as light sensors, noise sensors, vibration sensors, thermostats, etc. The environment data 1156 can include historical readings or reports from those sensors. By way of example, a light sensor is used to collect data indicative of the frequency and duration of instances of increased lighting when the user is asleep.

Figure 19:
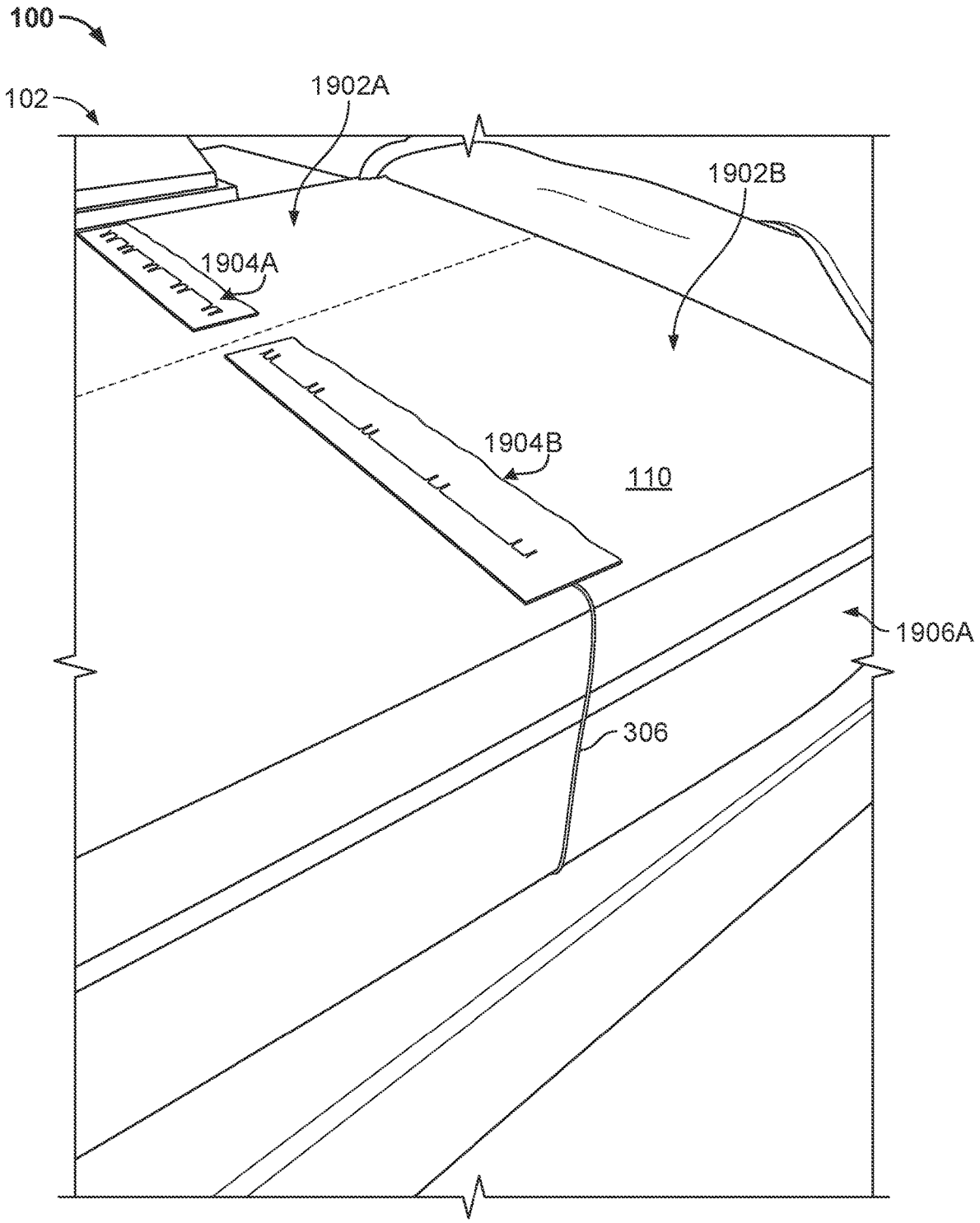
FIG. 19 is a side perspective view of the bed system having sensor strips.

FIG. 19 is a side perspective view of the bed system 100 having sensor strips 1904A-B. The sensor strips 1904A-B can be configured similarly to the sensor strips 112 described herein. The mattress 102 of the bed system 100 can include a first side 1902A and a second side 1902B. The first side 1902A can support a first user of the bed system 100 and the second side 1902B can support a second user of the bed system 100. Accordingly, the first side 1902A can extend from a first lateral side of the mattress 102 to a midpoint of the mattress 102 and the second side 1902B can extend from a second lateral side of the mattress 102 opposite the first lateral side to the midpoint of the mattress 102. Various bed systems 100 can have this configuration, including but not limited to king, California-king, queen, full, split top king, split top California-king, split top queen, flex top king, flex top California-king, and/or flex top queen mattresses. Each side 1902A and 1902B of the mattress 102 can have a respective sensor strip. Thus, the strip 112 described throughout this disclosure can be configured to attach to either side 1902A or 1902B of the mattress 102. In the example of FIG. 19, the strip 112 is attached to a portion of the foam tub 110 of the second side 1902B of the mattress 102. The sensor strips 1904A-B, which can be the same as the sensor strip 112 described herein, can be configured to attach to a portion of the foam tub 110 of the first side 1902A and the second side 1902B of the mattress 102, respectively.

Figure 24:
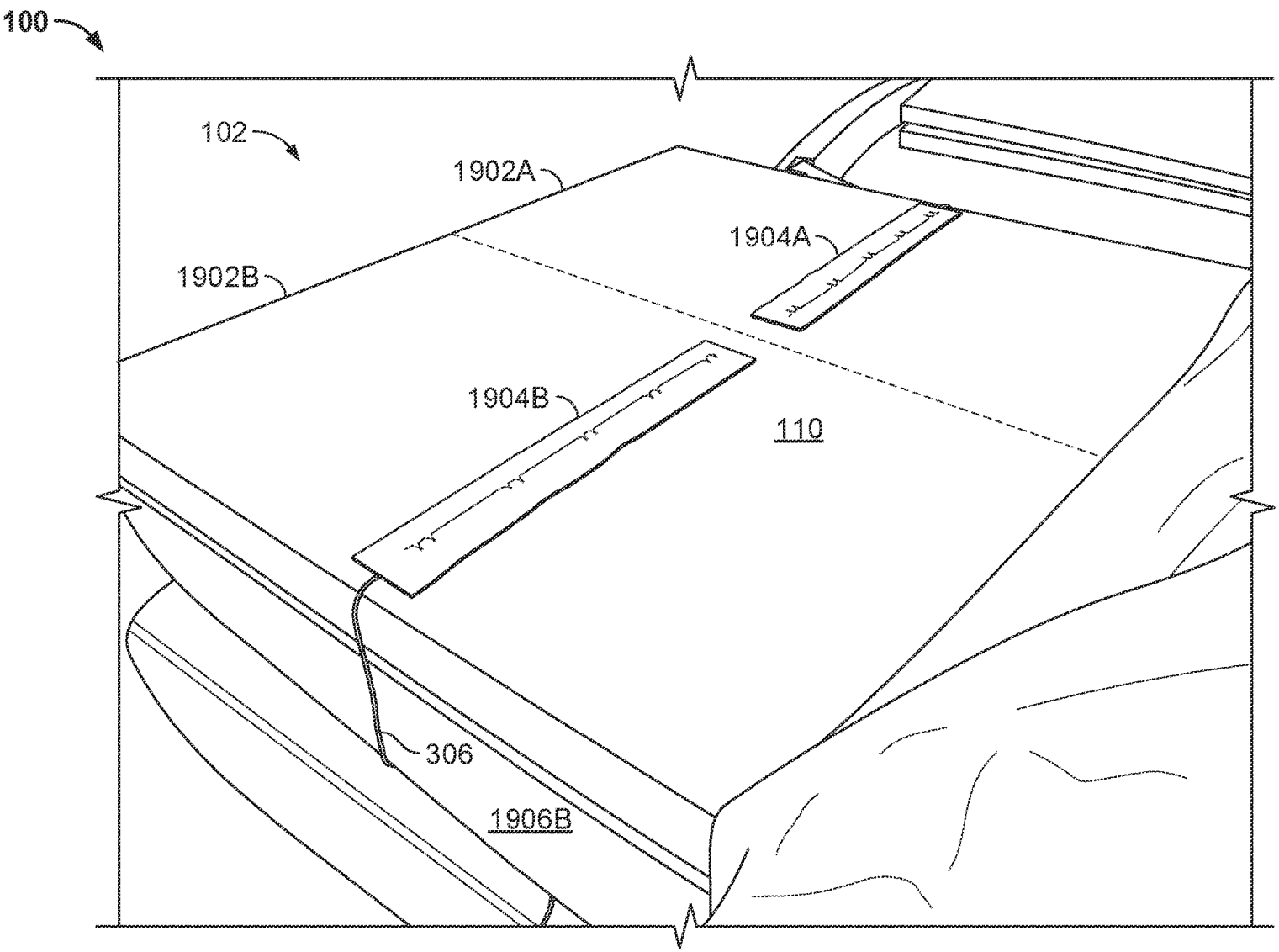
FIG. 24 is another side perspective view of the bed system having sensor strips.

In this configuration, the sensor strap at the second side 1902B does not extend over a side 1906A of the mattress. Similarly, the sensor strap at the first side 1902A does not extend over a side (opposite to the side 1906A) of the mattress. The wires 306 of the strip 1904A can be organized and routed over an edge and a side of the foam tub 110 then down the side 1906A of the mattress 102. Wires of the strip 1904B (e.g., refer to FIG. 24) can similarly be routed down a side of the foam tub 110 that is opposite the side 1906A. Refer to FIG. 24 for additional discussion.

As shown in FIG. 19, the strip 1904A can extend over a portion of the foam tub 110 on the second side 1902B of the mattress 102. For example, the strip 1904A can be offset by some distance from an edge between a top surface of the foam tub 110 and the side 1906A of the mattress 102. Therefore, the strip 1904A may not extend over the edge of the foam tub 110 and down the side 1906A of the mattress 102, in some implementations. The strip 1904A may also extend across a length of the second side 1902B that is less than a length between the edge of the foam tub 110 and the side 1906A of the mattress 102 and the midpoint of the mattress 102. The same configuration can also be applied and used for the sensor strip 1904B on the first side 1902A of the mattress 102.

The sensor strips 1904A-B can be made of a fabric having a fibrous side, or a "loop" side so that the sensor strips 1904A-B can connect to microhooks or other "hook" fasteners described throughout this disclosure. In implementations where hook fasteners are not used to connect the sensor strips 1904A-B to the foam tub 110, other fabrics can be used that do not include the fibrous side. The fabric of the sensor strips 1904A-B can also be thin enough (e.g., within a threshold measurement range) such that users of the mattress 102 may not feel the sensor strips 1904A-B as they lay on top of the mattress 102. The fabric may also have an antimicrobial additive or other features that ensure the fabric is compliant with standards including but not limited to ASTM G21. In some implementations, the fabric may also have some rigidity to it as opposed to being more flexible such that the sensor strips 1904A-B are distributed evenly over the top surface of the foam tub 110 and the users are less likely to feel the sensor strips 1904A-B. The fabric of the sensor strips 1904A-B may also have one or more additional or similar characteristics and/or qualities.

Figure 20:
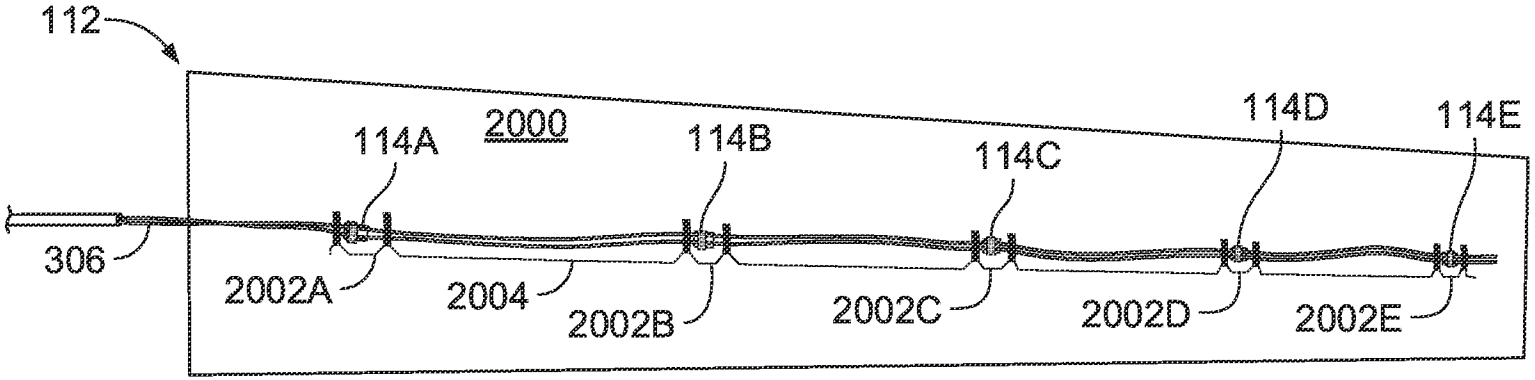
FIG. 20 is a bottom view of the sensor strip.

FIG. 20 is a bottom view of the sensor strip 112. As described in reference to FIG. 9, the sensor strip 112 can include a first strip surface 2000, which can be attached and thus abutted to a top surface of the foam tub layer (e.g., compressible layer). The sensors 114A-E can be attached to the first strip surface 2000. As shown in FIG. 20, the sensors 114A-E can be sewn into the first strip surface 2000 by respective stitching 2002A-E and 2004. The stitching 2002A-E can also extend over the wire 306 that wiredly connect the sensors 114A-E in series such that the wire 306 can be retained in an organized manner against the first strip surface 2000.

As shown in FIG. 20, the strip 112 can have five sensors 114A-E. They can be equally spaced/distanced apart along the first strip surface 2000. In some implementations, the strip 112 can include eight sensors that are equally spaced apart. Five sensors 114A-E can be cost efficient and provide accuracy in the collection of temperature data. In some implementations, the strip 112 can include any quantity of sensors that can be spaced every half inch apart from each other along the first strip surface 2000.

Figure 21:
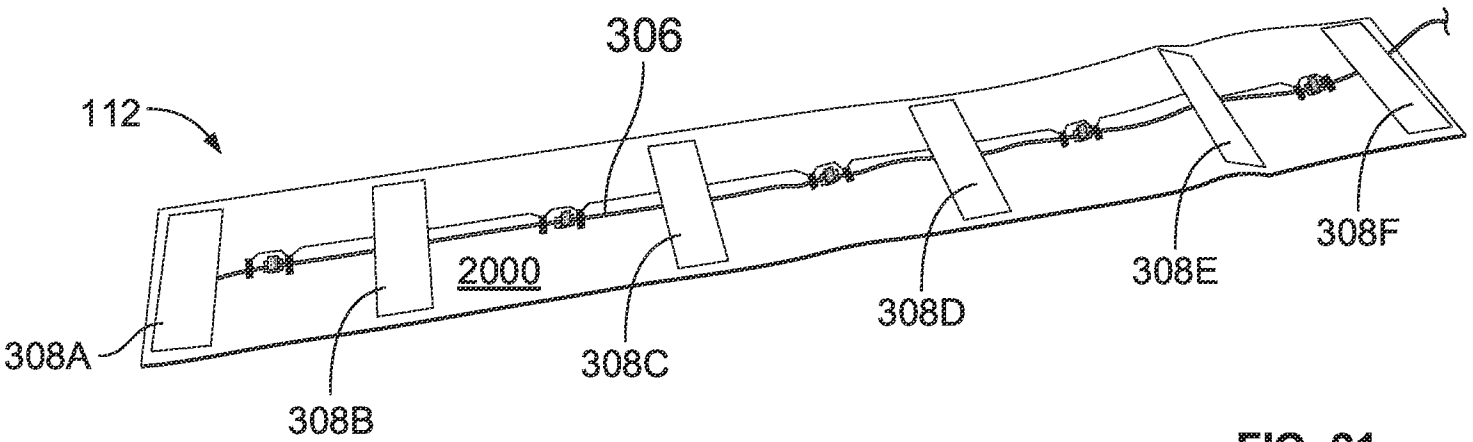
FIG. 21 is another bottom view of the sensor strip with adhesives.

FIG. 21 is another bottom view of the sensor strip 112 with adhesives 308A-F. The adhesives 308A-F can be equally spaced apart between the sensors to provide for attaching the strip 112 to the top surface of the foam tub. In some implementations, adhesives 308A and 308F can be positioned on opposite ends of the sensor strip 112 to retain the strip 112 to the foam tub. The adhesives 308A-F can be equally spaced apart as shown in FIG. 21 in order to prevent the strip 112 from bunching up when a user rests on top of the bed system. The placement of the adhesives 308A-F can also be beneficial to ensure that the strip 112 can shift slightly without causing failures or interference with the sensors. Therefore, the strip 112 can be held in place to the top surface of the foam tub and can accurately capture temperature data regardless of the movement or other activity on the surface of the bed system. Accordingly, the configuration of the adhesives 308A-F shown in FIG. 21 can prevent the strip 112 from moving or shifting in position over time from movement, use of, or other activity on the bed system.

As described herein, the adhesives 308A-F can include but are not limited to microhooks. In some implementations, the adhesives 308A-F can be acrylic adhesives, tapes, and/or various hooks. Illustrative examples of adhesives 308A-F include but are not limited to (1) 3M™ hook fasteners, such as model number SJ3506, which can be attached to the sensor strap with acrylic adhesives, (2) 3M™ hook fasteners that can be attached to the sensor strap with an adhesive tape such as model number 3M 9775WL PSA, and/or (3) VELCRO™ hooks, such as model number HTH 830 with PSA 9932. In some implementations, a reclosable fastener can use an acrylic adhesive as described above. The reclosable fastener, a hook fastener, can use an interlocking mushroom-like head instead of a loop. The reclosable fastener can be used in maximum temperatures of 158 degrees Fahrenheit. The reclosable fastener can have a density of approximately 1400 hooks/in. In some implementations, different types of adhesive transfer tapes (e.g., acrylic tapes) can be used, which can provide bonding between fabricated foams, fabrics substrates, and has good shear strength at elevated temperatures (e.g., over 100 degrees Fahrenheit). In some implementations, the adhesives 308A-F can be approximately 0.005 inches thick. The adhesives 308A-F can have one or more other thicknesses, such as a thickness ranging from 0.01 inches to 0.05 inches. Moreover, in some implementations, the adhesives 308A-F can include hook and loop fasteners. The hooks can be made of a Polypropylene material and the loops can be made of a Polyamide material. The hook and loop fasteners can secure the strip 112 to the foam tub and endure tension of approximately 12.3 PSI. Moreover, adhesives for the hook and loop fasteners can operate within temperature ranges such as −30 to 200 degrees Fahrenheit. These adhesives may also have an adhesive pull strength such as 8 PIW. The adhesives can also provide a foam tearing bond.

Figure 22:
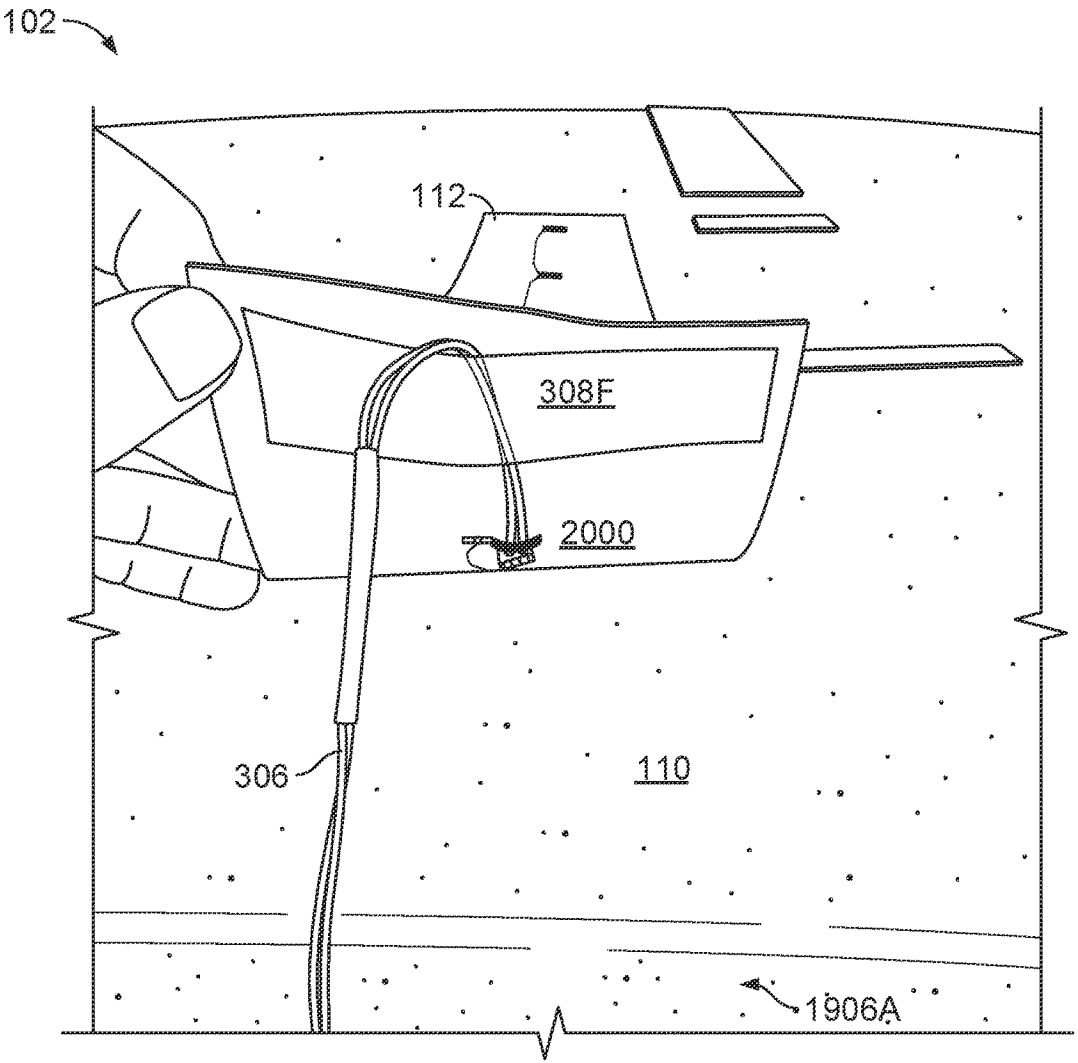
FIG. 22 is a partial exploded perspective view of the sensor strip as it attaches to the mattress.

FIG. 22 is a partial exploded perspective view of the sensor strip 112 as it attaches to the mattress 102. The adhesive 308E is positioned along an edge of the strip 112 so as to retain the edge of the strip 112 to the top surface of the foam tub 110. The adhesive 308E also goes over a portion of the wire 306 such that the wire 306 is organized and extending out from a midpoint of the edge of the strip 112. When the strip 112 is attached and secured to the top surface of the foam tub 110, the wire 306 can extend over an edge and side of the foam tub 110, down the side 1906B of the mattress 102.

Figure 23A:
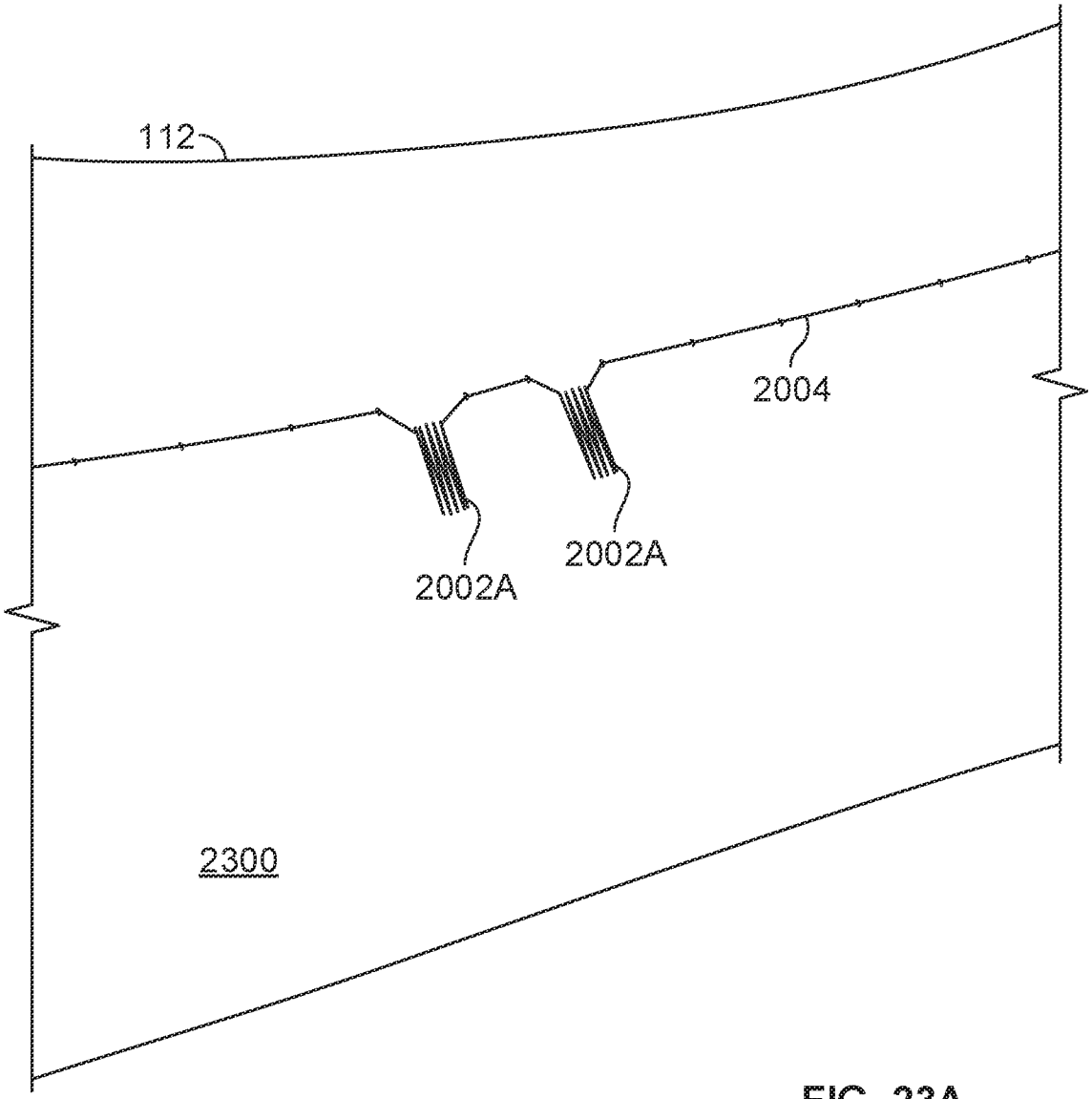
FIG. 23A is a partial exploded top view of the sensor strip.

FIG. 23A is a partial exploded top view of the sensor strip 112. As described throughout this disclosure, the sensor strip 112 has a first strip surface and a second strip surface. Refer to FIG. 20 for additional discussion about the first strip surface 2000. FIG. 23A depicts a second strip surface 2300 of the sensor strip 112. The second strip surface 2300 is opposite the first strip surface 2000 of FIG. 20 and can be exposed to a top of the mattress of the bed system. As shown in FIG. 23A, the stitching 2002A and 2004 depicted and described in FIG. 20 may appear on the second strip surface 2300 since the stitching 2002A and 2004 can pass through the strip 112 to secure the sensors and the wire in place.

Moreover, the fabric of at least the second strip surface 2300 can provide comfortability to users of the bed system. In some implementations, the fabric of the entire strip 112 (including the first and second strip surfaces) can minimize interference of sensor performance while also maintaining user comfortability. The fabric can be thin enough such that a user of the bed system may not feel the strip 112 when they run their hands over the top of the mattress or otherwise rest on top of the mattress. The fabric of the second strip surface 2300 can also be a preferred thickness that provides for accurate collection of temperature data by the sensors sewn or otherwise attached to the strip 112.

Figure 23B:
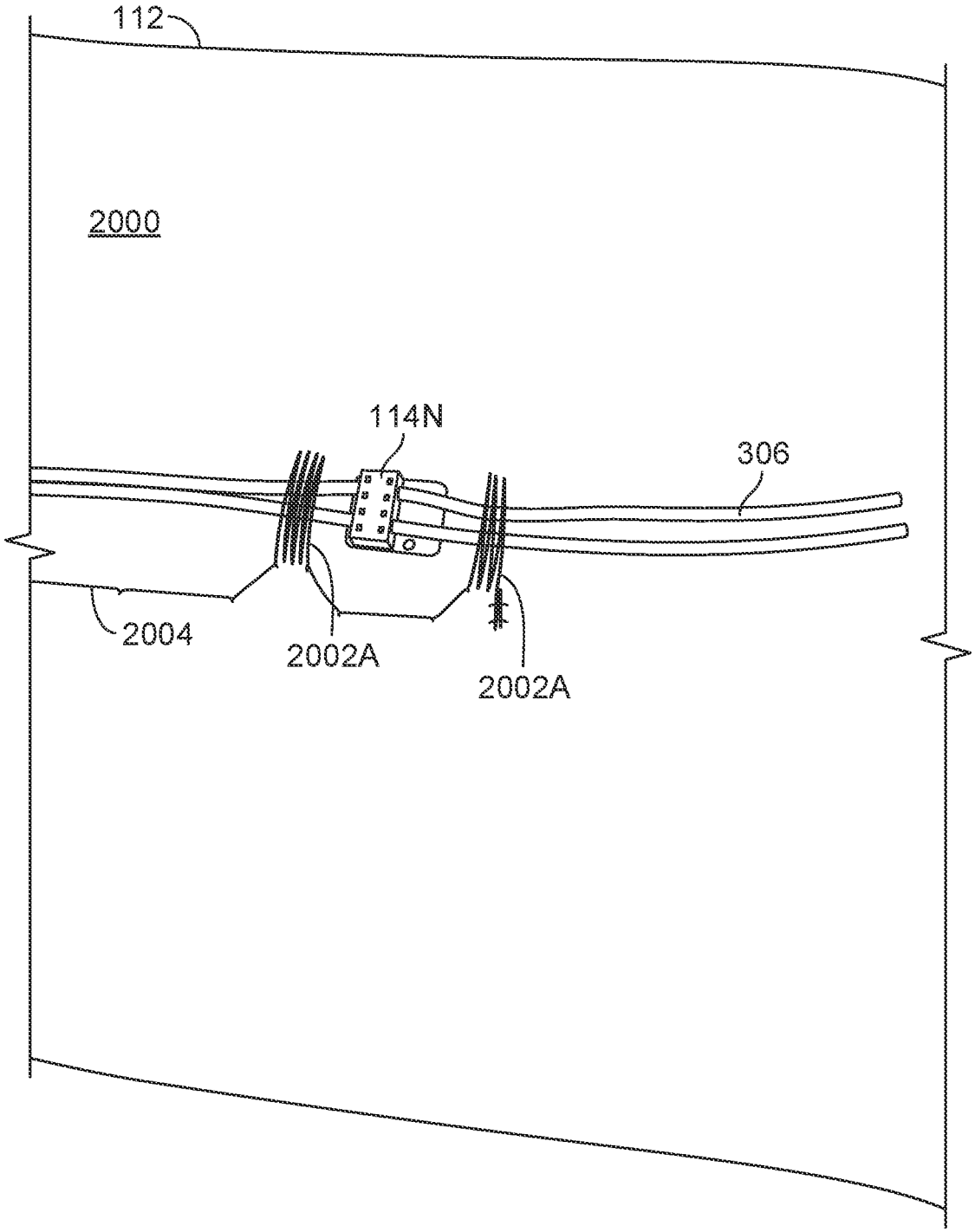
FIG. 23B is a partial explored bottom view of the sensor strip.

FIG. 23B is a partial explored bottom view of the sensor strip 112. As described in FIG. 20, the sensor 114N can be sewn to the first strip surface 2000 (which is opposite the second strip surface 2300 described in FIG. 23A) with stitching 2002A and 2004. The stitching 2002A and 2004 depicted in FIG. 23B can appear partially through the second strip surface 2300 as described in reference to FIG. 23A since the stitching 2002A and 2004 is configured to retain the sensor 114N and the wire 306 in position on the first strip surface 2300.

FIG. 24 is another side perspective view of the bed system 100 having sensor strips 1904A-B. As described in reference to FIG. 19, the bed system 100 can include first and second sides 1902A and 1902B, respectively. As shown and described herein, the sensor strip 1904A can be attached to the top surface of the foam tub 110 on the first side 1902A of the mattress 102 and the sensor strip 1904B can be attached to the top surface of the foam tub 110 on the second side 1902B of the mattress 102. The wire 306 from the sensor strip 1904B can extend over an edge and side of the foam tub 110, and down a side 1906B of the mattress 102. As shown, the wire 306 can be consolidated and organized to seamlessly and unobtrusively extend down the side 1906B of the mattress 102. In some implementations, as described above, the wire 306 can also be routed through a hole or holes that are carved into the foam tub 110.

FIGS. 25A-F illustrate example configurations for welding a sensor to the sensor strip 112 using ultrasonic welding techniques. Instead of stitching the sensors described herein to the sensor strip 112, ultrasonic welding techniques can be used. For example, a second fabric or other material can be bonded to the strip 112 using ultrasonic welding to hold a portion of the sensor and/or wire(s) attached to the sensor. The sensor can then be enveloped between the ultrasonically welded second fabric or other material and the fabric of the sensor strip 112. Moreover, the additional materials (e.g., second fabric) described in reference to FIGS. 25A-F can include but is not limited to a fabric having a fiber blend of rayon (e.g., inherent FR rayon), polyester, and para aramid. The additional materials can have a thickness within a range of approximately 0.02 to 0.033 inches and a tensile strength within a range of approximately 40 to 140 pounds.

Figure 25A:
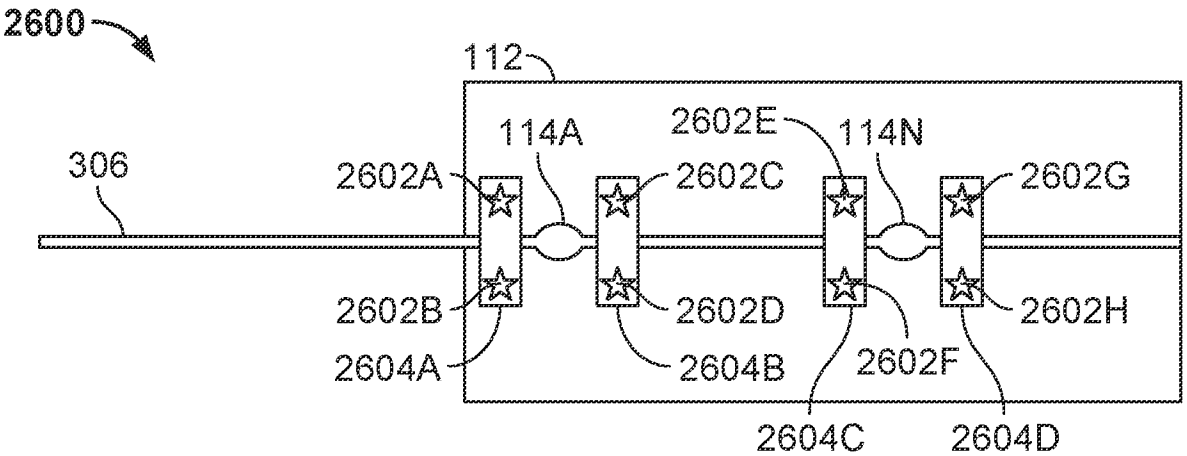
FIGS. 25A-F illustrate example configurations for welding a sensor to the sensor strip using ultrasonic welding techniques.

FIG. 25A shows an ultrasonic welding configuration 2600. Two sensors 114A and 114N are depicted as being attached to the sensor strip 112. An additional material 2604A can be welded at locations 2602A and 2602B to the strip 112 to straddle a portion of the wire 306 near the sensor 114A. An additional material 2604B can also be welded at locations 2602C and 2602D to the strip 112 to straddle a portion of the wire 306. Using the materials 2604A and 2604B, the sensor 114A is able to be cradled or otherwise maintained in position on the strip 112. Similarly, an additional material 2604C can be welded at locations 2602E and 2602F to the strip 112 to straddle a portion of the wire 306 near the sensor 114N. An additional material 2604D can also be welded at locations 2602G and 2602H to the strip 112 to straddle another portion of the wire 306 near the sensors 114N.

The welding locations 2602A-H can be close enough to the wire 306 to retain the sensors 114A and 114N in place, but also far enough apart to avoid risk of damaging or causing failure or interference with the sensors 114A and 114N. Moreover, although the additional materials 2604A-D each have two welding locations to the strip 112, the additional materials 2604A-D can also include additional welding locations to ensure that the respective sensors 114A and 114N are securely positioned and attached to the strip 112 without causing damage, failure, or interference.

Figure 25B:
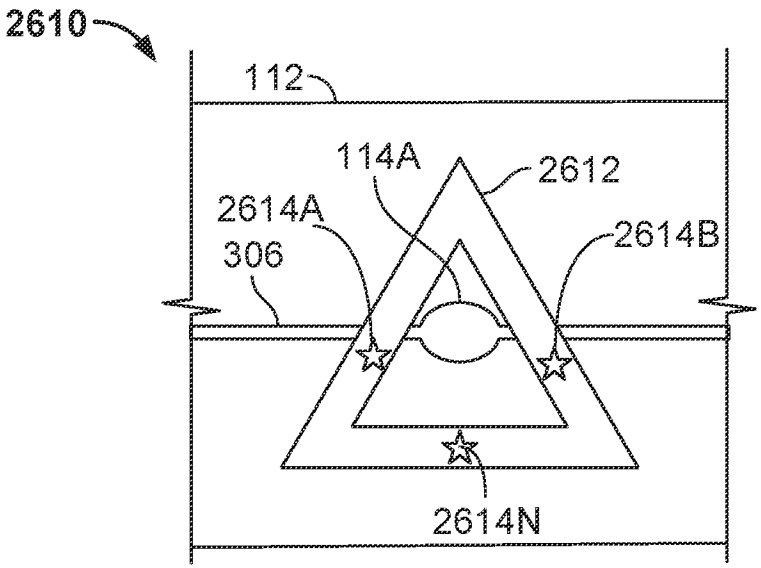

FIG. 25B shows an ultrasonic welding configuration 2610. In the configuration 2610, an additional material 2612 can form a triangle around the sensor 114A. In some implementations, the additional material 2612 can comprise multiple pieces of material (e.g., 1 piece of material per side of the triangle) that form the shape of a triangle and are welded to the strip 112 in the shape of the triangle. The additional material 2612 can be welded to the strip 112 at welding locations 2614A-N. The additional material 2612 can be welded to the strip 112 at one or more fewer or additional locations so that the additional material 2612 can retain the sensor 114A to the strip 112 without causing interference, damage, or failure. As shown in FIG. 25B, the additional material 2612 may also be welded over the wire 306 at welding locations 2614A-N that do not cause damage to the wire 306.

Figure 25C:
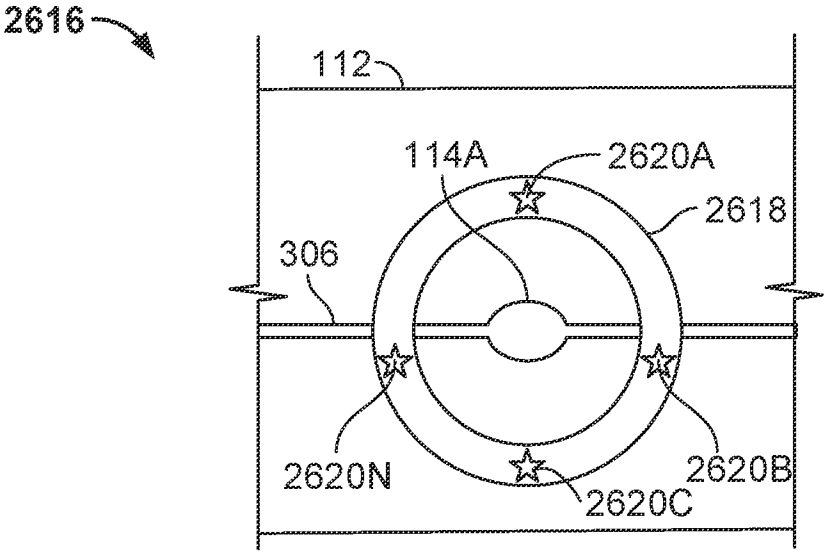

FIG. 25C shows an ultrasonic welding configuration 2616. In the configuration 2616, an additional material 2618 can form a circle (e.g., donut, oval, oblong shape) around the sensor 114A. In some implementations, the additional material 2618 can comprise multiple pieces of material that form the shape of a circle and are welded to the strip 112 in the shape of the circle. The additional material 2618 can be welded to the strip 112 at welding locations 2620A-N. The additional material 2618 can be welded to the strip 112 at one or more fewer or additional locations so that the additional material 2618 can retain the sensor 114A to the strip 112 without causing interference, damage, or failure. As shown in FIG. 25C, the additional material 2618 may also be welded over the wire 306 at welding locations 2620A-N that do not cause damage to the wire 306.

Figure 25D:
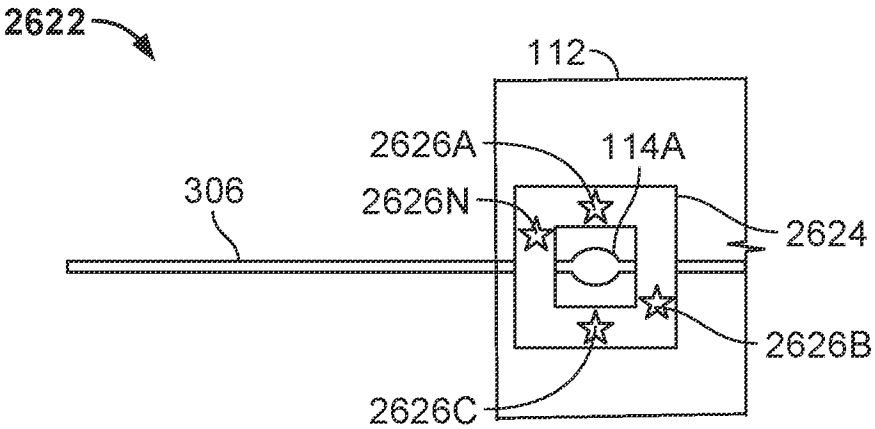

FIG. 25D shows an ultrasonic welding configuration 2622. In the configuration 2622, an additional material 2624 can form a square around the sensor 114A. The square configuration can be beneficial to reduce a quantity of pieces of additional material used to manufacture the strip 112. In some implementations, the additional material 2624 can comprise multiple pieces of material (e.g., 1 piece of material per side of the square) that form the shape of a square and are welded to the strip 112 in the shape of the square. The additional material 2624 can be welded to the strip 112 at welding locations 2626A-N. The additional material 2624 can be welded to the strip 112 at one or more fewer or additional locations so that the additional material 2624 can retain the sensor 114A to the strip 112 without causing interference, damage, or failure. As shown in FIG. 25D, the additional material 2624 may also be welded over the wire 306 at welding locations 2626A-N that do not cause damage to the wire 306.

Figure 25E:
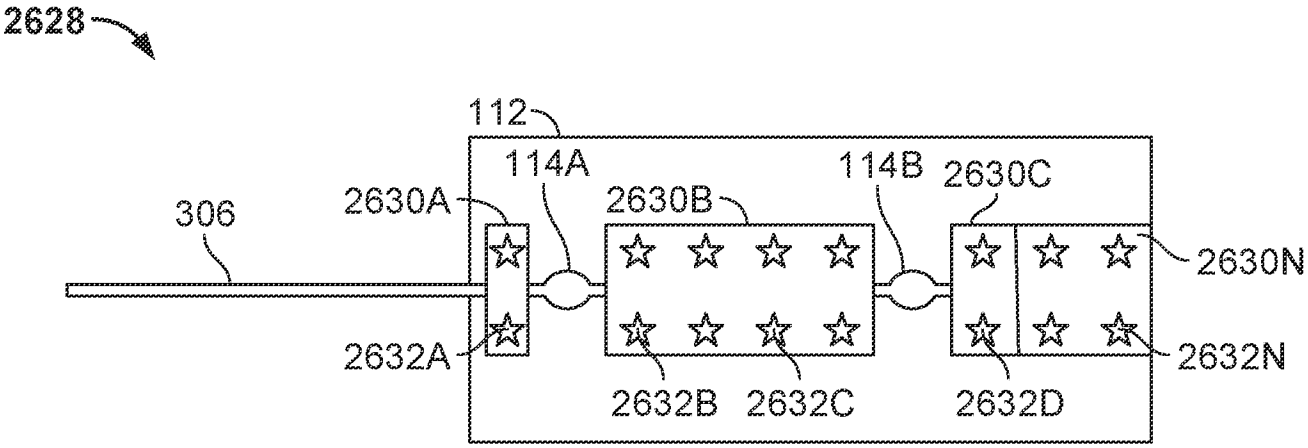

FIG. 25E shows an ultrasonic welding configuration 2628. In the configuration 2628, additional material can be welded in between sensors to provide additional support and strain relief. For example, additional materials 2630A and 2630C can be welded at at least welding locations 2632A and 2632D, respectively, to the strip 112. Refer to FIG. 25A for additional discussion about the welding configuration of the additional materials 2630A and 2630C. Another material 2630B can be welded at at least welding locations 2632B and 2632C to the strip 112, and positioned between two consecutive sensors 114A and 114B. The additional material 2630B can be longer in length to cover at least a portion of a distance between the two consecutive sensors 114A and 114B. In some implementations, the additional material 2630B can extend a length between the sensors 114A and 114B. The additional material 2630B can be beneficial to provide additional support for retaining the sensors 114A and 114B to the strip 112 while also providing strain relief in scenarios where the strip 112 may be twisted or otherwise moved around by movement on top of the strip 112.

As shown in FIG. 25E, the additional material 2630B can be welded to the strip 112 at multiple welding locations 2632B and 2632C. The additional material 2630B can also be welded to the strip 112 at one or more additional or fewer welding locations. For example, the additional material 2630B can be welded to the strip 112 at four equidistant welding locations along a top portion of the additional material 2630B and at four equidistant welding locations along a bottom portion of the additional material 2630B. One or more other welding locations are also possible.

Still referring to FIG. 25E, an additional material 2630N can also be welded to the strip 112 between the sensor 114B and a next consecutive sensor. The additional material 2630N can be welding at various welding locations, such as welding location 2632N, as described above. In some implementations, the additional material 2630C can be part of the additional material 2630N and thus forming one consecutive material between the sensor 114B and the next consecutive sensor.

Figure 25F:
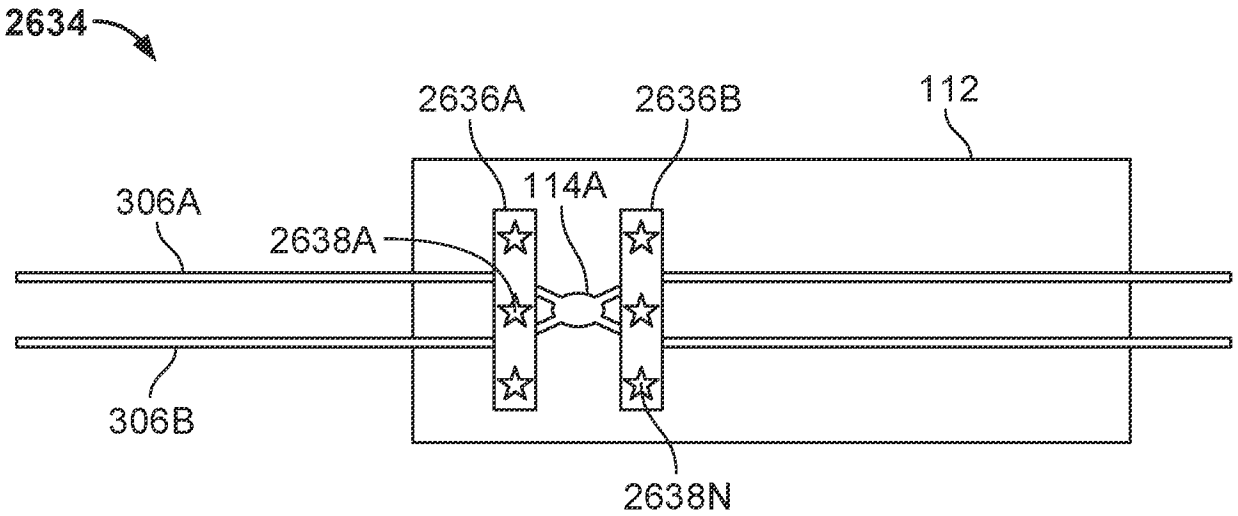

FIG. 25F shows an ultrasonic welding configuration 2634. In the configuration 2634, additional materials 2636A and 2636B can be welded to the strip 112 as described in FIG. 25A at at least welding locations 2638A and 2638N. Refer to FIG. 25A for additional discussion. In comparison to the configuration 2600 in FIG. 25A, in the configuration 2634, the wire 306 can be spread apart into wires 306A and 306B. Then, the additional materials 2636A and 2636B can be welded to the strip 112 on outer sides of the wires 306A and 306B as well as in between the wires 306A and 306B. The configuration 2634 can be beneficial to secure the sensor 114A in place but also to allow for the sensor 114A to have some movement to accurately capture temperature data. In some implementations, the configuration 2634 may include additional materials that are welded to the strip 112 in various other configurations previously described in FIGS. 25B-E.

While this specification contains many specific implementation details, these should not be construed as limitations on the scope of the disclosed technology or of what may be claimed, but rather as descriptions of features that may be specific to particular embodiments of particular disclosed technologies. Certain features that are described in this specification in the context of separate embodiments can also be implemented in combination in a single embodiment in part or in whole. Conversely, various features that are described in the context of a single embodiment can also be implemented in multiple embodiments separately or in any suitable subcombination. Moreover, although features may be described herein as acting in certain combinations and/or initially claimed as such, one or more features from a claimed combination can in some cases be excised from the combination, and the claimed combination may be directed to a subcombination or variation of a subcombination. Similarly, while operations may be described in a particular order, this should not be understood as requiring that such operations be performed in the particular order or in sequential order, or that all operations be performed, to achieve desirable results. Particular embodiments of the subject matter have been described. Other embodiments are within the scope of the following claims.

What is claimed is:

1. A mattress system comprising:

a mattress comprising a top surface, a head end, a foot end, and opposite lateral ends; and a sensor strip positioned on the top surface of the mattress, the sensor strip comprising:

a carrier strip extending at least partially between the opposite lateral ends of the mattress, the carrier strip having a longitudinal direction that extends between the opposite lateral ends of the mattress, the carrier strip comprising a first strip surface oriented to face the top surface of the mattress and a second strip surface opposite the first strip surface oriented to face away from the top surface of the mattress;

a fastener coupled to the first strip surface of the carrier strip and the mattress, the fastener configured to releasably attach the carrier strip to the mattress; and a plurality of sensors attached to the first strip surface of the carrier strip, wherein each sensor of the plurality of sensors are spaced apart from each other along the longitudinal direction of the carrier strip along the first strip surface.

2. The mattress system of claim 1, further comprising: a mattress cover disposed on a foam layer and covering a top surface of the foam layer, at least partially covering the opposite lateral ends, and at least partially covering the sensor strip, wherein the mattress cover is free of the carrier strip that is attached to the foam layer.

3. The mattress system of claim 1, wherein the plurality of sensors are stitched to the carrier strip.

4. The mattress system of claim 1, wherein the plurality of sensors are attached to the carrier strip by adhesive.

5. The mattress system of claim 1, wherein the fastener comprises: a first fastener coupled to the carrier strip, the first fastener configured to be releasably attached to a foam layer, a second fastener coupled to the foam layer, the second fastener configured to releasably attach the first fastener of the carrier strip, and the first and second fasteners comprise hook-and-loop fasteners.

6. The mattress system of claim 1, wherein each sensor of the plurality of sensors is spaced five inches apart from each other in the longitudinal direction of the carrier strip.

7. The mattress system of claim 1, wherein the sensor strip comprises micro-hooks configured to releasably attach directly to a surface of a foam layer.

8. The mattress system of claim 1, wherein the carrier strip is configured to extend between a midpoint of a foam layer and a location that is a predetermined distance away from an edge of a first lateral end of the opposite lateral ends of the foam layer, wherein the carrier strip does not extend over the edge of the first lateral end of the opposite lateral ends of the foam layer.

9. The mattress system of claim 1, wherein the carrier strip does not extend over either of opposite sides of a foam layer, and wherein the plurality of sensors comprise wires, the wires being collectively routed over an edge of a first lateral end of the opposite lateral ends of the foam layer and down one of the opposite sides of the foam layer.

10. The mattress system of claim 1, wherein the plurality of sensors comprise wires, the wires being collectively routed through at least one hole defined through a foam layer.

11. The mattress system of claim 1, wherein the sensor strip further comprises a plurality of additional materials, wherein each material of the plurality of additional materials are ultrasonically welded to the carrier strip between each of the plurality of sensors in the longitudinal direction of the carrier strip.

12. The mattress system of claim 11, wherein at least one material of the plurality of additional materials forms at least one of (i) a circle around at least one of the plurality of sensors and (ii) a triangle around at least one of the plurality of sensors.

13. The mattress system of claim 11, wherein at least one material of the plurality of additional materials forms a square around at least one of the plurality of sensors.

14. The mattress system of claim 11, wherein at least one material of the plurality of additional materials extends a length between two consecutive sensors of the plurality of sensors in the longitudinal direction of the carrier strip.

15. The mattress system of claim 11, wherein each of the plurality of additional materials is welded to the carrier strip in welding locations that straddle a wire that connects the plurality of sensors in series in the longitudinal direction of the carrier strip.

16. A sensor strip configured to be placed on a top surface of a mattress, the top surface of the mattress defining a first portion and a second portion separate from the first portion, the sensor strip comprising including:

a carrier strip having a first strip portion positioned above the first portion of the top surface of the mattress and a second strip portion positioned above the second portion of the top surface of the mattress, the carrier strip comprising a first strip surface oriented to face the top surface of the mattress and a second strip surface opposite the first strip surface oriented to face away from the top surface of the mattress;

a plurality of first sensors attached to the first strip surface of the first strip portion of the carrier strip and spaced apart from each other in a longitudinal direction of the carrier strip, the plurality of first sensors configured to sense a condition at the first portion of the top surface of the mattress;

a plurality of second sensors attached to the second strip surface of the second strip portion of the carrier strip and spaced apart from each other in the longitudinal direction of the carrier strip, the plurality of second sensors configured to sense a condition at the second portion of the top surface of the mattress; and wherein the carrier strip is configured to be releasably fastened to the top surface of the mattress and to extend between the opposite lateral ends of the top surface of the mattress.

17. The sensor strip of claim 16, wherein each of the first strip surfaces are configured to be releasably attached to the respective first portion and the second portion of the top surface of the mattress.

18. The sensor strip of claim 16, wherein each sensor of the plurality of first sensors are spaced five inches apart from each other on the first strip portion of the carrier strip and each sensor of the plurality of second sensors are spaced five inches apart from each other on the second strip portion of the carrier strip.

19. A mattress system comprising:

a top layer positioned at a mattress top and having a top surface, a head end, a foot end, and opposite lateral ends; and a sensor strip comprising:

a carrier strip releasably fastened to the top surface and only extending between the opposite lateral ends of the top layer, the carrier strip comprising a first strip surface oriented to face the top layer and a second strip surface opposite the first strip surface oriented to face away from the top layer; and a plurality of sensors attached to the first strip surface of the carrier strip and spaced apart from each other in a longitudinal direction of the carrier strip between the opposite lateral ends of the top layer.

* * * * *